US012036461B2

(12) United States Patent
Speed

(10) Patent No.: US 12,036,461 B2
(45) Date of Patent: Jul. 16, 2024

(54) SYSTEMS AND METHODS FOR PROVIDING AN ADJUSTABLE CLIMBING WALL

(71) Applicant: FAST TWITCH INDUSTRIES, LLC, Bountiful, UT (US)

(72) Inventor: Boone Speed, Salt Lake City, UT (US)

(73) Assignee: Fast Twitch Industries, LLC, Bountiful, UT (US)

( * ) Notice: Subject to any disclaimer, the term of this patent is extended or adjusted under 35 U.S.C. 154(b) by 0 days.

(21) Appl. No.: 16/952,011

(22) Filed: Nov. 18, 2020

(65) Prior Publication Data

US 2021/0275888 A1 Sep. 9, 2021

Related U.S. Application Data

(63) Continuation-in-part of application No. 16/518,751, filed on Jul. 22, 2019, now Pat. No. 11,273,353.
(Continued)

(51) Int. Cl.
*A63B 69/00* (2006.01)

(52) U.S. Cl.
CPC ..... *A63B 69/0048* (2013.01); *A63B 2225/09* (2013.01); *A63B 2225/74* (2020.08)

(58) Field of Classification Search
None
See application file for complete search history.

(56) References Cited

U.S. PATENT DOCUMENTS 4,848,737 A 7/1989 Ehrenfield
5,125,877 A 6/1992 Brewer
(Continued)

FOREIGN PATENT DOCUMENTS

BE 905390 A * 12/1986 ..... A63B 69/0048
CA 3107437 A1 1/2020
(Continued)

OTHER PUBLICATIONS

Swierzynski, "Fitness Training Over Skype" [online] (retrieved from the Internet on Dec. 10, 2019) <URL: https://blogs.skype.com/stories/2017/02/21/fitness-training-over-skype/>, Feb. 21, 2017 (Feb. 21, 2017).
(Continued)

*Primary Examiner* — Shila Jalalzadeh Abyaneh
(74) *Attorney, Agent, or Firm* — David B. Tingey; K. Russell Griggs; Kirton McConkie

(57) ABSTRACT

Systems and methods for providing climbing walls are discussed. While such systems and methods can include any suitable component, in some cases, they include a climbing wall that has a base member and a climbing surface that includes at least one climbing hold. In some cases, the climbing surface is pivotally connected to the base member. Additionally, in some cases, the system includes an anchor that is configured to adjustably retain the climbing surface at an angle with respect to the base member. In some cases, the system further includes a camera, microphone, and/or display that are configured to allow a climber to have audio and/or visual interactions with another person in a remote location (e.g., for training, competition, etc.). In some cases, at least one climbing hold on the climbing surface comprises a sensor that is configured to indicate when a climber has used that hold. Other implementations are described.

8 Claims, 53 Drawing Sheets

Related U.S. Application Data

(60) Provisional application No. 62/701,922, filed on Jul. 23, 2018.

(56) References Cited

U.S. PATENT DOCUMENTS

| | | | | |
|---|---|---|---|---|
| 6,231,482 | B1 | 5/2001 | Thompson | |
| 6,659,496 | B1 * | 12/2003 | Wilson | B60P 3/0252 414/469 |
| 6,872,167 | B1 | 3/2005 | Meissner | |
| 7,731,632 | B2 | 6/2010 | Wu | |
| 7,762,928 | B2 † | 7/2010 | Meissner | |
| 8,668,626 | B1 | 3/2014 | Horowitz et al. | |
| 8,808,145 | B1 | 8/2014 | Parsons et al. | |
| 8,951,166 | B2 | 2/2015 | Bae | |
| 9,017,224 | B1 * | 4/2015 | Singley | A63B 22/0005 482/52 |
| 9,600,716 | B2 | 3/2017 | Skjaerseth | |
| 9,770,614 | B1 | 9/2017 | Sudeith | |
| 10,918,925 | B2 * | 2/2021 | Sudeith | A63B 23/1218 |
| 2002/0169052 | A1 | 11/2002 | Godsey | |
| 2003/0228956 | A1 | 12/2003 | Paci | |
| 2006/0199627 | A1 | 9/2006 | Oliver | |
| 2008/0300111 | A1 * | 12/2008 | Meissner | A63B 69/0048 482/36 |
| 2010/0004098 | A1 | 1/2010 | Hensley | |
| 2015/0057776 | A1 | 2/2015 | Skjaerseth et al. | |
| 2017/0266533 | A1 | 9/2017 | Dalebout et al. | |
| 2018/0272214 | A1 * | 9/2018 | Ratner | A63B 71/06 |
| 2019/0009157 | A1 † | 1/2019 | Sudeith | |
| 2020/0023257 | A1 | 1/2020 | Speed et al. | |
| 2022/0016505 | A1 * | 1/2022 | Sweeney | A63B 69/0048 |

FOREIGN PATENT DOCUMENTS

| | | | | | |
|---|---|---|---|---|---|
| CA | 3199474 | | | 5/2022 | |
| CN | 1439436 | A | * | 9/2003 | |
| CN | 106215394 | A | * | 12/2016 | |
| CN | 107050775 | A | * | 8/2017 | A63B 24/0062 |
| CN | 107050775 | A | * | 8/2017 | A63B 24/0062 |
| CN | 110681138 | A | * | 1/2020 | A63B 69/0048 |
| CN | 112930218 | | | 6/2021 | |
| DE | 102005063225 | A1 | † | 6/2007 | |
| EP | 3826734 | | | 6/2021 | |
| ES | 2208074 | A1 | | 6/2004 | |
| ES | 1064328 | U | * | 3/2007 | A63B 69/0048 |
| ES | 2385599 | A1 | * | 7/2012 | A42B 3/30 |
| FR | 2623091 | A1 | * | 5/1989 | A63B 69/0048 |
| FR | 2656361 | A1 | * | 6/1991 | A63B 69/0048 |
| FR | 2682606 | A1 | | 4/1993 | |
| JP | 11347170 | A | | 12/1999 | |
| KR | 2016132564 | A | | 5/2015 | |
| WO | 8909635 | A2 | | 10/1989 | |
| WO | 2016049786 | A1 | | 4/2016 | |
| WO | WO-2016049786 | A1 | * | 4/2016 | A63B 22/02 |
| WO | 2020023453 | A1 | | 1/2020 | |
| WO | WO2022108991 | | | 5/2022 | |

OTHER PUBLICATIONS

The International Bureau of WIPO, "International Preliminary Report on Patentability" under Chapter I of the Patent Cooperation Treaty and the "Written Opinion of the International Searching Authority" issued May 16, 2023 for corresponding PCT application No. PCT/US21/59661.

The International Bureau of WIPO, "International Search Report" issued May 6, 2022 for corresponding PCT application No. PCT/US21/59661.

* cited by examiner
† cited by third party

SYSTEMS AND METHODS FOR PROVIDING AN ADJUSTABLE CLIMBING WALL

BACKGROUND

CROSS-REFERENCE TO RELATED APPLICATIONS

This is a continuation-in-part application, which claims priority to U.S. patent application Ser. No. 16/518,751, which was filed on Jul. 22, 2019, and which is entitled SYSTEMS AND METHODS FOR CLIMBING, which claims priority to U.S. Provisional Application No. 62/701,922, which was filed on Jul. 23, 2018, and which is entitled SYSTEMS AND METHODS FOR CLIMBING; the entire disclosures of which are hereby incorporated herein.

FIELD OF THE INVENTION

The present invention relates to systems and methods for climbing. More particularly, some implementations of the described invention relate to systems and methods for providing an adjustable climbing wall having a climbing surface that is readily adjustable (via one or more adjustment mechanisms) to a plurality of angles or positions. In some cases, the climbing wall also has one or more markers to identify holds in a climbing path.

BACKGROUND AND RELATED ART

Rock climbing is becoming an ever more popular sport. In this regard, rock climbing often involves climbing up, down, and/or across natural rock formations (and/or other surfaces). Rock climbing can be accomplished through a variety of climbing techniques, including, but not limited to, aid climbing (in which a climber repeatedly places and weights gear that is used to provide safety and to aid ascent), free climbing (in which a climber uses anchors, ropes, and/or other forms of protection as passive ascending aids), bouldering (in which a climber climbs relatively short routes without the use of a safety rope), solo climbing (in which a climber climbs alone, without a belay), free solo climbing (in which a climber climbs without a belay and without use of a rope or other safety equipment), deep-water solo climbing (in which a climber climbs over relatively deep water instead of the ground), roped solo climbing (in which a rope is secured at the beginning of a climb to allow a climber to self-belay as the climber advances), lead climbing (in which a lead climber ascends and passes a rope through a number of anchors that are below the lead climber), multi-pitch climbing (in which a climber breaks a route into multiple segments or pitches), and a variety of other climbing techniques. Whatever the technique, however, the goal in rock climbing is typically the same—to climb to the end of a climbing route (often the summit) without falling.

In an effort to: practice climbing, learn new climbing techniques, exercise, save travel time, train, and/or climb in a relatively safe environment, many people do at least some of their climbing on artificial rock surfaces (or other climbing surfaces). While such artificial rock surfaces have been found to be useful, they are not necessarily without their shortcomings. Indeed, some artificial rock surfaces can often be relatively difficult and time consuming to build. Additionally, some artificial climbing surfaces are quite heavy—making them difficult for most people to transport and/or assemble. Moreover, for a variety of reasons, some artificial rock surfaces can take relatively long periods of time to assemble. Additionally, the climbing routes on some artificial rock surfaces are relatively static. As a result, a climber can often become bored with such surfaces relatively quickly. Similarly, as a climber improves, some such artificial rock surfaces are not easily modifiable to continuously stretch the climber and to improve the climber's climbing ability. Furthermore, some artificial rock surfaces are relatively weak and, as a result, are somewhat likely to fail during use and to hurt a user.

Thus, while systems and methods currently exist that are used to provide climbers with an artificial rock surface for climbing, some challenges still exist, including those listed above. Accordingly, it would be an improvement in the art to augment or even replace current techniques with other techniques.

SUMMARY

The present invention relates to systems and methods for climbing. More particularly, some implementations of the described invention relate to systems and methods for providing an adjustable climbing wall having a climbing surface that is readily adjustable (via one or more adjustment mechanisms) to a plurality of angles or positions. In some cases, the climbing wall also has one or more markers to identify holds in a climbing path.

While the described climbing walls (or climbing wall system) can include any suitable component, in some cases, the described climbing walls have one or more base members and climbing panels (or climbing surfaces) that include at least one climbing grip or hold. In some cases, the climbing surface is pivotally connected to the base member, such that the climbing surface can be selectively moved (e.g., automatically, mechanically, and/or manually) to and from a variety of positions (or angles) with respect to the base member and/or the floor (which term may be used herein to refer to a floor, ground surface, support surface, and/or any other suitable surface). Additionally, in some cases, the system includes one or more supports that are configured to selectively and adjustably retain the climbing surface at one or more angles with respect to the base member. In some cases, the supports are configured to manually and/or automatically adjust the angle of the climbing wall with respect to the base (e.g., between climbs, during a climb, after a climb, and/or at any other suitable time).

In some cases, the supports comprise one or more cables, chains, come-alongs, hoists, ratcheting straps, actuators (e.g., linear actuators, cable actuators, threaded rod actuators, hydraulic actuators, pneumatic actuators, piston actuators, screw actuators, rotary actuators, fluid power linear actuators, fluid power rotary actuators, chain actuators, servos, electric actuators, and/or any other suitable type of actuators), winches, cable ratchet winches, straps, boards, arms, solid supports, bars, load bars, angle irons, legs, struts, four-bar linkages, legs, springs (e.g., compression springs, tension springs, torsion springs, coil springs, spiral springs, gas springs, mechanical lockout gas springs, full lockout gas springs, ferromagnetic gasp springs, shocks, struts, conical springs, and/or any other suitable type of springs), and/or other suitable climbing surface supports.

Indeed, in some implementations, the climbing surface supports comprise one or more legs that are configured to hold the climbing surface at a desired angle. While such legs can be disposed in any suitable location, in some implementations, at least one leg is disposed at each of two sides of the climbing surface (e.g., so as to not obstruct the climbing surface).

In some cases, the climbing surface supports comprise one or more gas springs that extend (directly or indirectly) between the climbing surface and the base member (and/or any other suitable support) so as to offset or otherwise support the weight of the climbing surface and to allow a user to move the climbing surface (e.g., automatically, mechanically, and/or manually) through a forward and/or backward range of motion without worrying that the weight of the climbing surface could fall on and injure the user. In some cases, once the gas springs help the user to be able to easily and safely move the climbing surface to a desired location, the user then locks the climbing surface in that location through the use of one or more climbing surface supports. In this regard, the user can lock the climbing surface in the desired location in any suitable manner. In some cases, the gas spring comprise a lockout gas spring that can be locked in a desired location. In some other cases, one or more bars or other rigid braces are configured to extend (directly or indirectly) from the base member to the climbing surface. In such cases, the rigid brace can be used to lock a position of the climbing surface (e.g., to retain the climbing surface in a locked position during a climb) in any suitable manner. Indeed, in some cases, the rigid brace is pivotally coupled at one end to the base member, and the other end of the brace has a variety of holes that allow a pin to be slid through one or more of the holes to lock the climbing surface in place.

In some cases, the climbing surface supports comprise one or more actuators that are configured to move the climbing surface to any desired location in a range of motion. Indeed, in some cases, the actuator is configured to move from −10 degrees less than vertical to 60 degrees overhanging, to within any suitable subrange thereof (e.g., −5 degrees less than vertical to 55 degrees overhanging). Where the system comprises one or more actuators, the actuators can be used in any suitable configuration, including, without limitation, in a tension and/or a compression position. That said, in some cases, the actuator is used in a compression (or a pushing) configuration.

Where the climbing wall system and/or the climbing surface supports comprise one or more actuators, the system can comprise any suitable number of actuators. Indeed, the system can comprise 1, 2, 3, 4, 5, 6, 7, 8, or more actuators. In some implementations, however, the system comprises a single actuator that is configured to move the climbing surface through a forward and/or backward range of motion and/or to selectively retain the climbing surface at one or more desired positions. In this regard, using a single actuator can provide a variety of features to the system, including, without limitation, avoiding the hassle of syncing multiple actuators, reducing the cost of the system, causing less wear on the system, making the system more economical, and/or reducing the system's weight.

Where the climbing wall comprises one or more actuators, the actuators can be disposed in any suitable location. For instance, some implementations comprise one or more actuators that extend from the base member (and/or any other suitable support) to the climbing surface (e.g., at one or more sides of the climbing surface).

In some other cases, one or more actuators are disposed behind at least a portion of the climbing surface. In such cases, the climbing wall can have any suitable component and function in any suitable manner. For instance, some implementations include a climbing surface that is configured to selectively move forward through a forward range of motion and backward through a backward range of motion, with the climbing surface comprising multiple climbing hold couplers that are each configured to hold a climbing hold on a front side of the climbing surface. In some such cases, the climbing surface is pivotally coupled to a first support (e.g., the base member and/or any other suitable support). Additionally, in some such cases, a lever arm has a first portion (e.g., a first end) that is pivotally coupled at a first coupling to a second support (e.g., the base member and/or any other suitable support). In some cases, the system further includes one or more lever arm couplers that have a first part (e.g., a first end) that is coupled to a second portion (e.g., a second end) of the lever arm at a second coupling and that have a second part (e.g., a second end) that is coupled to the climbing surface (e.g., at the back and/or a side of the climbing surface) at a third coupling. Moreover, in some cases, an actuator has a first section (e.g., a first end) that is coupled to a third support (e.g., the base member and/or any other suitable support) and a second section (e.g., a second end) that is coupled to the lever arm at a fourth coupling in such a manner that as the climbing surface moves through the forward range of motion, a weight of the climbing surface rests on the actuator (e.g., the actuator is under compression). In such cases in which the actuator is under compression, if the actuator were to fail, the weight of the climbing surface would still compress the actuator and, even if the actuator shortened to its shortest length, the actuator would prevent the climbing surface from falling on the user (e.g., and pancaking the user against the floor, under the weight of the climbing wall).

While the actuator can be placed under compression in any suitable manner, in some cases, the climbing wall system comprises a four-bar linkage (or four-part linkage), with at least some weight of the linkage resting on the actuator. In some such cases, the base member (e.g., serving as the first, second, and/or third support) acts as the first part of the linkage, the lever arm acts as the second part, the lever arm coupler acts as the third part, and the climbing surface acts as the fourth part of the four-part linkage. In this regard, as the actuator is coupled to the lever arm at the fourth coupling, a significant portion of the weight of the four-part linkage rests on the actuator. In this regard, while a four-part linkage can perform any suitable function, in some cases, it allows for the climbing surface to move through a relatively large range of motion (e.g., greater than about 45 degrees), while the linkage itself takes up a relatively small amount of space.

In some cases in which the climbing wall comprises a four-part linkage, the wall comprises one or more gas springs to reduce and/or a load on the actuator. In this regard, the gas springs can be disposed in any suitable location that allows the wall to function as described. Indeed, in some cases, one or more gas springs are disposed on one or more sides of the actuator, with the gas springs being coupled to the lever arm (e.g., at and/or adjacent to the fourth coupler).

The various couplings or joints on the lever arm (e.g., the joint that connects the lever arm to the base member (or other support), the joint that couples the lever arm coupler to the lever arm, and/or the joint that couples the actuator to the lever arm) can be disposed in any suitable location in relation to each other. In some implementations, the three joints or couplings are disposed linearly on the lever arm (e.g., such that a single straight line can pass through all of them). In some other cases, however, the three joints are disposed in a non-linear configuration. Indeed, in some cases, the three joints are disposed in a triangular configuration (e.g., when viewed from a side). In some such cases, by having the joints be disposed in a non-linear configuration, the actuator can control a placement of the climbing wall with relatively little movement.

In addition to or in place of the climbing surface supports and/or four-part linkage, the climbing wall system can comprise any suitable component or components that allows the climbing surface to be pivoted and/or to otherwise be adjusted to one or more positions. Indeed, in some implementations, the system comprises one or more hinges, pivot joints, coupling mechanisms, catches, pins with corresponding receptacles in which one or more pins placed in one or more receptacles to hold the wall in a certain position, ratcheting mechanisms, brakes, and/or any other suitable component that allows an angle of the climbing surface to be selectively adjusted and/or locked in place with respect to the base member and/or the floor.

In some cases, the climbing wall is configured to raise a lower edge of the climbing surface further up off the floor as the climbing surface is leaned forward through at least a portion of the climbing surface's forward range of motion. Where the lower end of the climbing surface is configured to raise through at least a portion of the surface's forward movement, the wall can comprise any suitable mechanism that is configured to perform such a function. Some examples of such mechanisms include one or more guides, linkages, cams, pivot joints, and/or other mechanisms that are configured to raise a lower edge of the climbing surface as the surface leans forward. In some cases, however, the lower edge of the climbing surface is coupled to one or more camming couplers. While such camming (or cam) couplers can have any suitable characteristic that allows them to cause the lower edge to raise when the surface moves forward and/or to lower when the surface is leaned, in some cases, the cam couplers are configured to extend from and/or past the front face (or climbing face) of the climbing surface and that couple the climbing surface to the base member (and/or to any other support).

In some cases, the climbing wall system further includes one or more cameras, microphones, speakers, processors, displays, sensors, transmitters, communication devices, light boards showing information about holds (e.g., whether or not: they have been touched, they are on a chosen path, etc.) on another climbing wall, and/or any other suitable components that are configured to allow a climber (wherein such term may refer to any user) to monitor and/or have audio, visual, and/or any other suitable type of interactions with another person in a remote location (e.g., for training, competition, gaming, companionship, etc.). Indeed, in some implementations, each system comprises one or more screens, cameras, and/or sensors to allow a user of one wall to monitor a user on another wall.

In some implementations, at least one climbing hold on the climbing surface comprises one or more sensors that are configured to indicate when a climber has and/or has not used that hold and/or how that climber used the hold (e.g., a direction in which the climber applied weight to the hold). Accordingly, in some cases, the described systems can: track a climber's movements on the climbing surface; adjust proposed climbing routes based on the climber's location, past climbs, another climber's activities, and/or any other suitable factor; automatically modify an angle of the climbing surface based on climber input (and/or any other suitable input or command); notify others (e.g., a climber on another climbing wall) of the routes and/or location of the climber; track the amount of weight placed on particular holds; track the time spent on a particular hold; allow climbers to "gamify" their climbing experience; allow multiple climbers to compete against (and/or inspire) each other; and/or can perform any other suitable function.

In some cases, the described climbing walls are configured to provide moisture to at least one of the climbing surface, a climbing hold, the base member, and/or the climber. As a result, some implementations of the climbing wall can simulate dew, moisture, rain, springs, and/or other moist circumstances that a climber may find in nature.

In some implementations, the described climbing walls comprise one or more projectors, processors, displays, and/or other components that are configured to help give the climbing wall the appearance of a natural and/or fabricated climbing surface. In some cases, this appearance is dynamic, being able to be changed as desired by a climber and/or any other suitable person or program.

In some cases, the described climbing wall comprises one or more light sources that are configured to light up (or otherwise identify) one or more holds and/or climbing courses, to indicate which hold should be used next, to indicate which holds have been used, to track a climber's path, to indicate the holds that another climber is using (e.g., in real time or in near real time) and/or has used, to indicate which holds are part of a particular path, to indicate the difficulty of a particular hold and/or climbing path, and/or for any other suitable purpose. In some such cases, one or more lights are coupled to the climbing surface (e.g., to a climbing panel) and/or to the base member so as to be disposed near one or more climbing holds (or holds). Additionally, in some cases, one or more of the holds themselves comprise one or more such light sources (e.g., LEDs, incandescent lights, and/or any other suitable lights sources).

Where a hold comprises a light source (e.g., one or more LEDs, multi-color LEDs, lights, and/or any other suitable light source), the light source can be disposed in any suitable portion of the hold, including, without limitation, in a center of the hold, being substantially centered in a face of the hold, being offset from a center of the hold, being in a hole that is typically used to bolt the hold to a climbing surface, being at a perimeter of the hold, and/or in any other suitable location. In some cases, however, the light source is disposed in a substantially central hole of the hold (e.g., in a hole that is typically formed in the hold to receive a bolt and/or any other suitable fastener so as to secure the hold to a surface (e.g., the climbing panel)).

In some cases in which one or more holds comprise one or more light sources, the holds optionally comprise one or more lenses to cover, protect, diffuse light from, and/or otherwise cover the light source. In some such cases, the lens is recessed within and/or flush with a surface of the hold. In some other cases, however, a portion of the lens and/or the light source is configured to extend from a portion of hold (e.g., such that light from the light source is easily visible on the hold, even if the climber is above, below, and/or at any other suitable location with respect to the hold).

In some cases, the climbing surface comprises one or more addressable light sources, including, without limitation, addressable: LEDs, lights, LED strips, and/or light strips. In this regard, one or more portions (and/or light sources of) the addressable light source can be selectively illuminated to identify one or more holds. Indeed, in some cases, the addressable light sources are configured to light up one or more holds on a particular climbing path, identify a starting hold, identify an ending hold, identify a challenge of a hold, identify a hold that is outside of a path, identify a hold that was used by another climber (e.g., on that particular climbing wall, remotely, and/or otherwise), identify a location of another climber (e.g., on another wall in a remote location and/or otherwise), and/or to perform any other suitable purpose.

Where the climbing wall comprises one or more addressable light sources, the addressable light sources can emit any suitable color and/or combination of colors. Indeed, in some implementations, each addressable light strip or light source is configured to produce a single-color light. In some other implementations, however, multiple addressable light strips and/or other addressable light sources that each produce a different color are combined together and/or are otherwise disposed close to each other. In still other implementations, one or more addressable light strips and/or other addressable light sources are configured to produce multiple colors of light.

In some cases, the addressable light strips or light sources associated with one or more holds (or potential hold locations) can be changed or illuminated: as one color (e.g., to green or any other suitable color) when a particular hold is a starting hold in a route, to another color (e.g., to red or any other suitable color) when a particular hold is an ending hold in a route, to another color (e.g., to yellow and/or any other suitable color) when a particular hold is on desired climbing path or route, to another color (e.g., purple) when a hold is to be used for feet, to another color (e.g., blue) when a hold is to be used for hands, and/or can otherwise have its color changed to convey any suitable information. Additionally, in some cases, one or more portions of one or more addressable light sources are configured to be: caused to increase and/or decrease in intensity, caused to blink, caused to turn on and off at particular times, and/or to otherwise modify the light signal they produce so as to convey information.

Where the climbing wall comprises one or more addressable light strips or other addressable light sources, such light sources can be disposed in any suitable location with respect to the wall and in any suitable manner. Indeed, in some cases, the addressable light strips are placed on top of (or at an external surface of) a climbing face of the climbing surface. In some cases, one or more addressable light sources are disposed behind an external surface of the climbing surface (e.g., at a back surface of the climbing surface where one or more climbing panels comprise a translucent material, such as poly(methyl methacrylate)). Additionally, in some cases, the climbing surface defines one or more channels, holes, grooves, and/or other recesses, with one or more addressable light sources being disposed in the recesses. In some such cases, the recesses can be formed in the climbing surface (e.g., one or more climbing panels) in any suitable manner, including, without limitation, through the use of a computer numerical control (CNC) machining tool, a router, a saw, a mold, a press, a stamp, a drill, a chisel, 3D printer, and/or in any other suitable manner. Indeed, in some cases, one or more channels (e.g., for receiving the addressable light sources) are formed in the climbing surface through the use of a CNC machine.

In some implementations in which one or more addressable light sources are disposed below an external face of the climbing surface of the climbing wall (or a surface of the climbing wall which is configured to hold one or more climbing holds for climbing), the addressable light sources are left uncovered. In some other cases, however, one or more of the addressable light sources are covered with a translucent covering. In this regard, the addressable light sources can be covered with any suitable translucent covering, including, without limitation, one or more pieces of plastic, glass, polymer, ceramic, natural materials, synthetic materials, and/or any other suitable materials that are at least partially translucent so as to allow the addressable light source to identify one or more particular holds and so as to protect the addressable light source.

Where the climbing wall has one or more addressable light sources, the addressable light sources can be disposed in any suitable pattern on the climbing wall. Indeed, in some cases, one or more addressable light (e.g., LED) strips are arranged vertically along a length of the climbing surface. For instance, some implementations of the climbing surface comprise 1, 2, 3, 4, 5, 6, 7, 8, 9, 10, or more light strips that run vertically in the climbing surface and are spaced apart from each other so as to fit one or more holds between them. In some other implementations, one or more addressable light sources (e.g., addressable light strips) run horizontally in the climbing surface and are spaced apart from each other (e.g., so as to fit one or more holds between them).

In still other implementations, one or more addressable light sources are disposed in proximity to one or more holds and/or possible hold locations. Indeed, in some implementations, one or more addressable light strips border one or more edges, circle, extend around, are disposed near, and/or otherwise are configured to identify one or more holds (and/or possible hold positions). In still other implementations, one or more addressable light sources are disposed diagonally (e.g., diagonally in one direction, diagonally in two patterns that cross-hatch each other, in an argyle configuration, and/or in any other suitable diagonal pattern) so as to allow one or more portions of the addressable light sources to be lit up to identify one or more holds (or potential hold locations). Additionally, in some implementations, one or more addressable light sources extend across one or more borders of the climbing surface and/or panel (e.g., a top side, a bottom side, a right side, a left side, and/or any other suitable portion) and are configured to light up specific lights (or portions of the addressable light source) so that a user can identify one or more particular holds or hold spots (e.g., by identifying a hold that corresponds to an intersection point of light sources that light up on both a horizontal (or X) axis and a vertical (or Y) axis of the climbing surface).

Where the climbing wall comprises one or more climbing panels and/or climbing surfaces, the addressable light sources on the panel and/or surfaces can electrically couple with each other, to a processing unit, to a smartphone, to a tablet, and/or to any other suitable component in any suitable manner, including, without limitation, wirelessly (e.g., via WiFi, BLUETOOTH', radio signals, short range communications, and/or in any other suitable manner) and/or via one or more wired connections. Indeed, in some cases, one or more portions of the various surfaces (e.g., a back surface, a side surface, and/or any other suitable portion of one or more panels) comprises one or more electrical connection interfaces (e.g., one or more plugs, sockets, leads, clips, electrical contacts, electrical connectors, and/or any other suitable electrical connectors). In some cases, however, each of the panels (and/or climbing surfaces) comprises a flush mounted electrical coupler on its back side (and/or in any other suitable location). Thus, in some cases, one or more panels and/or climbing surfaces can be added to and/or removed from the climbing wall in a plug-and-play manner and without ruining cords or wires (e.g., as the climber climbs on the climbing surface).

In some cases, in place of and/or in addition to the addressable light sources, the climbing wall comprises wiring for addressable light sources and the holds themselves comprise a light source (e.g., one or more LEDs, light bulbs, etc.) and one or more electrical contacts (e.g., to electrically contact a light in the hold with the wiring for the addressable light source in the climbing wall). In some cases, when the hold is bolted (or otherwise coupled) to the climbing wall, contacts from the hold are forced into contact with the electrical contacts of the wiring for the addressable light sources.

With respect to the holds, although the holds can couple to the climbing wall in any suitable manner, including, without limitation, by having one or more bolts and/or other suitable fasteners extend through an opening in the hold and be coupled with a threaded coupler of (e.g., a T-nut, a nut, and/or any other suitable threaded coupler of) and/or directly into the climbing wall, in some cases, one or more threaded couplers (e.g., screws and/or any other suitable threaded couplers) extend through a portion of the climbing wall and are threadedly anchored within the hold. Indeed, in some cases, to prevent the hold from twisting on the climbing wall (and/or any other object to which the hold is coupled), two or more set screws, wood screws, grabber screws, nails, and/or any other suitable fasters extend through a portion of the climbing wall (and/or another suitable object), through a back side of the hold (e.g., a portion of the hold that interfaces with the climbing wall and/or other object), and into a portion of the hold.

While the holds on the climbing surface can be in any suitable location (e.g., coupled to one or more positions on a grid of holes and/or other coupling mechanisms on the climbing surface), in some cases, the holds are disposed in a pattern that is analogous to a yoga mat. Indeed, in some embodiments, the holds are carefully placed in specific locations that help promote a "ladder-like", a "left-right-left-right", and/or any other suitable routine. Moreover, in some cases, careful planning and expertise in climbing movement and awareness is utilized to create natural feeling routines for both hand and foot movement as well as for correct body positions. Thus, in some cases, the described climbing wall allows climbers of virtually every ability to properly learn moves (e.g., like katas in karate, asanas in yoga, etc.).

Indeed, in some cases, specific sequencing of holds and corresponding "flows" on the climbing wall allow climbers of every ability to build and maintain comprehensive strength and awareness for climbing. Additionally, in some cases, the sizing of the holds is carefully optimized for a wide range of climbers. Moreover, in some cases, the climbing holds (or flow holds) are substantially symmetrical and/or are shaped for uses as a natural "pull down" hold, like a ladder rung. In some cases, one or more of the holds are also configured to be flipped (or rotated) to make the hold an "under-cling" hold, where the fingers are pointing up when grabbing the hold (e.g., to work the biceps and provide body tension in a specific way). In some cases, the exact shapes of the holds and their locations on the climbing surface are specific to the flow concept of movement awareness, with coordination and asana-like "flow" for climbers of all skill levels. In this regard, having holds that a climber can grab from the top and the bottom is believed to be unique. Additionally, some implementations of the flow holds have radii that are configured to be ergonomic for fingers at every angle from −10 degrees slab to 70 degrees overhanging (and/or at any other suitable angle). Additionally, in some cases, flow holds are placed in a mirrored pattern and/or a substantially symmetrical pattern on the climbing surface (e.g., to promote a balanced practice).

While the methods and processes of the present invention may be particularly useful for providing a climbing wall with a single climbing surface, those skilled in the art will appreciate that the described systems and methods can be used in a variety of different applications and in a variety of different areas of manufacture. For instance, the described systems and methods can be used to provide: a climbing wall having multiple climbing surfaces that are independently adjustable, a climbing surface comprising multiple independently adjustable panels within the climbing surface, a climbing wall comprising multiple panels and/or climbing surfaces that are configured to be adjusted together, a climbing surface that includes one or more volumes, a treadmill climbing wall, and/or a foldable origami-style that allows a fluid manipulation of the angles of one or more features of a wall. Manipulation for this foldable origami-style can include continuous or non-continuous hinge points of any suitable type of: metal, nylon, wood, board, polypropylene, ultra-high-molecular-weight polyethylene, light-weight high-strength oriented-strange polyethylene gels, dyneema, poly-paraphenylene terephthalamide, Kevlar, polymers, woven fabrics, and/or in any other suitable climbing surface.

The various features of the described wall (e.g., climbing surface movement, movement of individual panels, lights, water features, fans, displays, etc.) can be controlled in any suitable manner. Indeed, in some embodiments, the various features of the wall are manually controlled. In some other embodiments, one or more of the described features are controlled via one or more programs and/or sensors. In some embodiments, one or more of the features are configured to be controlled by a user interface that is coupled to the climbing wall. In some embodiments, however, one or more features of the climbing wall are configured to be controlled by a remote device (e.g., a remote control, a smartphone, tablet, laptop and/or any other suitable device).

In addition to the aforementioned features, the climbing wall can be modified in any suitable manner. For instance, in accordance with some implementations, the system is capable of moving the climbing surface through a relatively large range of motion (e.g., up to 130 degrees, or any suitable amount less). Indeed, in some implementations, the system is configured to pivot one or more climbing surfaces through a range of motion that is greater than about 30 degrees (e.g., that is between about 35 degrees and about 80 degrees, or within any subrange thereof). In some cases, for instance, the system is configured to pivot the climbing surface up to total range of motion that is selected from between about 40 degrees and about 70 degrees (e.g., 60 degrees±5 degrees).

In some implementations in which the climbing surface is configured to move through a large range of motion, the climbing wall is configured to fold down to be a bed (e.g., acting as a Murphy bed), a table, and/or any other suitable structure. Additionally, in some cases, the climbing surface is configured to follow an animated route (e.g., by having the climber follow a pattern of specific movements that are designated by a series of illuminated holds in order). Additionally, in some cases, the climbing surface is configured to change its angle during an animated session (e.g., while the climber is on the climbing wall).

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other features and advantages of the present inventions are obtained, a more particular description of the described inventions will be rendered by reference to specific embodiments thereof, which are illustrated in the appended drawings. Understanding that the drawings are not necessarily drawn to scale or in proper proportion, and that the drawings depict only typical embodiments of the present inventions and are not, therefore, to be considered as limiting the scope of the inventions, the present inventions will be described and explained with additional specificity and detail through the use of the accompanying drawings in which:

FIGS. 13-21A illustrates various views of multiple representative embodiments of the adjustable climbing wall;

DETAILED DESCRIPTION OF THE INVENTION

The present invention relates to systems and methods for climbing. More particularly, some implementations of the described invention relate to systems and methods for providing an adjustable climbing wall having a climbing surface that is readily adjustable (via one or more adjustment mechanisms) to a plurality of angles or positions. In some cases, the climbing wall also has one or more markers to identify holds in a climbing path.

The following disclosure of the present invention is grouped into two subheadings, namely "Systems and Methods for Providing a Climbing Wall" and "Representative Operating Environment." The utilization of these subheadings is for convenience of the reader only and is not to be construed as being limiting in any sense.

Systems and Methods for Climbing

Figure 1A:
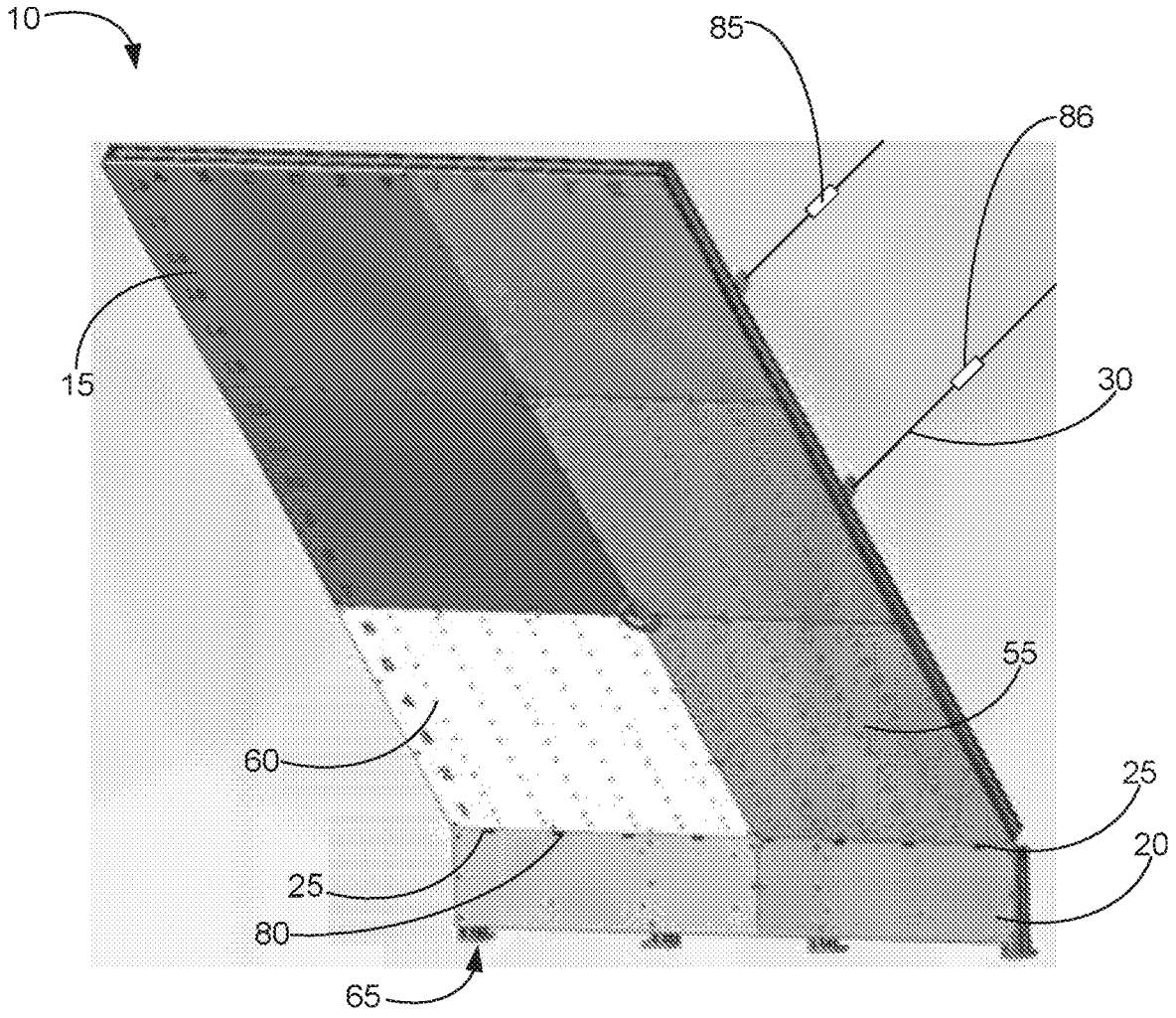
FIG. 1A illustrates a front perspective view of a representative embodiment of an adjustable climbing wall.

As mentioned, the described invention relates to systems and methods for climbing. More particularly, the described systems and methods relate to a climbing wall that has a climbing surface that is selectively adjustable so that an angle of the climbing wall can be varied to any of a plurality of different positions. While the climbing wall can comprise any suitable component that allows it to function in such a manner, FIG. 1A shows a representative embodiment in which the climbing wall (or the system) 10 comprises one or more climbing surfaces 15, base members 20, pivoting members 25, and/or climbing surface supports 30.

With respect to the climbing surface 15, the climbing surface can comprise any suitable component that allows a climber to climb on it, and that allows the climbing surface's position to be selectively adjusted. Indeed, in some embodiments, the climbing surface comprises one or more frames and/or climbing panels.

Figure 2:
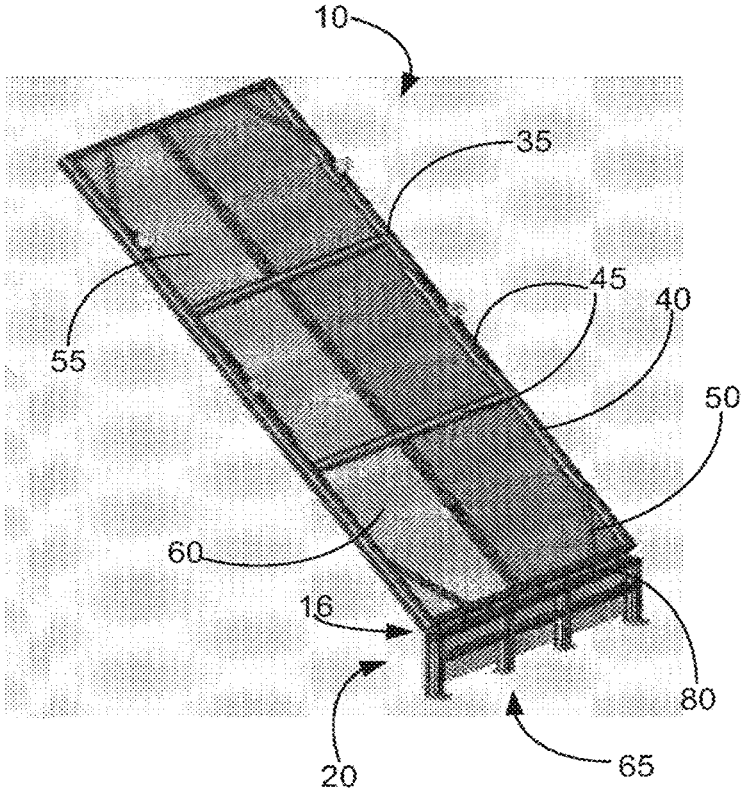
FIG. 2 illustrates a back-perspective view of a representative embodiment of the adjustable climbing wall.

With regards to the frame, the frame can comprise any suitable component that allows it to support one or more climbing panels and that allows the frame (and hence the climbing surface 15) to have its position to be selectively adjusted. In some embodiments, the frame comprises one or more frameworks, scaffolds, trusses, structures, supports, ribs, rods, horizontal supports, vertical supports, diagonal supports, struts, crossbars, braces, skeletons, angle irons, pipes, bars, sheets of material, and/or other support structures that are capable of supporting one or more climbing panels. By way of non-limiting illustration, FIG. 2 shows an embodiment in which the frame 35 comprises a framework 40 of crossbars 45 and braces 50 that are configured to be coupled to one or more climbing panels 55. In this regard, the frame is configured to be coupled to the panels in any suitable manner, including, without limitation, via one or more bolts, screws, threaded engagements, rivets, welds, clamps, mechanical engagements, frictional engagements, adhesives, glues, straps, crimps, nails, staples, fasteners, belts, ties, clips, couplers, and/or in any other suitable manner. In some embodiments, however, the panels are bolted to the frame.

Turning now to the climbing panels 55, the panels can comprise any characteristic and component that allows a climber to climb up the climbing surface 15. Indeed, in some embodiments, the climbing panels each comprise one or more: relatively flat surfaces, contoured surfaces, three dimensional volumes, surfaces that are shaped to resemble a natural rock surface, surfaces with built-in climbing holds, smooth surfaces, texturized surfaces, and/or any other suitably shaped surfaces that include (and/or are capable of including) one or more climbing holds. By way of illustration, FIG. 1A shows an embodiment in which the climbing panels 55 are relatively flat. In some other embodiments, however, the panels comprise one or more raised and/or indented surfaces (e.g., that are configured to resemble a natural climbing surface, a specific climb, an angled surface, and/or any other suitable surface).

Although some embodiments of the climbing panels 55 comprise one or more permanent climbing holds (e.g., holds that are integrally formed with, on, in, and/or that are permanently attached to the panels), in some other embodiments, the panels are configured to have one or more holds be selectively coupled to and/or be decoupled from the panels. In such latter embodiments, the holds (e.g., jugs, mini-jugs, slopers, pockets, pinches, crimps, open hand holds, joeys, cobbles, mono holds, jibs, pitted holds, morphology holds, splines, mud holds, sunspots, nibs, wood holds, stone holds, plastic holds, metal holds, ceramic holds, synthetic holds, holds comprising a natural material, finger holds, holes, and/or any other suitable holds) can selectively couple to and decouple from the panels in any suitable manner. In this regard, the holds can be bolted, clamped, screwed, glued, nailed, stapled, twisted into, fastened, attached via a mechanical engagement, attached via a frictional engagement, and/or otherwise be attached to the panels.

Figure 21A:
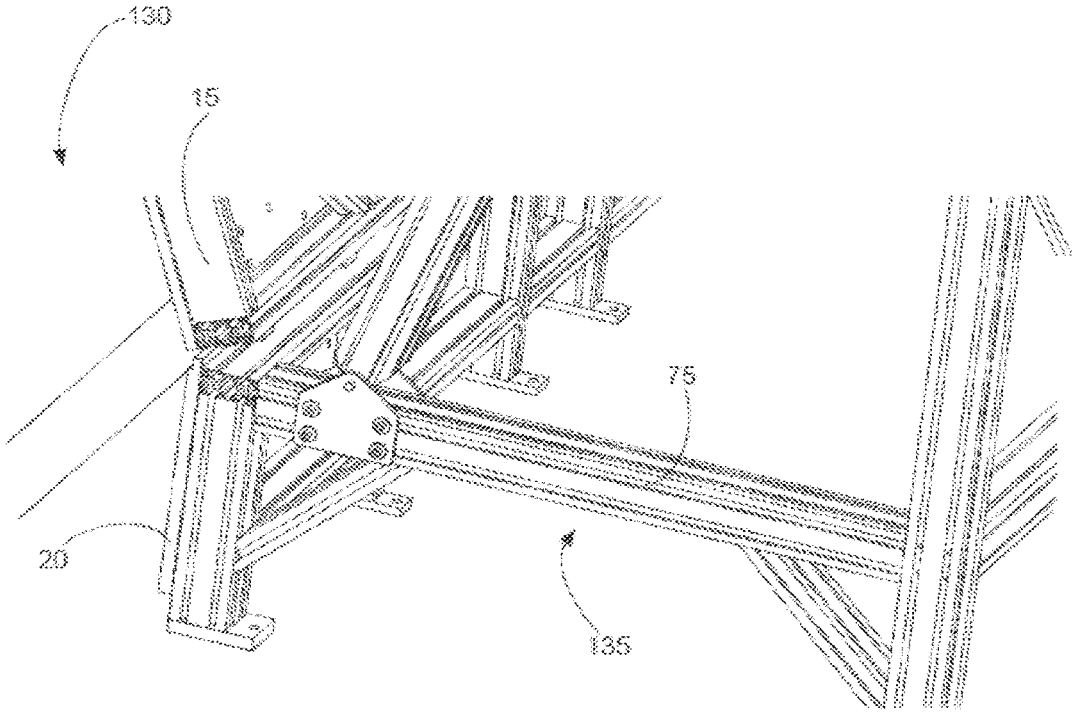
Figure 21B:
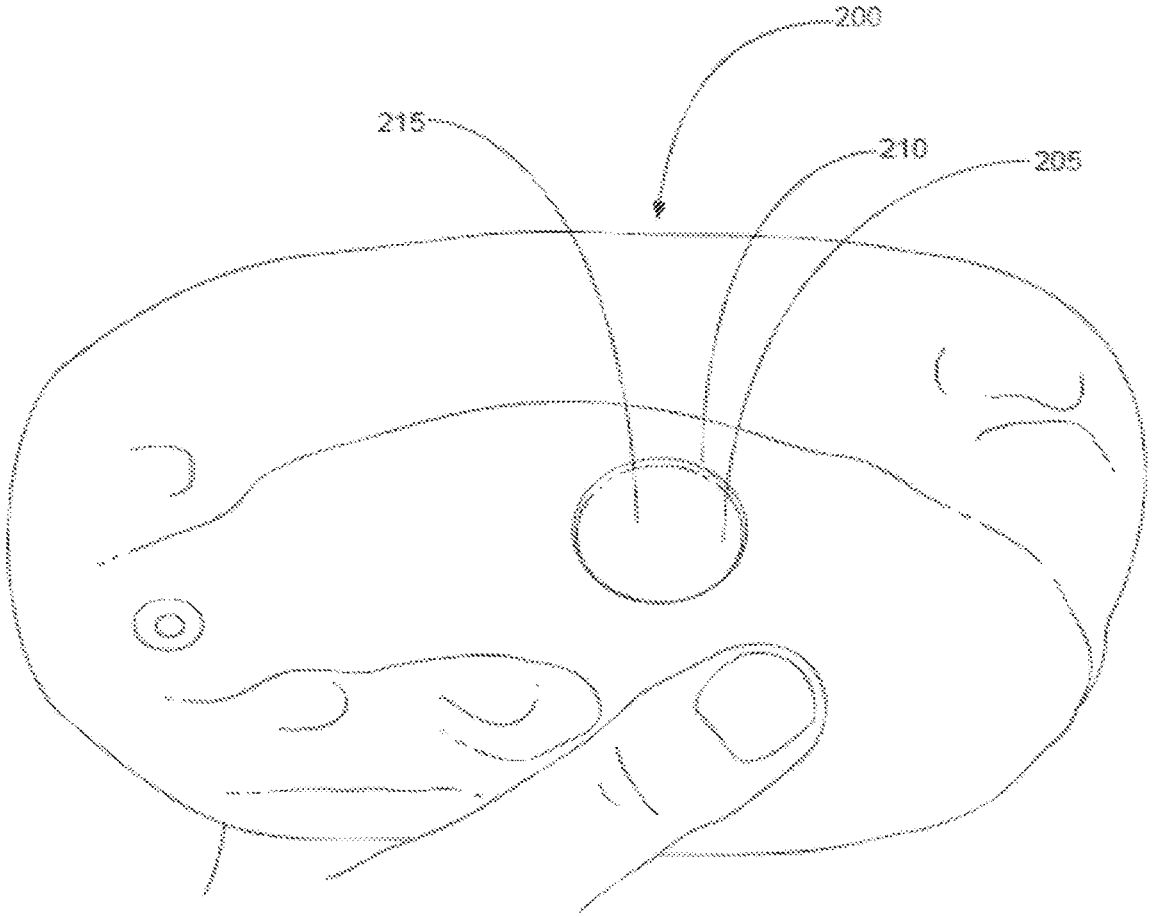
FIGS. 21B-21C each illustrate a view of a climbing hold comprising a light source and a lens in accordance with a representative embodiment.
Figure 21C:
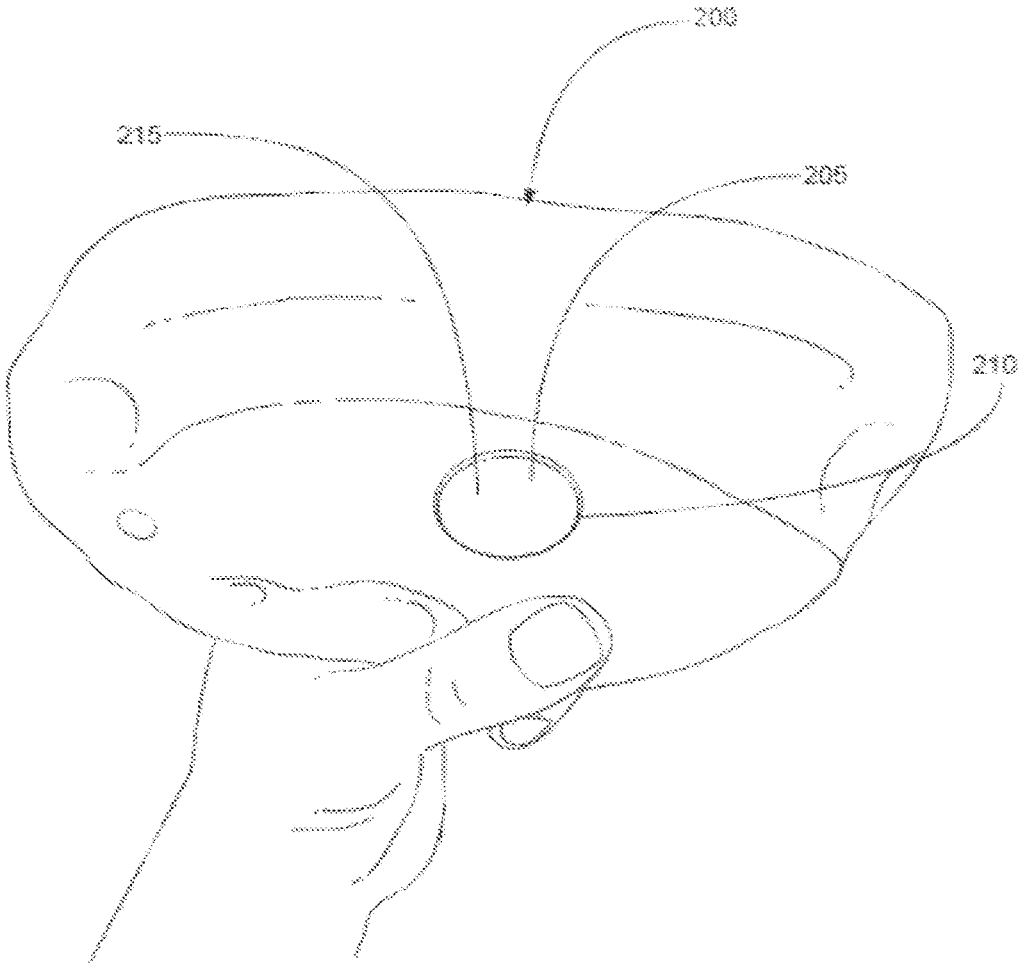
Figure 21D:
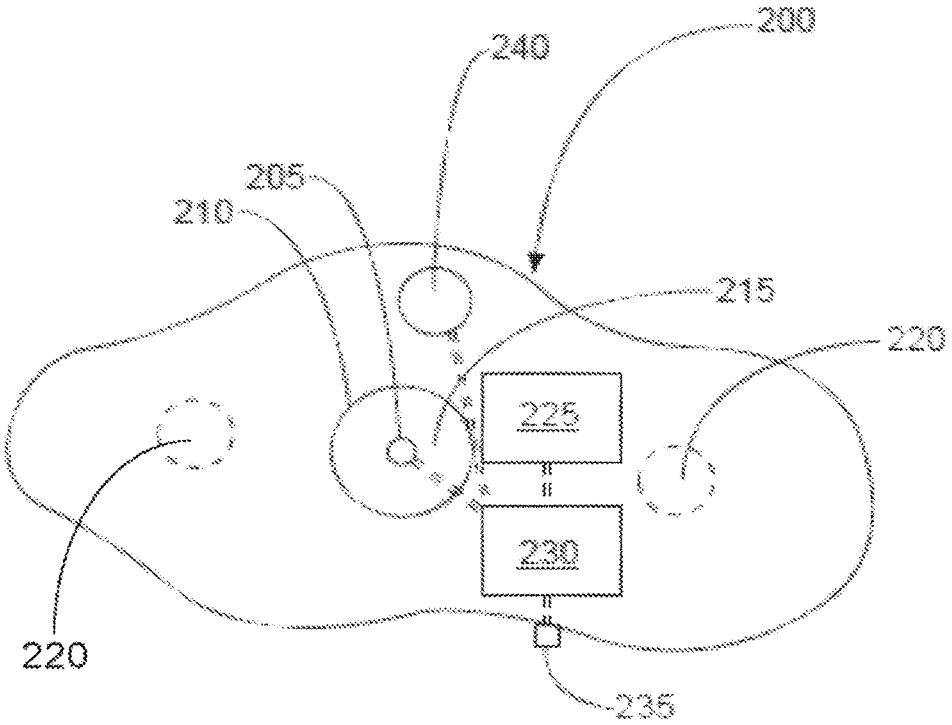
FIG. 21D illustrates a schematic, face view of the climbing hold comprising the light source in accordance with a representative embodiment.

In some embodiments, the holds are configured to be bolted to the climbing panels 55 and/or the climbing surface 15 (e.g., the panels comprise one or more T-nuts, nuts, and/or bolt receptacles; holes; catches; washers; sleeves; and/or any other suitable mechanisms for securing the holds to the panels). By way of non-limiting illustration, FIG. 1A shows an embodiment in which the panels 55 comprise a grid and/or any other suitable layout of holes 60 (e.g., holes comprising threaded receptacles, T-nuts, and/or any other suitable type of hold connection points (not shown)). In some embodiments (e.g., as shown in FIG. 1A), one or more of the panels 55 comprise a grid of holes 60, with each hole being configured to receive a single bolt that is configured (as a single bolt) to couple a single hold (discussed below) to the wall 10. In some other embodiments, however, instead of using a single hole to couple a hold to the wall, one or more panels define (or are configured to define) two or more holes per hold, with such holes set forth in a grid pattern (much like as shown in FIG. 1A, except with two holes being disposed next to each other and such pairs of holes being evenly spaced in the panel), in various locations that can be used to set up one or more climb paths, in random locations, and/or in any other suitable location. Indeed, in some embodiments, the climbing wall defines two or more holes per hold location (e.g., to keep the holds from twisting around a single bolt (or other anchor mechanism)). In this regard, FIG. 21D shows an embodiment in which the climbing hold 200 is configured to couple to the climbing wall 10 (not shown in FIG. 21D) via two or more threaded members 220 (e.g., set screws, grabber screws, wood screws, machine screws, screws, bolts, and/or any other suitable fasteners), such that the hold does not twist during use.

In some embodiments, each of the holes 60 comprise one or more T-nuts, nuts, threaded couplers, mechanical engagements, frictional engagements, and/or any other suitable coupler or couplers that are configured to couple a hold 200 to the climbing wall 10. Indeed, as mentioned above, in some cases, each hole comprises a T-nut that is configured to receive a bolt that extends through and/or into a hold. In some other cases, however, one or more of the holes comprise a sleeve, a washer, a sleeved washer, a coupler, and/or any other suitable object that allows a screw, bolt, and/or other fastener to pass from a backside of the climbing surface 15, through such object (e.g., so as to not damage the climbing surface), and into a climbing hold. In some other embodiments, however, one or more of the holes each simply comprise a hole in a portion of the climbing wall (e.g., a pre-drilled or pre-formed hole and/or a hole formed at the time that a hold is coupled to the climbing wall).

Additionally, while the holes 60 (and/or any other suitable hold 200 connection points) can be disposed in any suitable manner and with any suitable amount of space between them, FIG. 1A shows an embodiment in which the holes 60 are disposed in a grid and separated by about 20 cm±5 cm. Again, however, the holes can be separated by any suitable distance or distances, with spacing between the holes being relatively consistent and/or inconsistent. Indeed, in some other embodiments, the holes (and/or any other suitable hold connections) are placed to match (or otherwise resemble) holds on one or more famous (and/or any other) rock formations. Moreover, in some embodiments, where the climbing wall defines pairs of holes in which two holes are relatively close to each other, such pairs of holes are disposed across one or more portions of the climbing wall 10 (e.g., being evenly spaced; being unevenly spaced; being located in one or more possible climbing path locations, even if not evenly spaced; and/or in any other suitable locations).

Figure 1B:
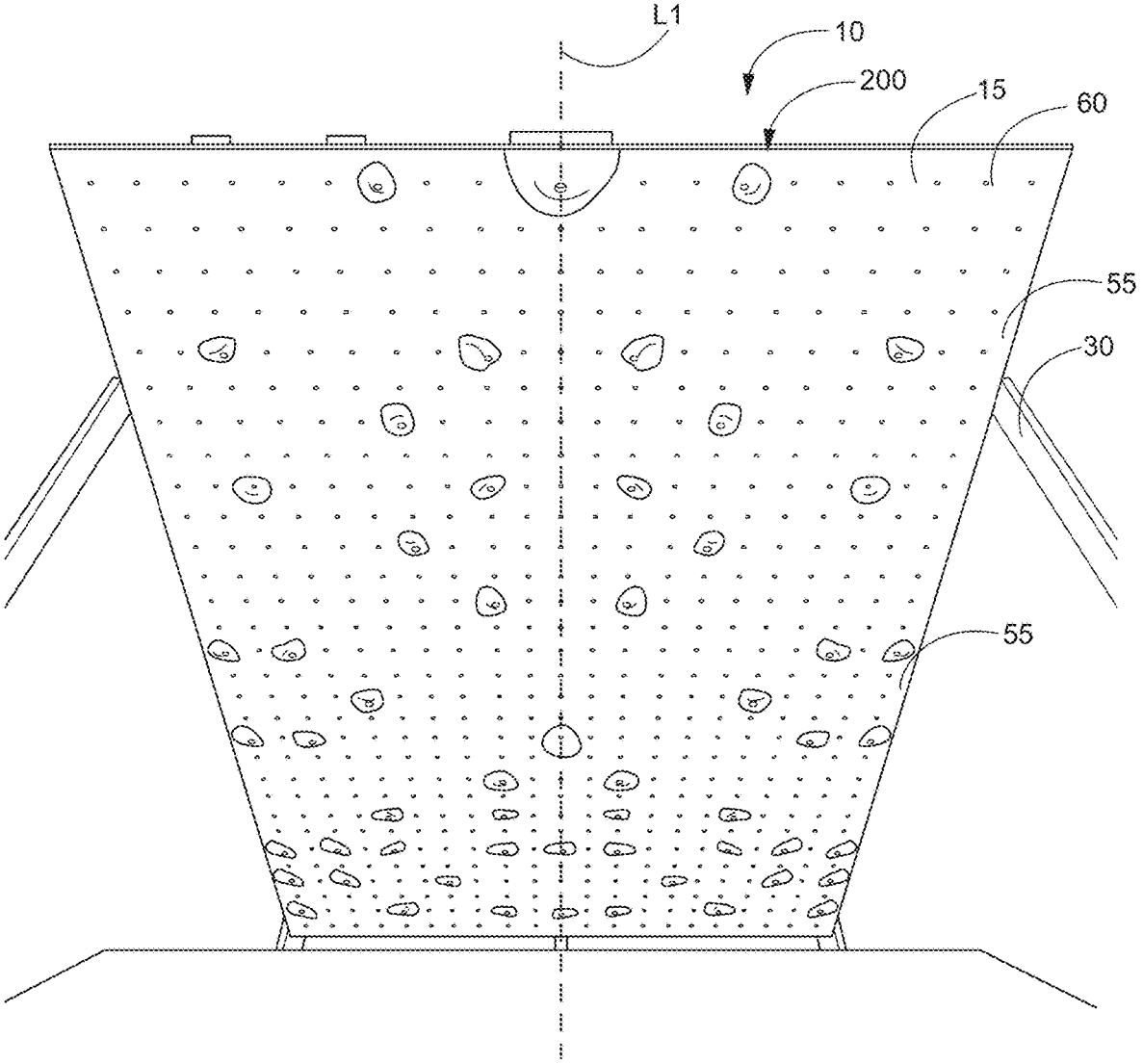
FIGS. 1B-1C each illustrate a front perspective view of the adjustable climbing wall comprising symmetrical flow hold patterns in accordance with some representative embodiments.
Figure 1C:
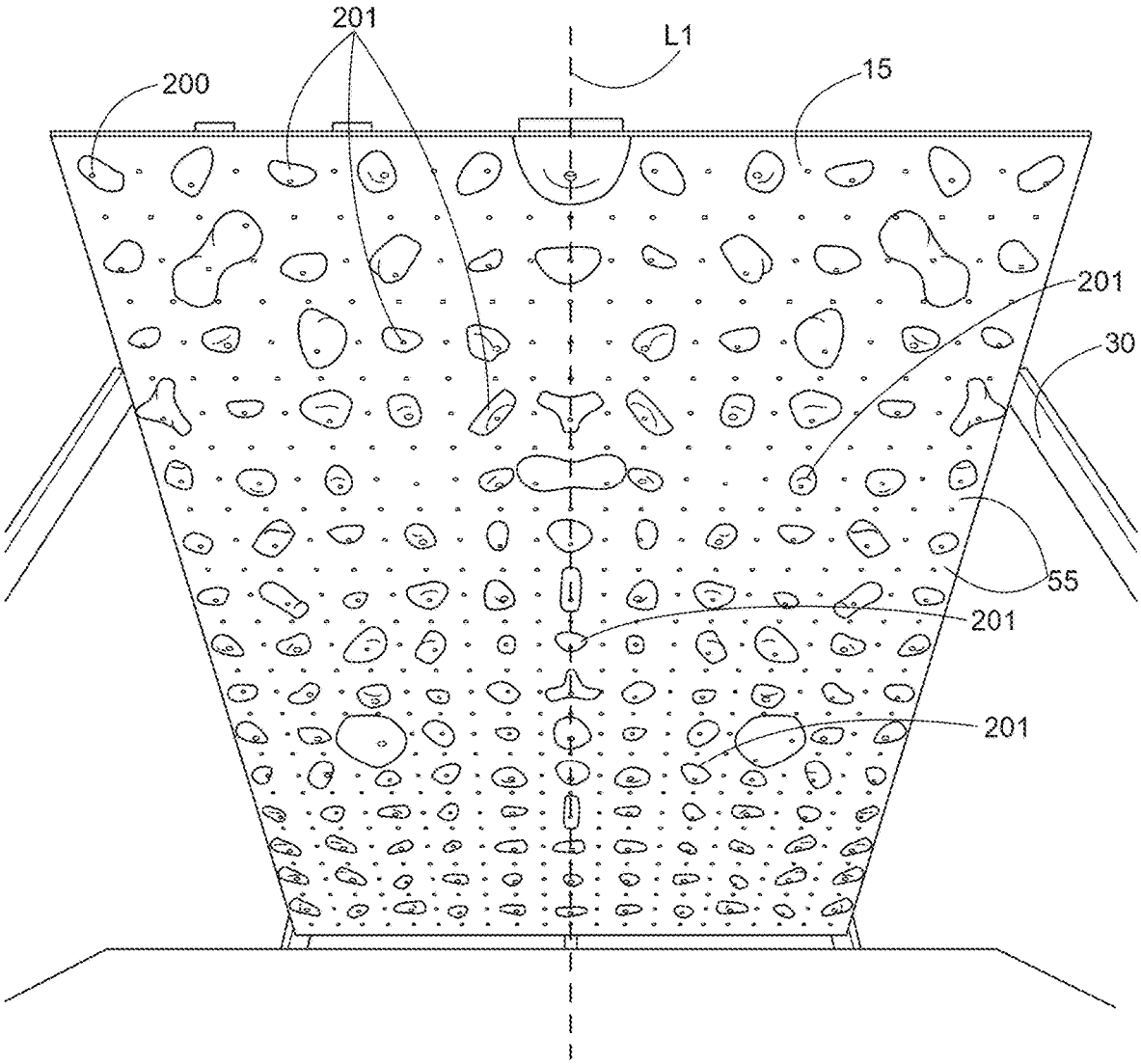

While the holds 200 on the climbing panel 55 and/or climbing surface 15 can be in any suitable location (e.g., coupled to one or more positions on a grid of holes 60 and/or other coupling mechanisms on the panel), in some cases, the holds are disposed in a pattern that is analogous to a yoga mat. Indeed, in some embodiments, the holds are carefully placed in specific locations that help provide a "ladder-like", a "left-right-left-right", and/or any other suitable climbing routine or flow (e.g., to provide a warmup routine for a master and/or a learning routine for a novice). Moreover, in some embodiments, careful planning and expertise in climbing movement and awareness is utilized to create natural feeling routines for both hand and foot movement and for correct body positioning. Additionally, in some embodiments, flow holds are placed in a mirrored pattern (and/or a substantially symmetrical pattern) on the climbing surface (e.g., to promote a balanced practice). Where flow holds are placed in a substantially symmetrical and/or mirrored pattern, the holds can be disposed in any suitable symmetrical pattern. By way of non-limiting illustration, FIGS. 1B and 1C show some embodiments in which the holds 200 are disposed in a mirrored pattern about a longitudinal axis L1 of the climbing surface 15. Thus, in some cases, climbers of virtually every ability can properly learn moves (e.g., like katas in karate, asanas in yoga, etc.). Indeed, in some embodiments, specific sequencing of holds and corresponding "flows" allow climbers of every ability to build and maintain comprehensive strength and awareness for climbing.

The climbing wall 10 can comprise any suitable number of climbing panels 55, including, without limitation, 1, 2, 3, 4, 5, 6, 7, 8, 9, 10, or more. By way of non-limiting illustration, FIGS. 1A and 2 show some embodiments in which the climbing wall 10 and the climbing surface 15 comprise 6 panels 55.

The panels 55 can also be any suitable shape, including, without limitation, being square, rectangular, triangular, hexagonal, polygonal, irregular, symmetrical, asymmetrical, flat, contoured, volume, and/or any other suitable shape. By way of non-limiting illustration, FIGS. 1A and 2 show some embodiments in which the panels 55 are substantially flat and square in shape. Additionally, FIGS. 1B and 1C show some embodiments in which the panels 55 are sized, shaped, and/or are otherwise configured to mate together.

The panels 55 can be any suitable size. Indeed, in some embodiments, the panels have a width, height, and/or diameter that are between about 2 cm and about 8 meters (or within any subrange thereof). In some embodiments, the panels have a height, width, and/or diameter that is between about 0.5 m and about 2.5 m (e.g., between about 0.9 m and about 1.6 m). By way of non-limiting illustration, FIGS. 1A and 2 illustrate some embodiments in which some panels 55 (e.g., on the right) are about 1.22 m×1.22 m, while other panels 55 (e.g., on the left) are about 1.32 m×1.32 m.

In at least some embodiments, the overall thickness of the panels is between about 5 mm and about 20 cm (or within any subrange thereof). Indeed, in some embodiments, the panels have a thickness that is between about 1 cm and about 2.3 cm.

In some embodiments, the panels 55 create one or more three-dimensional structures, such as a boulder, protruding surface, volume, and/or other structure upon which a climber can climb. In some such cases, one or more portions of the three-dimensional surface are adjustable. In some cases, such three-dimensional structures (i.e., one or more boulders, protruding surfaces, volumes, and/or other structures) can be any suitable size, including without limitation, being between about 0.1 m and about 15 m high (or within any subrange thereof), and between about 0.1 m and about 100 m wide (or within any subrange thereof).

The climbing surface 15 can be any suitable size. Indeed, in some embodiments, the climbing surface has a height and width that are each between about 0.6 m and 12.2 m (or within any subrange thereof). Indeed, in some embodiments, the climbing surface has a height and width that are both between about 1.2 m and about 6 m. By way of non-limiting illustration, FIGS. 1A and 2 show some embodiments in which the climbing surface 15 has a height of about 3.65 m and a width of about 2.44 m.

With reference now to the base member 20, some embodiments of the climbing wall 10 optionally comprise 1, 2, 3, 4, 5, 6, or more base members (and/or the base member be formed from any suitable number of parts). While the base member can perform any suitable function, in some instances, it is configured to keep the climbing surface 15 disposed at any suitable height above a floor, to anchor the climbing surface to the floor, to allow an angle of the climbing surface to be selectively pivoted or otherwise adjusted, to pivotally couple with the climbing surface, and/or for any other suitable purpose.

In some embodiments, the base member 20 is configured to: keep the climbing surface 15 any suitable height above the floor, help retain the climbing surface in a desired location, and/or to pivotally couple with the climbing surface. With respect to holding the climbing surface above a floor, in some cases, one or more base members are configured to keep the climbing surface between about 1 cm and about 1 m (or within any subrange thereof) above the floor.

Where the base member 20 is configured to retain the climbing surface 15 in a desired location (e.g., with respect to the floor and/or any other suitable object), the base member can perform such a function in any suitable manner, including, without limitation, by providing a surface that can be bolted, nailed, glued, clamped, pinned, stapled, frictionally attached, snapped, mechanically attached, fastened, weighted, placed against another object, cemented into, and/or otherwise be anchored to a floor (and/or another suitable object). By way of non-limiting illustration, FIGS. 1A-3 show some embodiments in which the base member 20 comprises one or more feet or other attachments 65 that are configured to be coupled to a floor (e.g., via one or more bolts, nails, adhesives, catches, anchors, rivets, and/or other suitable fastening methods).

In another non-limiting illustration, FIGS. 4-6A show some embodiments in which the base member 20 comprises a base section 70, edging 75, and/or is otherwise expanded from the base member 20 shown in FIGS. 1A-3 so as to allow the base member to be: weighted down (e.g., by placing weights on the base section), rested against another object (e.g., a wall and/or any other support), fastened to a floor (e.g., via one or more bolts, nails, anchors, adhesives, and/or other suitable fastening mechanisms), and/or otherwise anchored down. Indeed, in some embodiments, the base member 20 of FIGS. 4-6A is weighted down (e.g., with sandbags, weights, and/or any suitable object) such that the weights can readily be removed to allow the climbing wall to be moved to a different location.

In addition to the aforementioned components, the base member 20 can have any other suitable shape or component. By way of example, although some embodiments of the base member do not comprise any climbing holds 200, some other embodiments do comprise permanent and/or replaceable holds.

As another example of a characteristic of the base member 20, FIGS. 6B-6I show that, in some embodiments, the base members 20 are configured to extend out in front of one or pivoting members 25 (e.g., a rotational axis of the pivoting members) that couple the climbing surface 15 to the base member 20. In this regard, the base members can extend out any suitable distance "D" in front of the pivoting members that couple the climbing surface to the base member, including between about 2 cm and about 4 m (or within any subrange thereof). Indeed, in some embodiments, one or more base members extend out a distance D that is between about 0.5 m and about 2.5 m. Additionally, in some such embodiments, the feet are configured to prevent the wall from falling down during use—even if the base members are not bolted (or otherwise anchored) to the floor.

In some embodiments, the base member 20 is configured to extend across a width of the climbing surface 15 (e.g., as shown in FIGS. 1A-6A). In other embodiments, however, the base members can be disposed in any suitable location and can extend across any suitable portion of the width of the climbing surface. By way of non-limiting illustration, FIGS. 6C, 6E, 6F, 6G, 6I, 6J, 6L, and 6N show some embodiments in which the base members 20 are disposed at each side (e.g., a right side and a left side) of the climbing surface 15. Additionally, while each base member can be independent from the other base members (e.g., only being connected to each other by being coupled to the climbing surface), in some other embodiments, multiple base members are coupled together (e.g., to form a single base member) via one or more connectors and/or in any other suitable manner. In this regard, while the base members can be coupled in any suitable manner, FIGS. 6I, 6J, and 6N show some embodiments, in which one or more crossbars 66 and/or cross panels 67 (and/or any other suitable objects) extend between two or more base members 20 (e.g., to form a single base member).

Figure 6A:
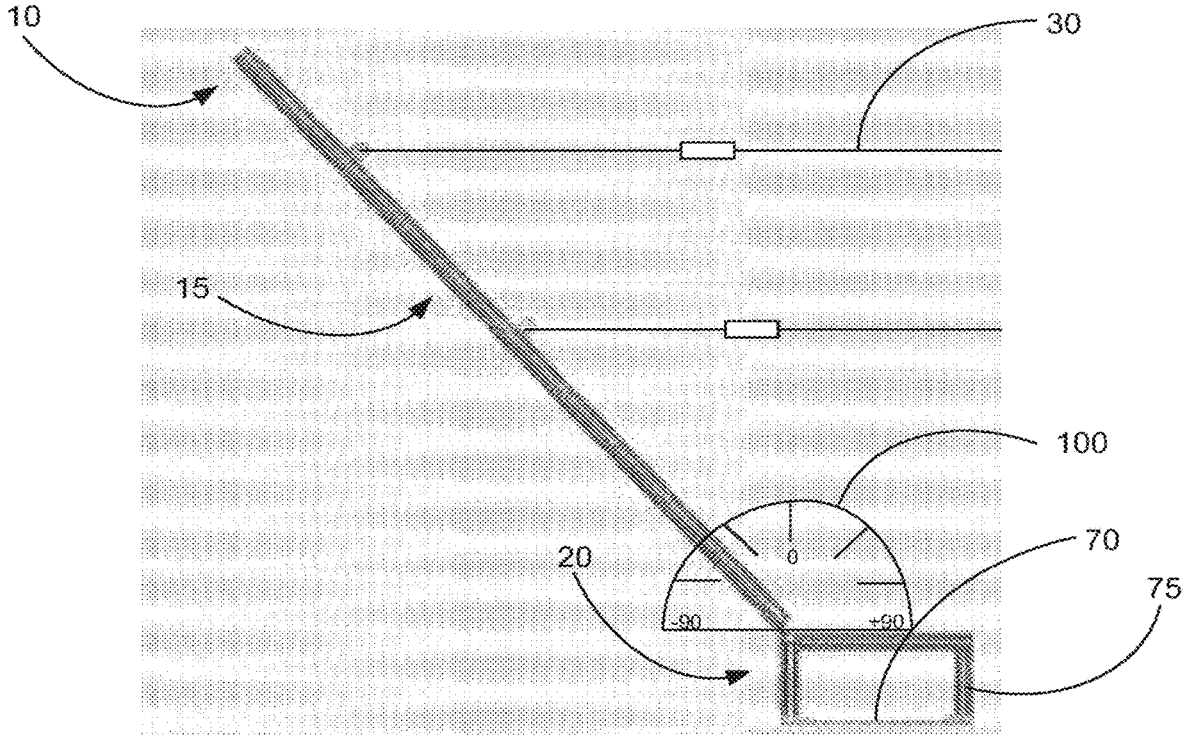
FIG. 6A illustrates a side view of a representative embodiment of the adjustable climbing wall.
Figure 6B:
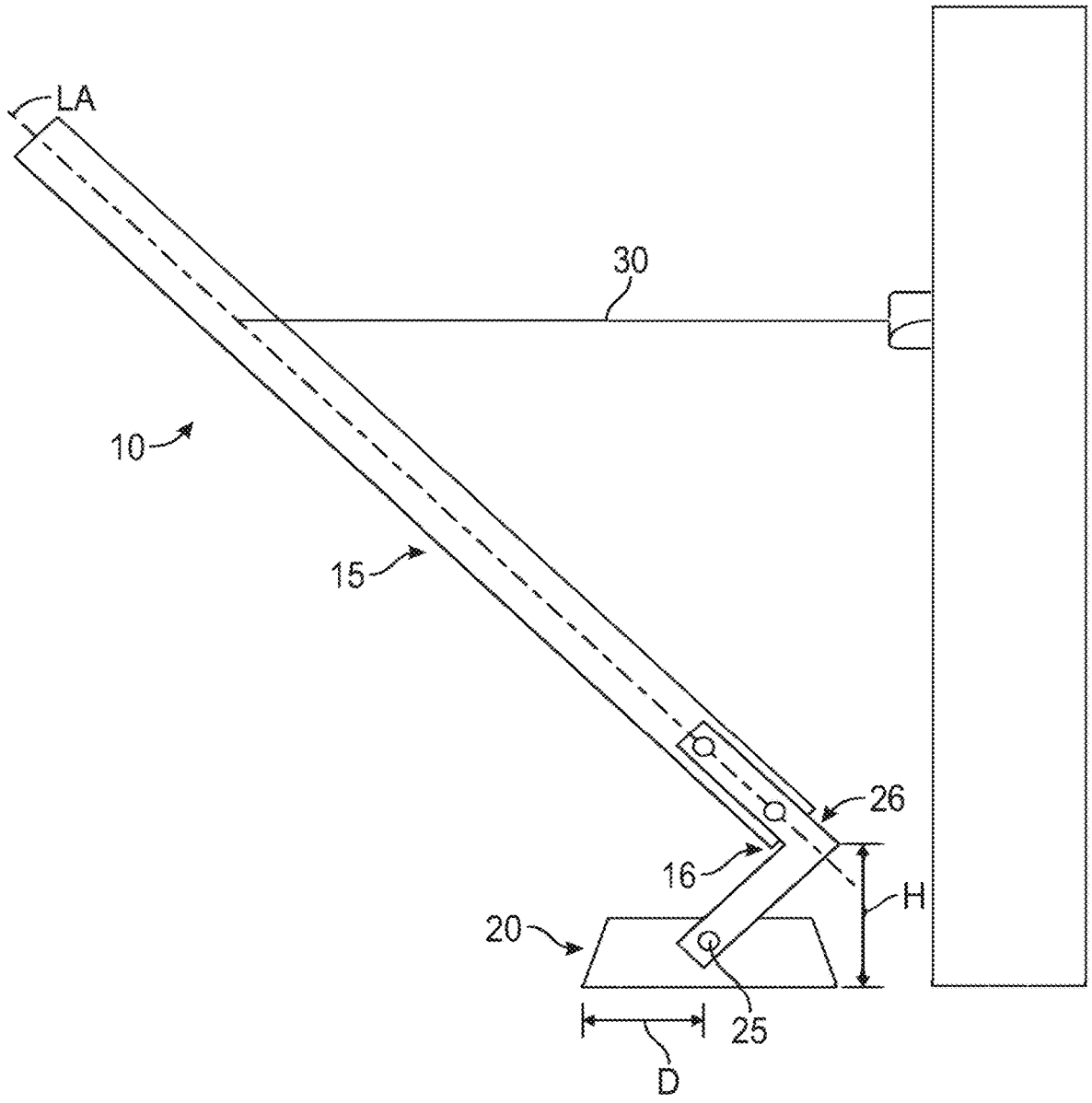
FIG. 6B illustrates a side view of the adjustable climbing wall comprising a camming coupler in accordance with a representative embodiment.
Figure 6C:
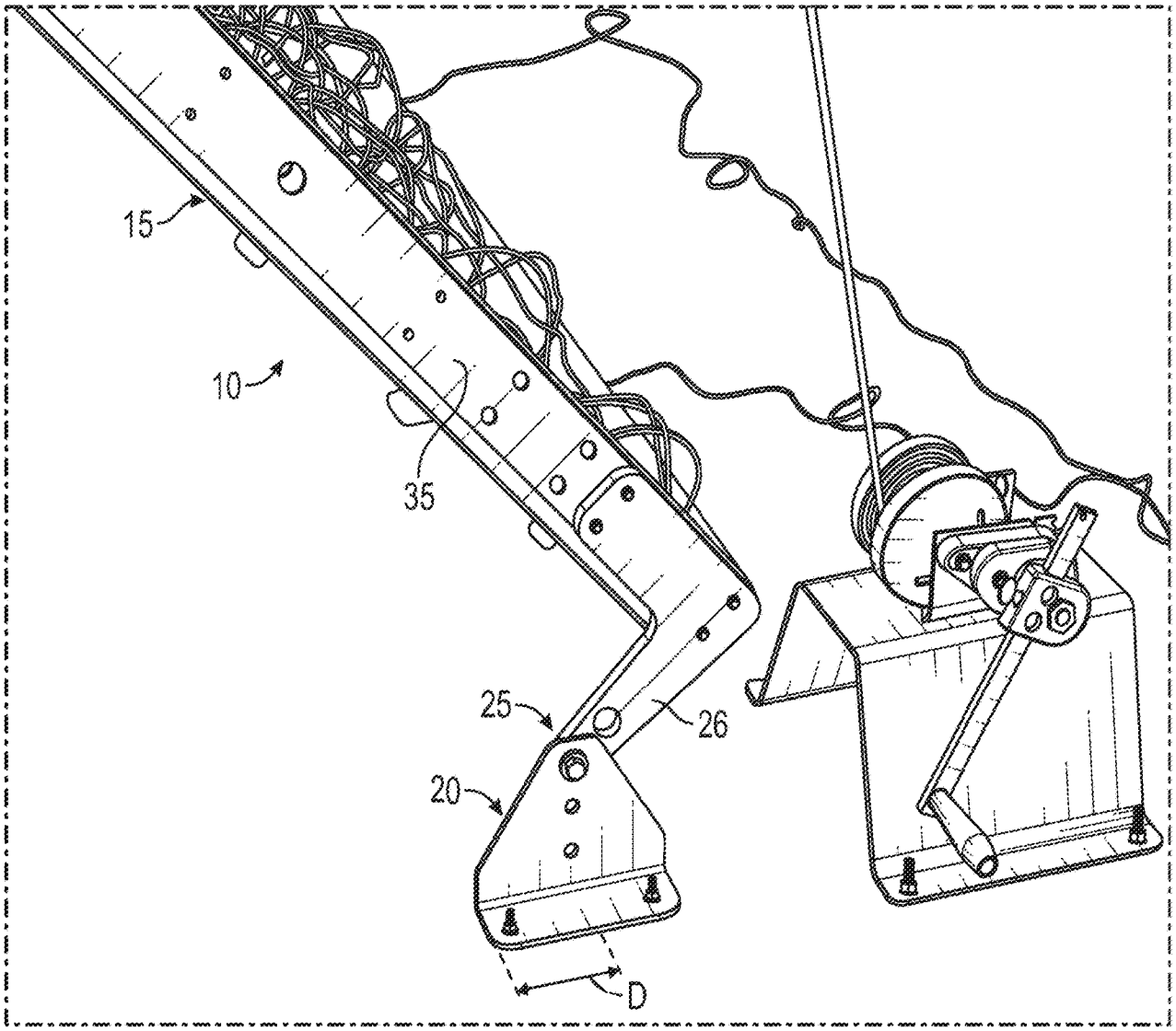
FIG. 6C illustrates a perspective view of a portion of the adjustable climbing wall comprising the camming coupler in accordance with a representative embodiment.

Turning now to the pivoting members 25, the climbing wall 10 can comprise any suitable mechanism that is configured to allow an angle of the climbing surface 15 to be varied with respect the base member 20 and/or a floor. Some non-limiting examples of such pivoting mechanisms comprise one or more hinges (e.g., continuous hinges, piano hinges, gate hinges, strap hinges, t-hinges, butt hinges, butterfly hinges, pivot hinges, flush hinges, barrel hinges, industrial hinges, and/or any other suitable hinges or materials to enable and allow the pivoting to function), straps, joints, couplers, motors, clamps, flexible members, springs, resilient members, linkages, camming (or cam) couplers, and/or any other suitable type of pivotal coupling mechanisms.

Where the pivoting members 25 comprise one or more hinges or hinge joints, the climbing wall can comprise any suitable number of hinge points, including, without limitation, 1, 2, 3, 4, 5, 6, 7, 8, or more. Indeed, in some embodiments, there is a minimum of three hinge joints. Other embodiments include less or more than three hinge joints. Additionally, some embodiments include continuous hinge joints. By way of non-limiting illustration, FIGS. 1A, 2, 4, and 5 show some embodiments in which the pivoting members 25 comprise multiple heavy-duty hinges 80. Additionally, FIGS. 6B and 6C show some embodiments in which the pivoting members each comprise a bolt and/or any other suitable pivot joint about which the climbing surface is configured to pivot with respect to the base member 20.

The pivoting members 25 (e.g., hinges 80) can allow the climbing surface 15 to be adjusted to any suitable angle. Indeed, where the climbing surface is deemed to be at 0 degrees when a longitudinal axis LA (e.g., as shown in FIG. 6B) of the panel is perfectly vertical (e.g., perpendicular with a floor), some embodiments of the climbing surface are configured to be moved to between +110 degrees (e.g., forward) to −110 degrees (e.g., backward) (or within any subrange thereof, as shown in FIG. 6). In some cases, for instance, the climbing surface 15 is configured to lean forward towards the climber on the wall (or overhang) between about 0 degrees and about 55 degrees (±5 degrees). Additionally, in some embodiments, the wall is configured to be pivoted from being vertical by up to −20 degrees (or by leaning back from being vertical) to being up to 65 degrees (or leaning forward, or overhanging a climber while the climber is on the wall), or within any subrange thereof. Indeed, in some embodiments, the wall 10 is configured to adjust from leaning backward away from being vertical by about −5 degrees, to leaning towards a climber on the wall (or forward) or overhanging the climber by about 55 degrees from being vertical.

Figure 3:
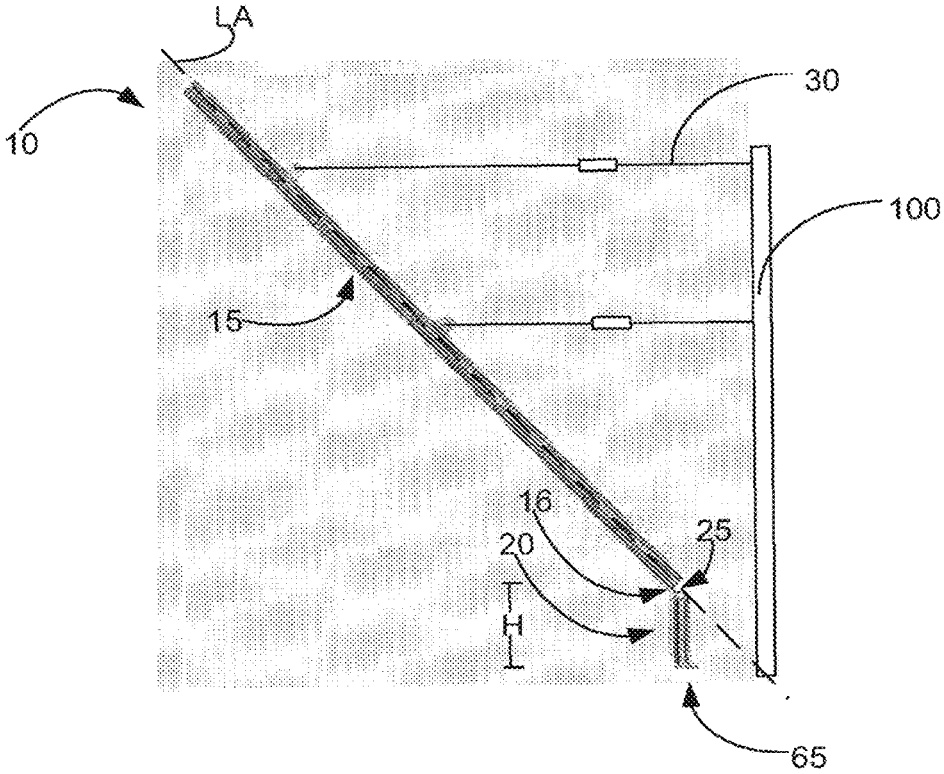
FIG. 3 illustrates a side view of a representative embodiment of the adjustable climbing wall.
Figure 4:
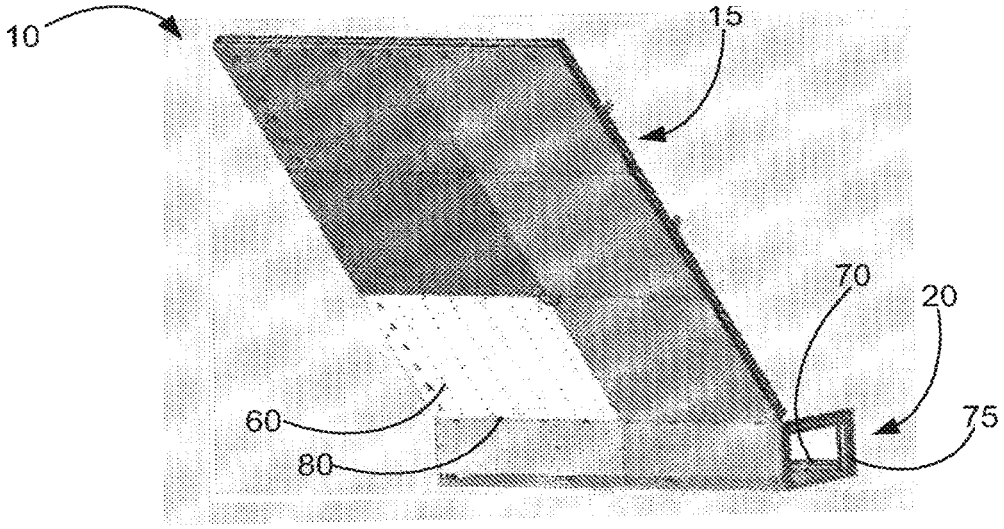
FIG. 4 illustrates a front perspective view of a representative embodiment of the adjustable climbing wall.
Figure 5:
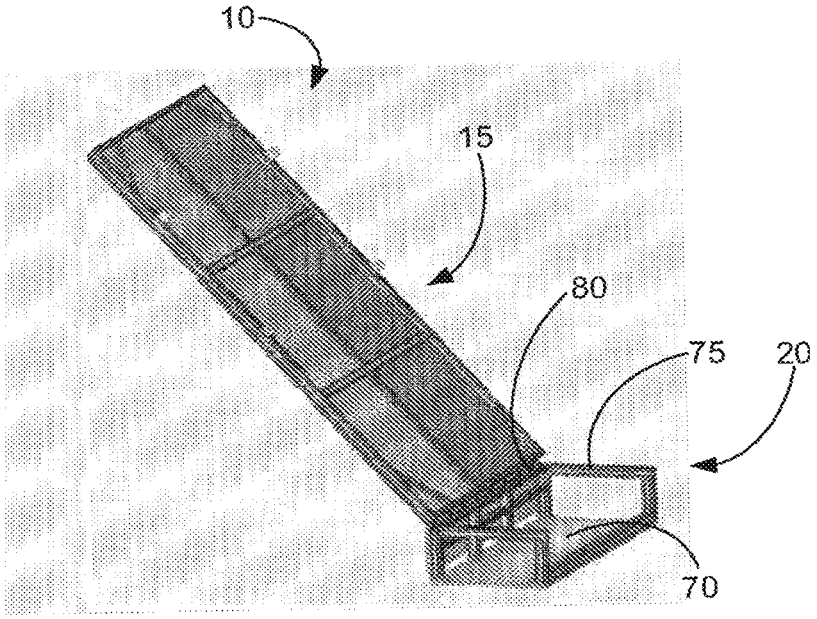
FIG. 5 illustrates a back-perspective view of a representative embodiment of the adjustable climbing wall.

In some embodiments, a longitudinal axis "LA" (e.g., as shown in FIG. 3) of the climbing panel 15 is configured to be aligned with, and radial rotate about, a radial axis of one or more pivoting members 25 such that a height "H" of a lower edge 16 of the climbing surface (or a distance between a lower edge of the climbing panel and the floor) is configured to remain substantially static as the climbing surface moves through its forward and backward ranges of motion.

In some embodiments, however, the climbing wall 10 is configured to raise the lower edge 16 of the climbing surface 15 further up off the floor as the climbing surface is leaned forward through at least a portion of the climbing surface's forward range of motion and/or to lower the lower edge closer to the floor as the climbing surface is pivoted backwards. In this regard, where the climbing wall is disposed in a location with a relatively low ceiling, the size of the climbing wall can be limited by that ceiling height. Thus, to maximize the height of the climbing surface, it can (in some cases) be helpful to raise the lower edge of the climbing surface from the floor as the climbing surface leans forward (e.g., to allow a user's feet to fit between the lower portion of the climbing surface and the floor) and/or to lower the lower edge of the climbing surface as the climbing surface is moved closer to its vertical position (e.g., to allow the surface to substantially span between the floor and the ceiling).

Where the lower edge 16 of the climbing surface 15 is configured to raise through at least a portion of the climbing surface's forward movement, the wall 10 can comprise any suitable mechanism that is configured to perform such a function. Some examples of such mechanisms include one or more guides, linkages, cams, pivot joints, rails, and/or other mechanisms that are configured to cam the climbing surface as it rotates (e.g., raise the lower edge of the climbing surface as the surface leans forward and/or lower the lower edge as the climbing surface rotates backward.

In some cases, a lower portion of the climbing surface 15 is coupled to one or more camming (or cam) couplers. While such cam couplers can have any suitable characteristic that allows them to cause the lower edge 16 of the climbing surface to raise when the climbing surface moves forward and/or to lower when the surface is rotated in a backward direction, FIGS. 6B-6H show that, in some embodiments, one or more cam couplers 26 are configured to extend from and/or past a front face (or climbing face on which holds are disposed) of the climbing surface 15 and to pivotally couple the climbing surface 15 to the base member 20 (and/or to any other support). As a result, the FIG. 6B shows that, in some embodiments, the longitudinal axis LA of the climbing surface 15 does not directly align with and radially rotate about the pivoting member 25 (e.g., with a rotational axis of the pivoting member) that couples the climbing surface 15 to the base member 20 (e.g., via the cam coupler 26).

With reference now to the climbing surface supports 30, the climbing surface 15 of the climbing wall 10 can be selectively and/or permanently kept in (and/or moved to) one or more desired positions in any suitable manner, including, without limitation, through the use of one or more climbing surface supports. In this regard, the supports can comprise any suitable component that is capable of helping the climbing surface to move and/or of helping to selectively hold the climbing surface in one or more positions (e.g., with respect to a floor, the base member 20, and/or any other suitable object).

Some non-limiting examples of suitable supports 30 include one or more cables, chains, come-alongs, hoists, ratcheting straps, ratchets, actuators (e.g., linear actuators, cable actuators, threaded rod actuators, hydraulic actuators, piston actuators, threaded actuators, screw actuators, rotary actuators, fluid power linear actuators, fluid power rotary actuators, chain actuators, servos, solenoids, pneumatic actuators, powered winches, motors, and/or any other suitable powered actuator or actuators), ratchet winches, ratcheting mechanisms, hoists, straps, boards, arms, solid supports, bars, load bars, pins, catches, legs, springs, bungees, ropes, linkages, four-bar (or four part) linkages, and/or other suitable supports. By way of non-limiting illustration, FIG. 1A shows an embodiment in which the supports 30 comprise one or more ratcheting straps 85, ropes, servos, actuators (e.g., motorized winches 86), come-alongs, and/or other suitable supports. In this regard, FIG. 1A shows an embodiment in which the supports (e.g., ratcheting straps) are under tension, or are being pulled by the weight of the climbing surface 15.

Figure 6D:
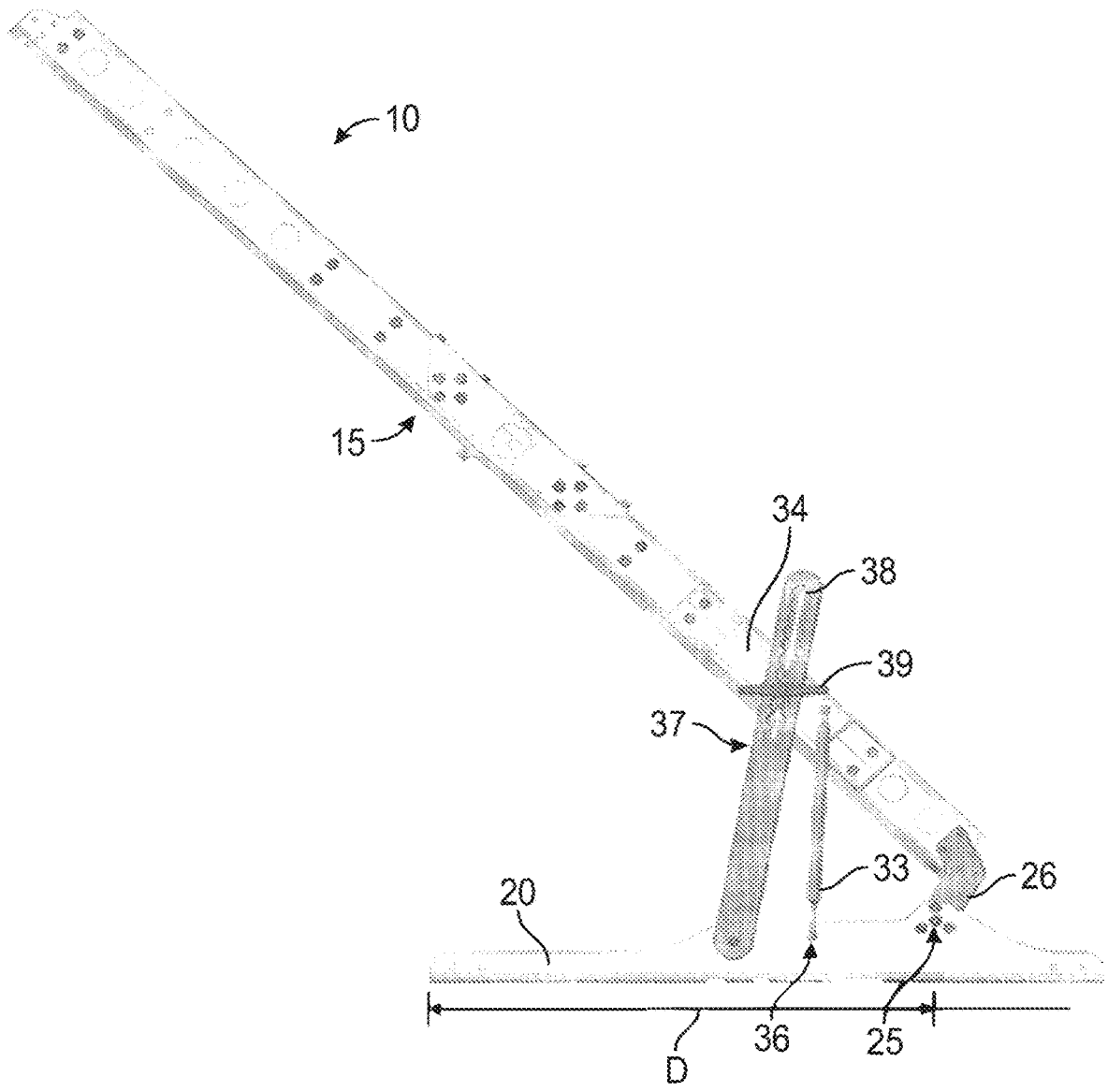
FIG. 6D illustrates a side view of the adjustable climbing wall comprising the camming coupler in accordance with a representative embodiment.
Figure 6E:
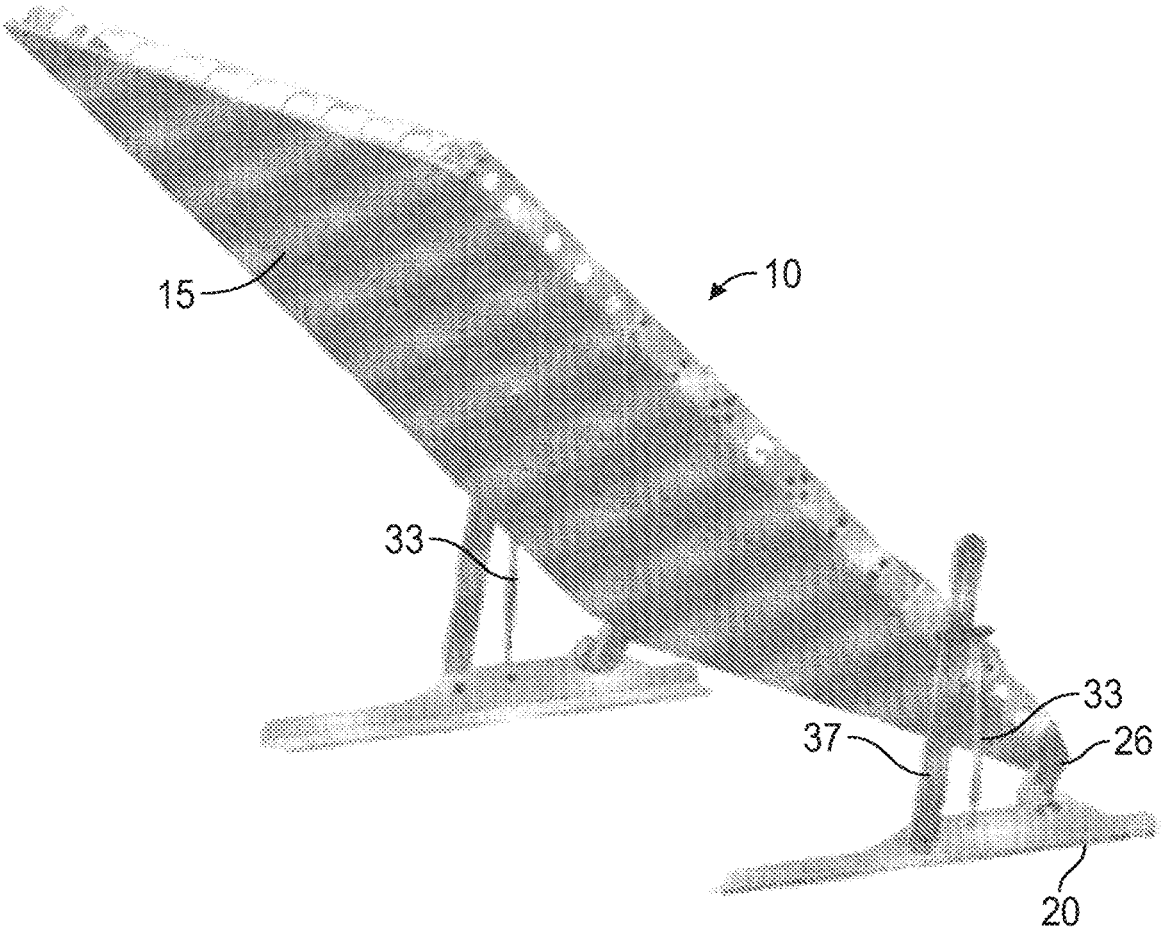
FIG. 6E illustrates a front perspective view of the adjustable climbing wall comprising the camming coupler in accordance with a representative embodiment.
Figure 6F:
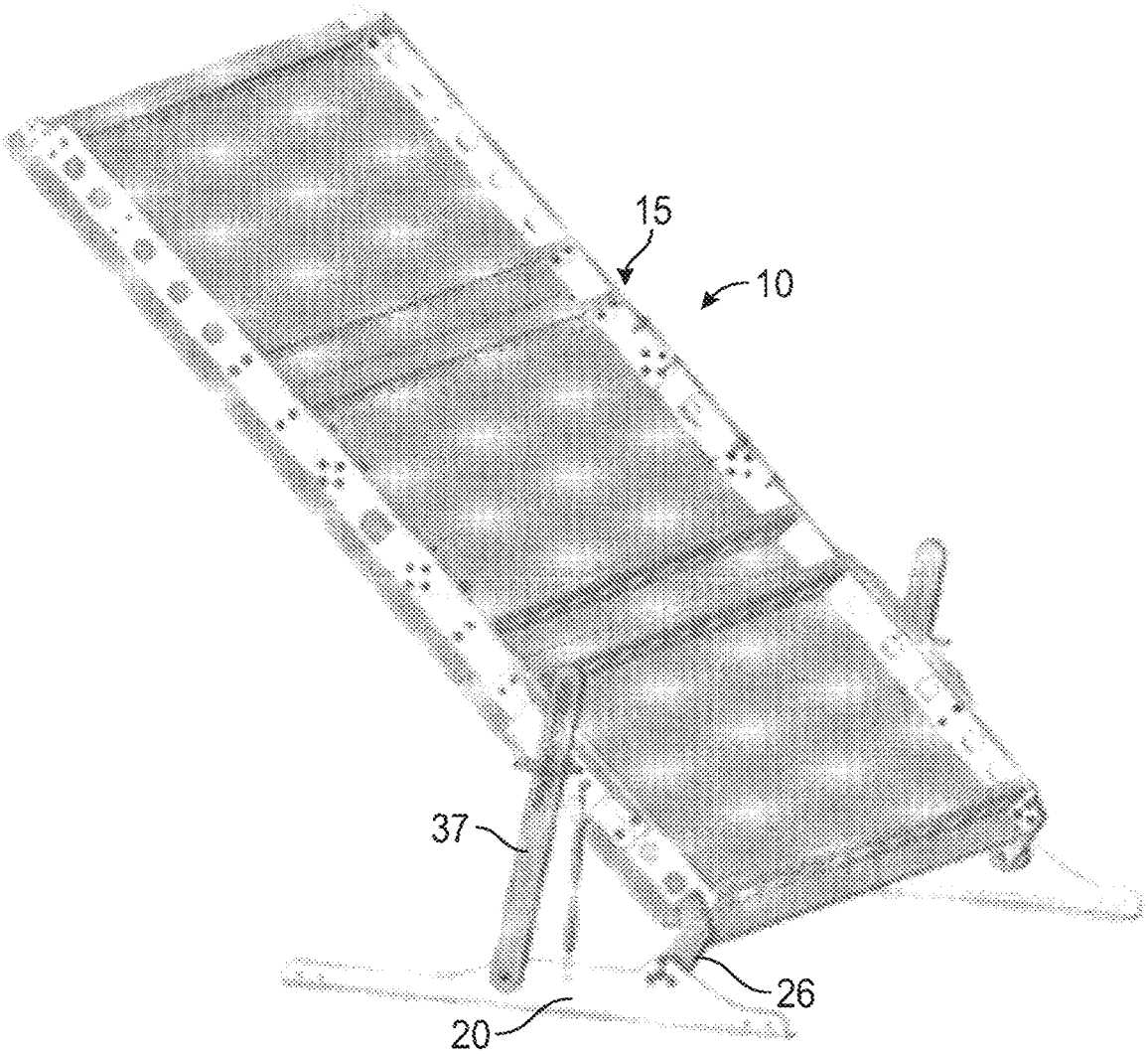
FIG. 6F illustrates a back-perspective view of the adjustable climbing wall comprising the camming coupler in accordance with a representative embodiment.
Figure 6G:
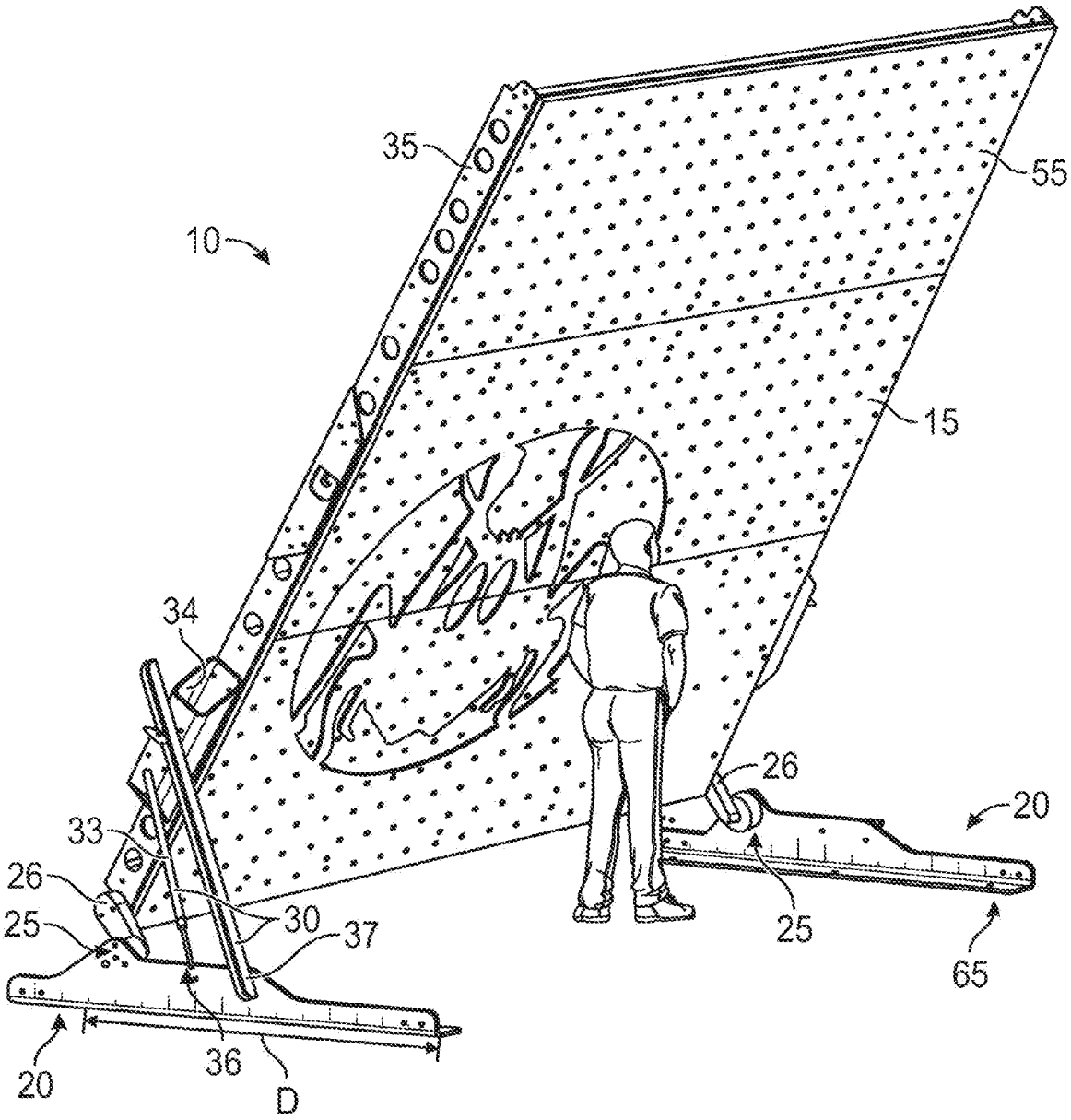
FIG. 6G illustrates a front perspective view of the adjustable climbing wall comprising the camming coupler and a gas spring in accordance with a representative embodiment.
Figure 6H:
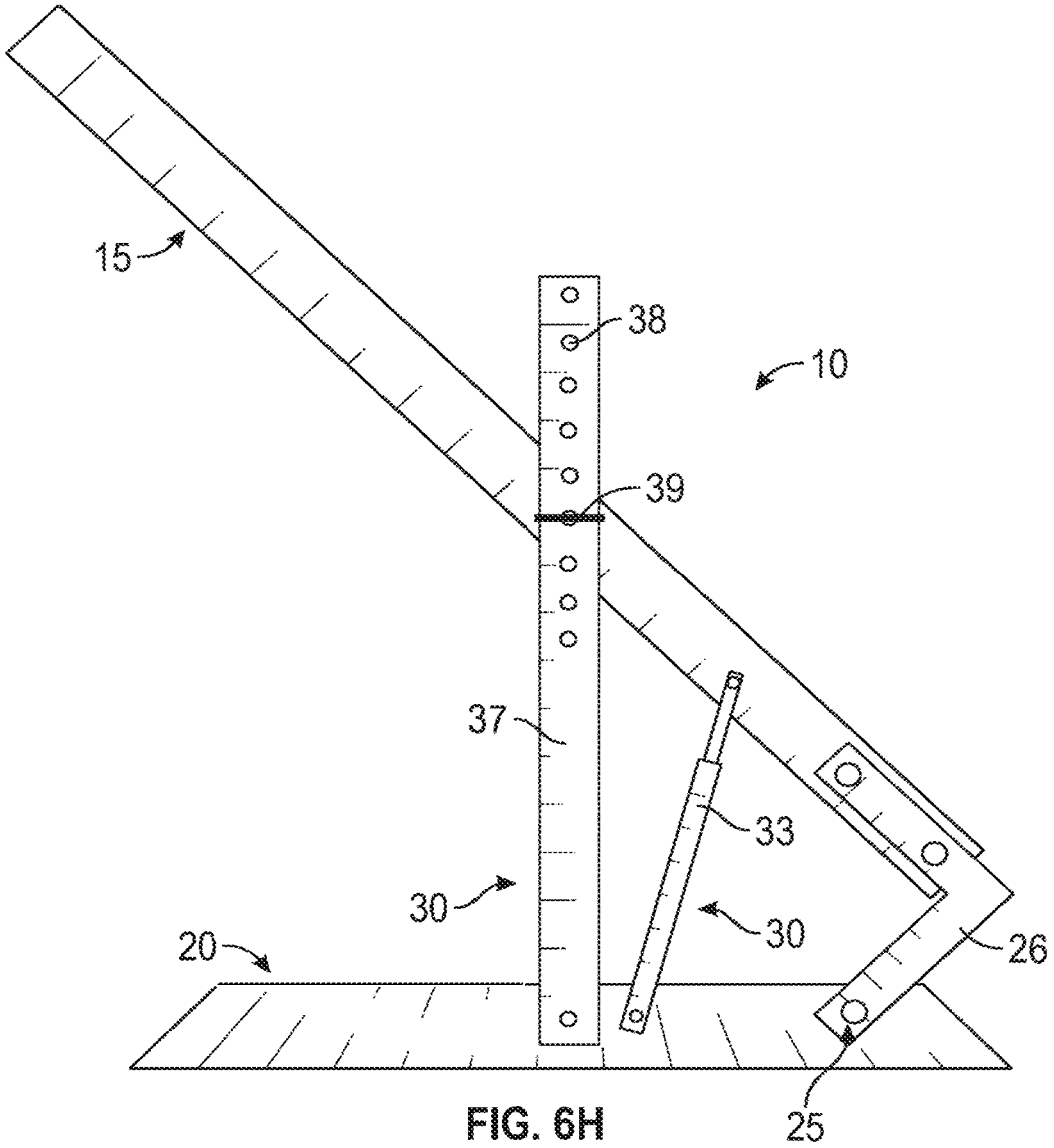
FIG. 6H illustrates a side view of the adjustable climbing wall comprising the camming coupler in accordance with a representative embodiment.
Figure 6I:
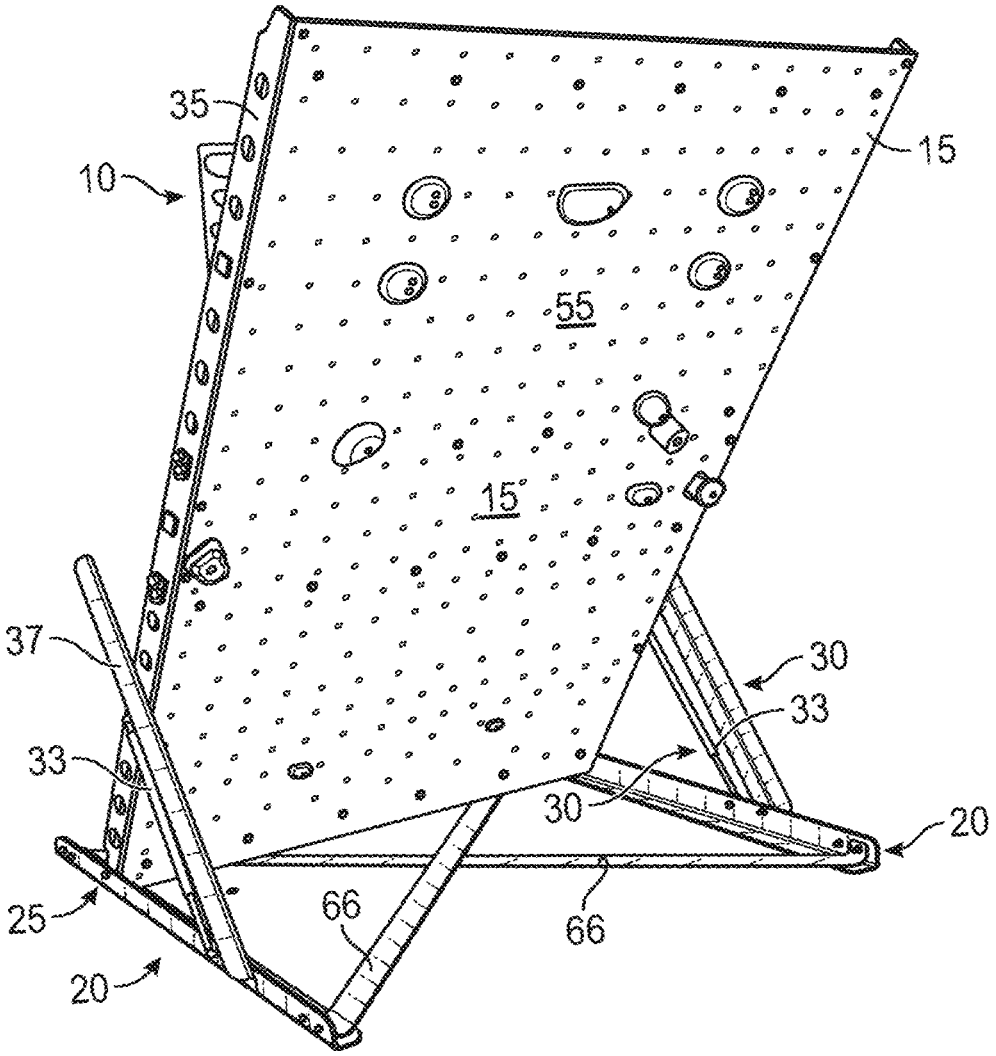
FIG. 6I illustrates a front perspective view of the adjustable climbing wall comprising the gas spring in accordance with a representative embodiment.
Figure 6J:
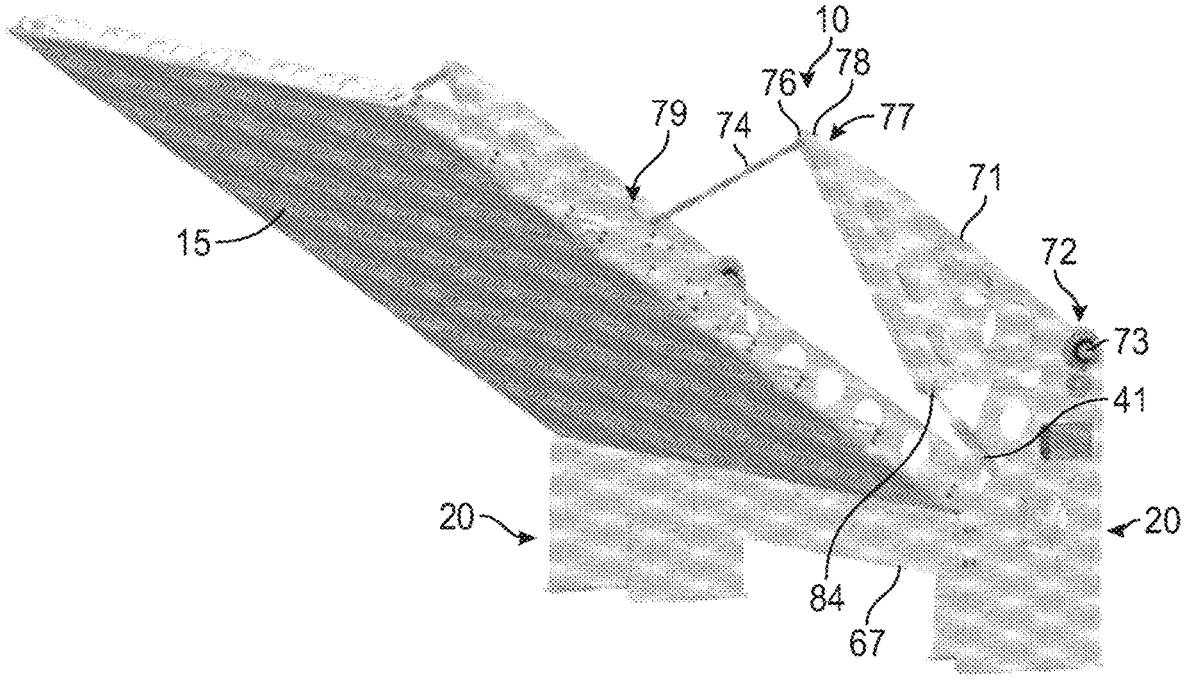
FIG. 6J-6L illustrates various views of the climbing wall in accordance with a representative embodiment.
Figure 6K:
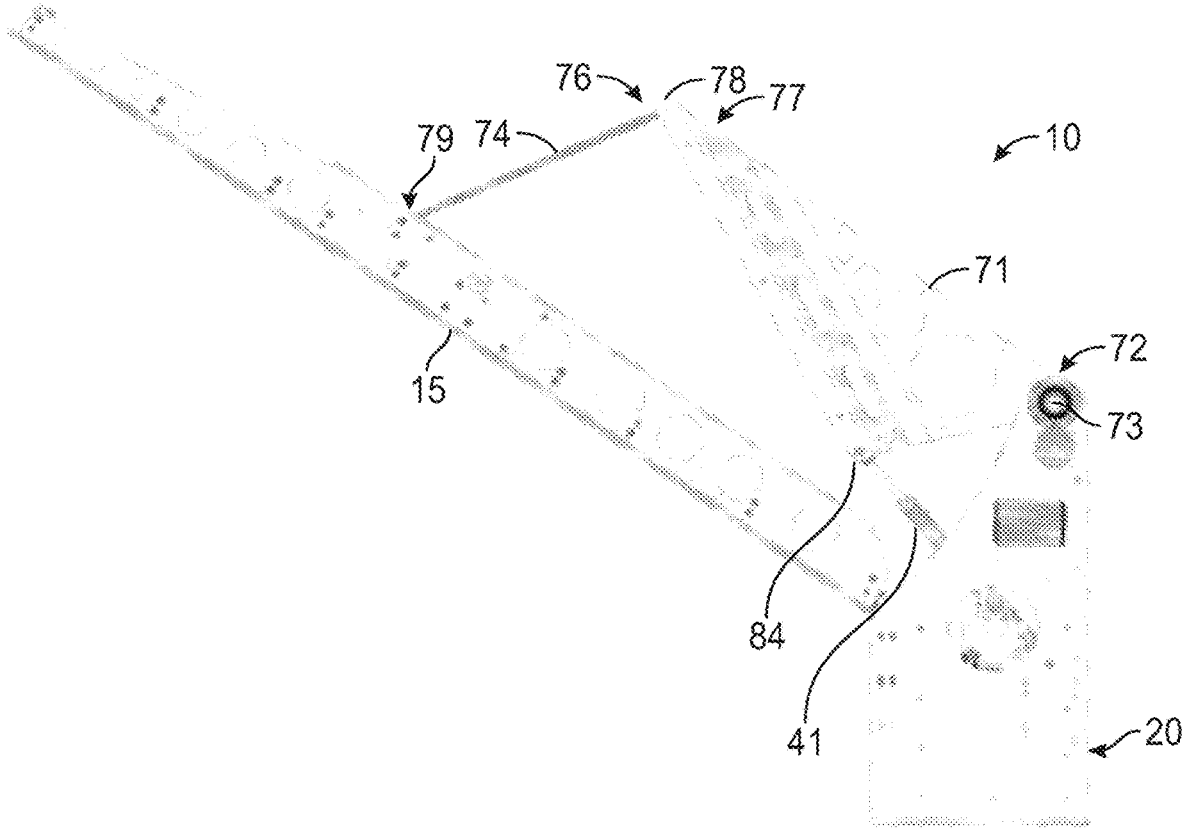

In some cases, the climbing surface supports 30 comprise one or more springs. In this regard, the climbing wall 10 can comprise any suitable type of spring, including, without limitation, one or more compression springs, tension springs, torsion springs, coil springs, spiral springs, extension springs, constant force springs, Belleville springs, drawbar springs, volute springs, flat springs, gas springs, conical springs, and/or any other suitable type of springs that are configured to help bear some of the weight of the climbing surface 15 so that a user can easily and safely move the climbing surface between positions. For instance, FIG. 6R shows that some embodiments of the climbing wall 10 comprise one or more torsion springs 31 that are disposed adjacent to one or more pivoting members 25 (e.g., being coupled to the base member 20, the cam coupler 26, the climbing surface 15, and/or to any other suitable components that allow the spring to bias the climbing surface towards a desired position, such as a vertical or forward leaning position). In another non-limiting example, FIG. 6S shows that, in some embodiments, one or more ratcheting torsion springs, torsion springs 31, and/or any other suitable springs are coupled to a cord 32 and/or any other suitable type of climbing surface support 30 such that the spring is configured to help support some of the weight of the climbing surface 15.

In some embodiments, the climbing surface supports 30 comprise one or more gas springs. In such embodiments, the climbing surface supports can comprise any type of gas springs that are suitable for use with climbing wall 10, that are configured to help dampen a movement of the climbing surface 15, and/or that are configured to help bear a portion of the weight of the climbing surface as the climbing surface moves through at least a portion of its range of motion. Some non-limiting examples of suitable types of gas springs include: standard cylinder gas springs, fixed-height cylinder gas springs, cable cylinder gas springs, spindle only gas springs, stage cylinder gas springs, return cylinder gas springs, auto-return cylinder gas springs, non-rotating cylinder gas springs, bouncing cylinder gas springs, dual-mode cylinder gas springs, heavy duty cylinder gas springs, oil damper air springs, mechanical lockout gas springs, full lockout gas springs, ferromagnetic gasp springs, gas spring shocks, gas spring struts, gas springs having an adjustable push in force (e.g., via a local knob and/or remotely via a Bowden line), gas springs having a single touch release to allow the ability to lock the springs out, extended stroke springs having one or more telescoping mechanisms (e.g., a mechanism comprising one rod and two cylinders), vari-lift gas springs, digressive gas springs (e.g., where the spring becomes more, not less powerful as the main cylinder expands), air springs, and/or any other suitable type of gas springs. Indeed, in some embodiments, the climbing wall comprises one or more standard gas springs that are configured to provide a force to the climbing surface 15 that is roughly equal to a weight of the climbing surface (and/or any other suitable force) so as to so as to offset or otherwise support the weight of the climbing surface and to allow a user to move the climbing surface through a forward and/or backward range of motion without worrying that the weight of the climbing surface could fall on and injure the user.

Where the climbing wall 10 comprises one or more gas springs, the climbing wall can include any suitable number of gas springs, including, without limitation, 1, 2, 3, 4, 5, 6, 7, or more. By way of non-limiting illustration, FIG. 6G shows an embodiment in which the climbing wall 10 comprises one gas spring 33. In contrast, FIGS. 6E, 6I, and 6N show some embodiments in which the climbing wall 10 comprises multiple gas springs 33.

Where the climbing wall 10 comprises one or more gas springs 33, the gas springs can be disposed in any suitable location that allows them to dampen a movement and/or to offset some of the weight of the climbing surface 15 during at least a portion of the climbing surface's movement. Indeed, in some embodiments, one or more gas springs are located in front of, behind, to the right side of, to the left side of, above, below, and/or in any other suitable location in relation to the climbing surface. By way of non-limiting illustration, FIGS. 6D and 6G show some embodiments in which a gas spring 33 extends between a base member 20 and the climbing surface (e.g., by being coupled directly to the climbing surface 15, to a coupler 34 that is coupled to the climbing surface, and/or in any other suitable manner). In this regard, while the gas spring can couple to the base member and/or the climbing surface in any suitable location, FIG. 6D shows an embodiment in which a lower end 36 of the gas spring 33 couples to the base member 20 in front of the pivoting member 25. In another non-limiting illustration, FIG. 6E shows that in some embodiments, gas springs 33 are disposed on both a right and a left side of the climbing panel 15. In yet another non-limiting illustration, FIG. 6N shows an embodiment in which one or more gas springs 33 are disposed behind the climbing surface 15.

In some cases, once the gas springs 33 are used to help the user to be able to easily and safely move the climbing surface 15 to a desired location, the user and/or the climbing wall 10 (e.g., a program) then selectively locks the climbing surface in that location. In this regard, the user and/or the wall can lock the climbing surface in a position in any suitable manner, including, without limitation, through the use of one or more or more locking hinges, locking pivot joints, four-bar linkages (as discussed below), catches, pins with corresponding receptacles in which a pin is placed in a receptacle to hold the wall in a certain position, ratcheting mechanisms, climbing surface supports 30 (i.e., legs 90, actuators, lockable gas springs, etc.), and/or any other suitable component that allows an angle of the climbing surface to be selectively locked in place. Indeed, in some embodiments in which the climbing wall 10 comprises one or more gas springs, one or more of the gas springs is configured to be selectively locked into a desired position.

In some other cases in which one or more climbing wall supports 30 are configured to selectively hold the climbing surface 15 in place, the supports comprise one or more bars and/or other rigid braces that are configured to extend (directly or indirectly) from the base member 20 to the climbing surface (i.e., to the climbing surface, a coupler 24 coupled to the climbing surface, and/or in any other suitable manner). In this regard, the rigid brace can be used to lock a position of the climbing surface in any suitable manner (e.g., to retain the climbing surface in a locked position during a climb). Indeed, FIG. 6D shows that, in some embodiments, the rigid brace 37 is pivotally coupled at one end to the base member 20, and the other end of the brace 37 has a variety of holes, recesses, and/or other catches 38 that allow a pin 39 (and/or any other suitable coupler) to be slid through one or more of the catches (and/or to otherwise function) to lock the climbing surface 15 in place.

In some embodiments, the climbing surface supports 30 comprise one or more actuators. In such embodiments, the actuators can perform any suitable function, including, without limitation, moving the climbing surface 15 between climbs, moving the angle of the climbing surface during a climb (e.g., to dynamically vary the challenge of a climb, to help simulate a natural climb, to challenge a climber, to gamify the climbing experience, to animate the wall, etc.), and/or to selectively lock the climbing surface at a desired angle.

Where the climbing wall 10 comprises one or more actuators, the actuators can be used in any suitable configuration, including, without limitation, in a tension and/or compression position. Indeed, in some embodiments, the actuator is used in a compression, or a pushing, configuration. In some such cases, when large forces are applied to the wall (e.g., a climber is moving and/or bouncing on the wall), the actuator is under pressure and is unlikely to fail. Moreover, if the actuator were to fail, in some cases, its placement and configuration can prevent (as discussed below) the wall from catastrophically failing (e.g., pulling the wall from an actuator and dropping the wall on its user or someone else). In contrast, in some cases in which an actuator (e.g., a hydraulic actuator and/or any other suitable actuator) is used under tension (e.g., the actuator is used to pull the wall so as to hold the wall in a particular position), if the actuator were to fail, the wall could pull away from the actuator and fall on the climber and/or otherwise harm the climber or damage the wall. For instance, in some embodiments in which the wall 10 comprises an actuator that is under tension (e.g., the motorized winch 86 of FIG. 1A) and that actuator does not have a secondary climbing surface support 30 (e.g., the ratcheting strap 85 in FIG. 1A), there is a possibility that if that actuator fails (e.g., the winch were to unroll its cable), the climbing surface could fall forward and harm the climber.

Where the climbing wall system 10 comprises one or more actuators, the system can comprise any suitable number of actuators. Indeed, while the system can comprise 1, 2, 3, 4, 5, 6, 7, 8, or more actuators, in some implementations, the system comprises a single actuator. In this regard, using a single actuator can provide a variety of features to the system, including, without limitation, avoiding the hassle of syncing multiple actuators, preventing un-synced actuators from binding up, and/or reducing the systems weight. In this regard, FIG. 6M-6O show some embodiments in which the climbing wall 10 is configured to operate with a single actuator 41.

Where the climbing wall 10 comprises one or more actuators 41, the actuators can be disposed in any suitable location. For instance, some embodiments comprise one or more actuators that extend from the base member 20 (and/or any other suitable support) to the climbing surface 15 (e.g., at one or more sides of the climbing surface, for instance replacing one or more of the rigid braces 37 and/or gas springs of FIG. 6D). In some other instances, the climbing wall comprises one or more solid supports (e.g., rigid braces) that are pivotally coupled at one end to the climbing surface 15 or to one or more base members 20. In this example, the other end of the one or more solid supports is coupled to one or more actuators (e.g., a threaded actuator, a piston actuator, a linear actuator, and/or any other suitable actuator) at the other of the climbing surface and the one or more base members. Thus, in such embodiments, as the actuator(s) move, placement of one end of the solid supports is changed such that an angle of the solid supports changes and forces the angle of the climbing surface to change as well.

In some other cases, one or more actuators 41 are disposed behind at least a portion of the climbing surface 15. In such cases, the climbing wall 10 can have any suitable component that allows it to function as described herein. For instance, some embodiments include a climbing surface that is configured to selectively move forward through a forward range of motion and backward through a backward range of motion, with the climbing surface comprising multiple couplers for climbing holds 200 (or climbing hold couplers) that are each configured to hold a climbing hold on a front side of the climbing surface.

In accordance with some such embodiments, FIGS. 6J-6Q show that the climbing surface 15 is pivotally coupled to a first support (e.g., the base member 20 and/or any other suitable support via one or more pivoting members 25). Additionally, FIGS. 6J-6Q show that in some such embodiments, the climbing wall 10 includes one or more lever arms 71 that have a first portion (e.g., a first end 72) that is pivotally coupled at a first pivotal coupling 73 to a second support (e.g., another portion of the base member 20 and/or any other suitable support). In some embodiments, the climbing wall 10 further comprises one or more lever arm couplers 74 (e.g., cables, bars, chains, rigid braces, and/or any other suitable couplers) that have a first part (e.g., a first end 76) that is coupled to a second portion (e.g., a second end 77) of the lever arm 71 at a second coupling 78 and that have a second part (e.g., a second end 79) that is coupled to the climbing surface 15 (e.g., at the back, a side, and/or any other suitable portion of the climbing surface 15) at a third coupling 81.

Moreover, FIGS. 6J-6Q show that, in some embodiments, one or more actuators 41 are configured to adjust an angle of the climbing surface 15. In this regard, the actuators can couple to the climbing wall 10 in any suitable manner. By way of non-limiting illustration, FIGS. 6J-6Q show that, in some embodiments, the actuators 41 have a first section (e.g., a first end 82) that is coupled to a third support (e.g., the base member 20 and/or any other suitable support) and a second section (e.g., a second end 83) that is coupled to the lever arm 71 at a fourth coupling 84 in such a manner that as the climbing surface 15 moves through its forward range of motion, a weight of the climbing surface 15 rests on the actuator 41 (e.g., the actuator is under compression). In some such embodiments in which the actuator is under compression (e.g., as discussed above), if the actuator were to fail, the weight of the climbing surface would still compress the actuator and, even if the actuator shortened to its shortest length, the actuator would prevent the climbing surface from falling on the user (e.g., and pancaking the user against the floor, under the weight of the climbing surface).

While the actuator 41 can be placed under compression in any suitable manner, FIGS. 6J-6Q show that, in some embodiments, the climbing wall 10 system comprises a four-bar linkage (or four-part linkage), with at least some weight of the linkage resting on the actuator. In this regard, FIGS. 6J-6Q show that the base member 20 (e.g., serving as the first, second, and/or third support) acts as the first part of the linkage, the lever arm 71 acts as the second part, the lever arm coupler 74 acts as the third part, and the climbing surface 15 acts as the fourth part of the four-part linkage. In this regard (and as mentioned above), as the actuator is coupled to the lever arm at the fourth coupling 84, a significant portion of the weight of the four-part linkage rests on the actuator. In this regard, while a four-part linkage can perform any suitable function, in some cases, it allows for the climbing surface to move through a relatively large range of motion (e.g., greater than about 45 degrees), while the linkage itself takes up a relatively small amount of space.

In some embodiments in which the climbing wall 10 comprises a four-part linkage (e.g., as shown in FIGS. 6J-6Q), the wall comprises one or more gas springs 33 to reduce and/or dampen a load on the actuator 41. In this regard, the gas springs can be disposed in any suitable location that allows the wall to function as described. By way of non-limiting illustration, FIG. 6N shows an embodiment in which one or more gas springs 33 are disposed on one or more sides of the actuator 41, with the gas springs being coupled to the lever arm 71 (e.g., at and/or adjacent to the fourth coupler 84).

The various couplings or joints on the lever arm (e.g., the joint 73 that connects the lever arm 71 to the base member 20 (or other support), the joint 78 that couples the lever arm coupler 74 to the lever arm 71, and/or the joint 84 that couples the actuator 41 to the lever arm 71) can be disposed in any suitable location in relation to each other. By way of non-limiting illustration, FIG. 6Q shows that in some implementations, the three joints or couplings (e.g., couplings 73, 78, and 84) are disposed linearly on the lever arm (e.g., such that a single straight line "SL" can pass through all of them).

In some other cases, however, the three joints (e.g., couplings 73, 78, and 84) are disposed in a non-linear configuration. In this regard, while such joints can be disposed in any suitable configuration, FIGS. 6J-6M and 6O-6P show some embodiments in which the three joints (e.g., couplings 73, 78, and 84) are disposed in a triangular (and/or any other suitable) configuration (e.g., when viewed from a side). In some such cases, by having the joints be disposed in a non-linear configuration, the actuator 41 can control a placement of the climbing wall with relatively little movement of the actuator.

In addition to, or in place of, the gas springs 33 and/or actuators 41, the climbing surface supports 30 can comprise any other suitable components. By way of non-limiting illustration, FIGS. 7-9A show some embodiments in which the supports 30 comprise one or more legs 90 and/or cross members 95. Where the supports comprise one or more legs and/or cross members, such components can have any suitable characteristic that allows them to support the climbing surface 15 and/or to be used to selectively modify a position of the climbing surface. For instance, although, in some embodiments, the height of one or more connection points between the legs (e.g., one or more cross members and/or any other suitable connection points) and the climbing surface are fixed, in some other embodiments, the height of the connection points between the legs (e.g., the cross members) and the climbing surface are selectively variable.

Where a height of a connection point between the legs 90 and the climbing surface 15 is variable, the height of such connection point can be varied in any suitable manner, including, without limitation, by having multiple cross members at different heights to which the climbing surface can be attached, by being able to move the cross member to one or more different heights on the leg or legs, by being able to increase and/or decrease a height of the legs, by being able to connect the legs to different portions (e.g., lower and/or higher portions) of the climbing surface, by having the legs comprise one or more actuators 41 that are configured to raise or lower a connection point, and/or by otherwise being configured to function in any other suitable manner. In some embodiments, however, the height of the legs is configured to be adjusted (e.g., by each leg comprising: an actuator, a jack, a load bar, two pieces in which at least one piece defines a hole and the other piece defines a plurality of holes that allow the two pieces to be adjusted with respect to each other and a pin (or other object) to slide through some of the holes to selectively lock a position of the leg pieces with respect to each other, and/or by comprising any other suitable mechanism that is configured to adjust a height of the legs). By way of non-limiting illustration, FIGS. 7-9A show some embodiments in which a height of the legs 90 is configured to be adjusted (e.g., by sliding a pin through holes in at least two pieces of the legs and/or otherwise).

Where the climbing wall supports 30 comprise one or more legs 90, the legs can be disposed in any suitable location that allows them to support the climbing surface 15, including, without limitation, being disposed between, at, and/or outside of the lateral edges (e.g., right side and/or left side) of the climbing surface. By way of non-limiting illustration, FIGS. 7-9A show some embodiments in which the legs 90 are disposed laterally to the lateral edges of the climbing surface 15, with a cross member 95 extending between the legs and supporting the climbing surface.

Where the wall 10 comprises one or more legs 90 that are disposed laterally to one or more lateral sides of the climbing surface 15, the legs can be disposed any suitable distance from a corresponding lateral edge of the climbing surface, including, without limitation, between about 0.01 cm and about 3 m (or within any subrange thereof). Indeed, in some embodiments, each leg is disposed laterally between about 0.5 m and about 1.5 m (e.g., 75 m) from a corresponding lateral edge of the climbing surface 15. As a result, if a climber falls from the climbing surface, the climber can do so without hitting one or more of the legs.

Where the climbing wall 10 comprises one or more climbing surface supports 30 (e.g., legs 90, ratcheting straps 85, actuators 41, etc.), the supports can be adjusted in any suitable manner and at any suitable time. Indeed, in some embodiments, the supports are manually adjustable (e.g., via one or more ratcheting mechanisms; by moving one or more connection points of a chain, cable, strap, and/or other support; by twisting a threaded engagement in a support; by moving adjusting a height or connection point of the legs; and/or in any other suitable manner); by being automatically adjustable (e.g., adjusted via one or more actuators (e.g., motors, servos, gear mechanisms, etc.), programs, voice commands, remote controls, processing units, user interfaces, smartphones, and/or any other suitable mechanism), and/or in any other suitable manner.

Indeed, in some embodiments, the wall 10 is manually adjusted. In other embodiments, the wall is configured to automatically adjust: as the climber moves to different holds on the wall, as directed by another entity (e.g., a training program; an exercise program; a trainer, competitor, another climber located with or remotely located away from the climber; and/or any other entity), based on the climber's climbing skills, based on set time periods, as controlled through a user interface (e.g., a phone, a user interface coupled to the wall) and/or in any other suitable manner. Indeed, although some embodiments of the wall are configured to stay in a static configuration as a climber climbs on the climbing surface, in some other embodiments, the wall is configured to change its angle one or multiple times while the climber is climbing on the climbing surface.

In some embodiments, one or more components of the climbing wall 10 are in signal communication with one or more smartphones, computers, and/or any other suitable type of processors (e.g., as discussed below) that are configured to adjust one or more portions of the wall. Indeed, in some embodiments, a computer processor is configured to adjust the angle of the climbing surface (and/or to otherwise modify one or more features of the wall) (e.g., via one or more actuators, programs, set time periods, sensor readings, voice commands, remote controls, and/or any other suitable mechanisms) based on one or more electronic commands that are given, preset programs, programs based on the users status, workouts selected, locations of a climber (e.g., depending on where the climber is on the wall, etc.), and/or based on feedback from one or more sensors on the wall, based on any other suitable command, and/or in any other suitable manner.

Figure 9A:
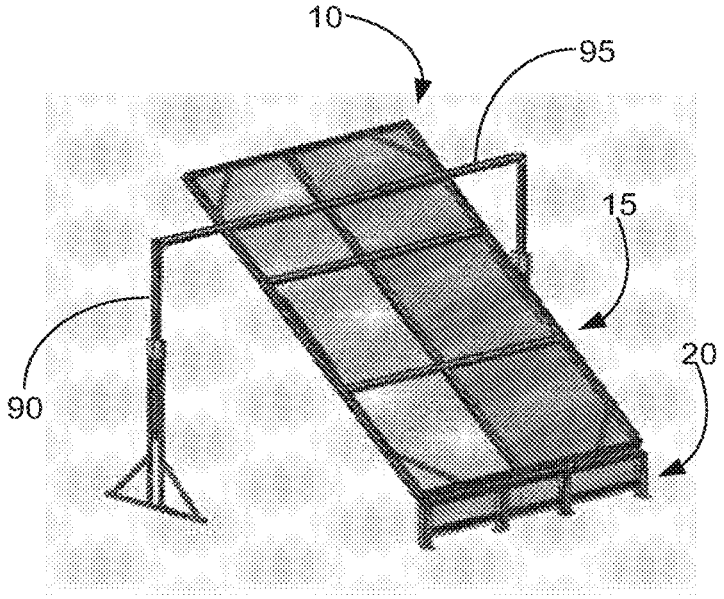
FIG. 9A illustrates a back-perspective view of the adjustable climbing wall in which the climbing wall comprises the pair of support legs in accordance with a representative embodiment.
Figure 9B:
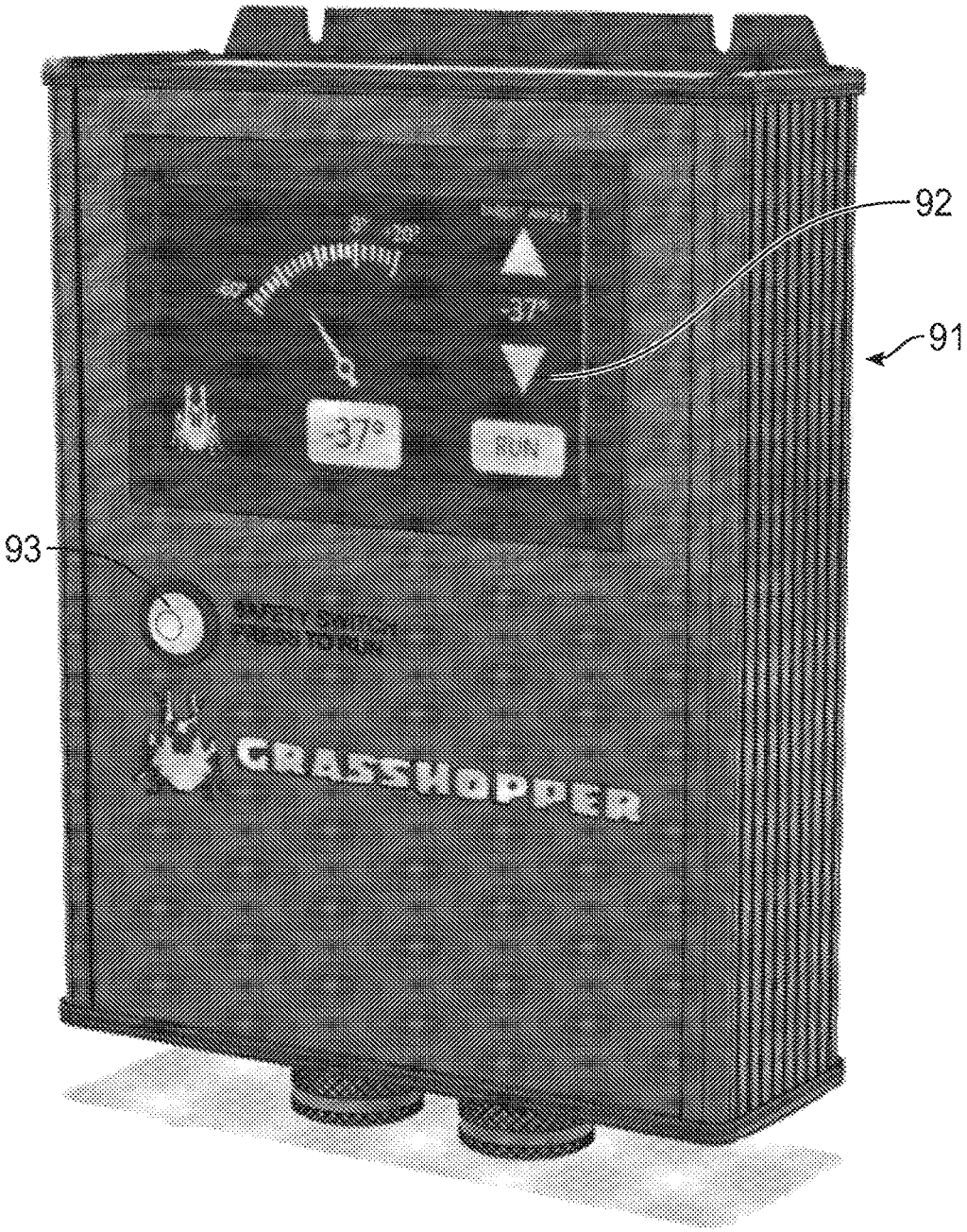
FIG. 9B illustrates a front perspective view of a user interface in accordance with a representative embodiment.

By way of non-limiting illustration, FIG. 9B shows an embodiment, in which the wall (not shown in FIG. 9B) comprises or is otherwise used with a user interface 91. While such a user interface can comprise any suitable feature (e.g., one or more: controls to change an angle of the climbing surface 15, water feature controls, fan controls, program interfaces that give the user the ability to choose between a number of programs and/or to reprogram how and when the climbing surface chances its angle, kill switches, and/or any other suitable controls), FIG. 9B shows an embodiment in which the user interface 91 comprises a touch screen interface 92 (e.g., including a control for changing an angle of the climbing surface) and a dead-man switch 93 that only allows the wall to move when then switch is being pressed (e.g., to ensure that no one is pinched or otherwise harmed as the wall operates). In some other embodiments, a user is able to download an app to a smartphone or other device to control the wall.

Figure 6L:
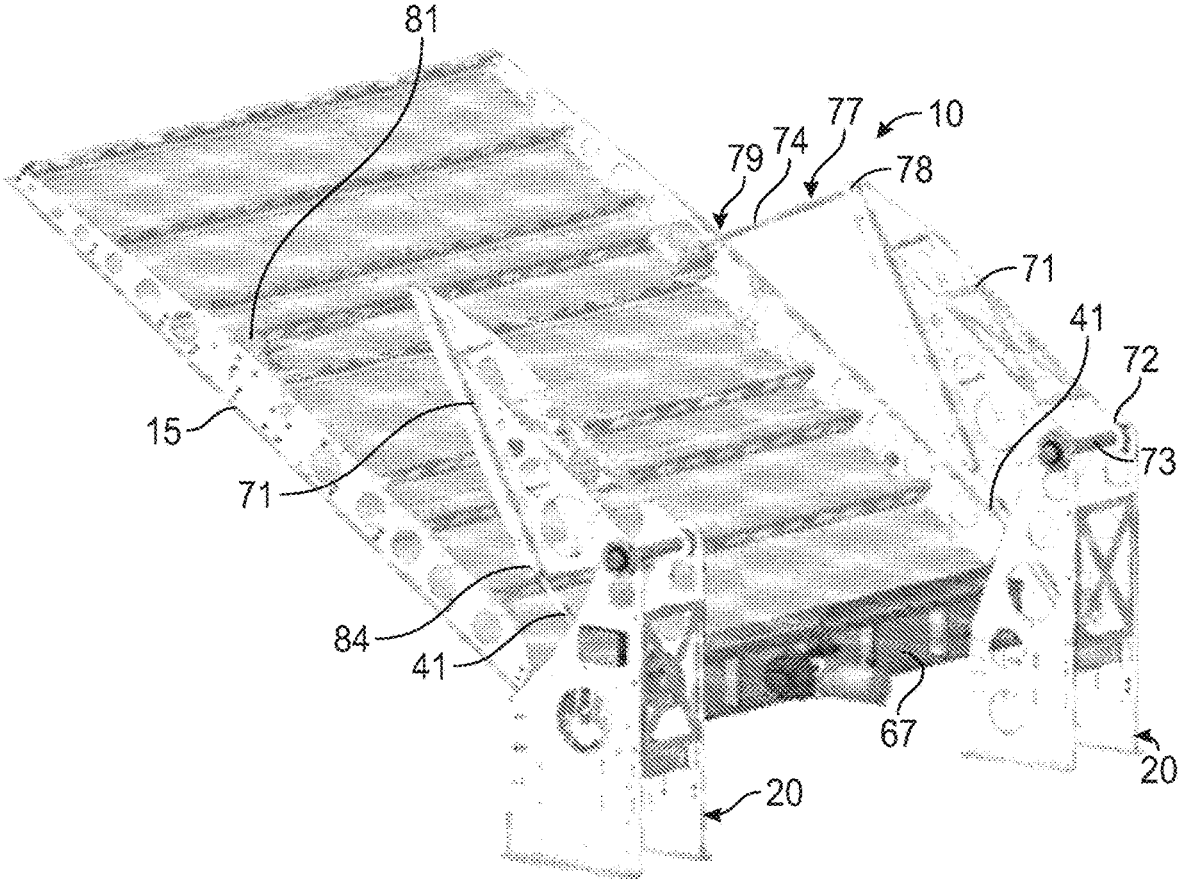
Figure 6M:
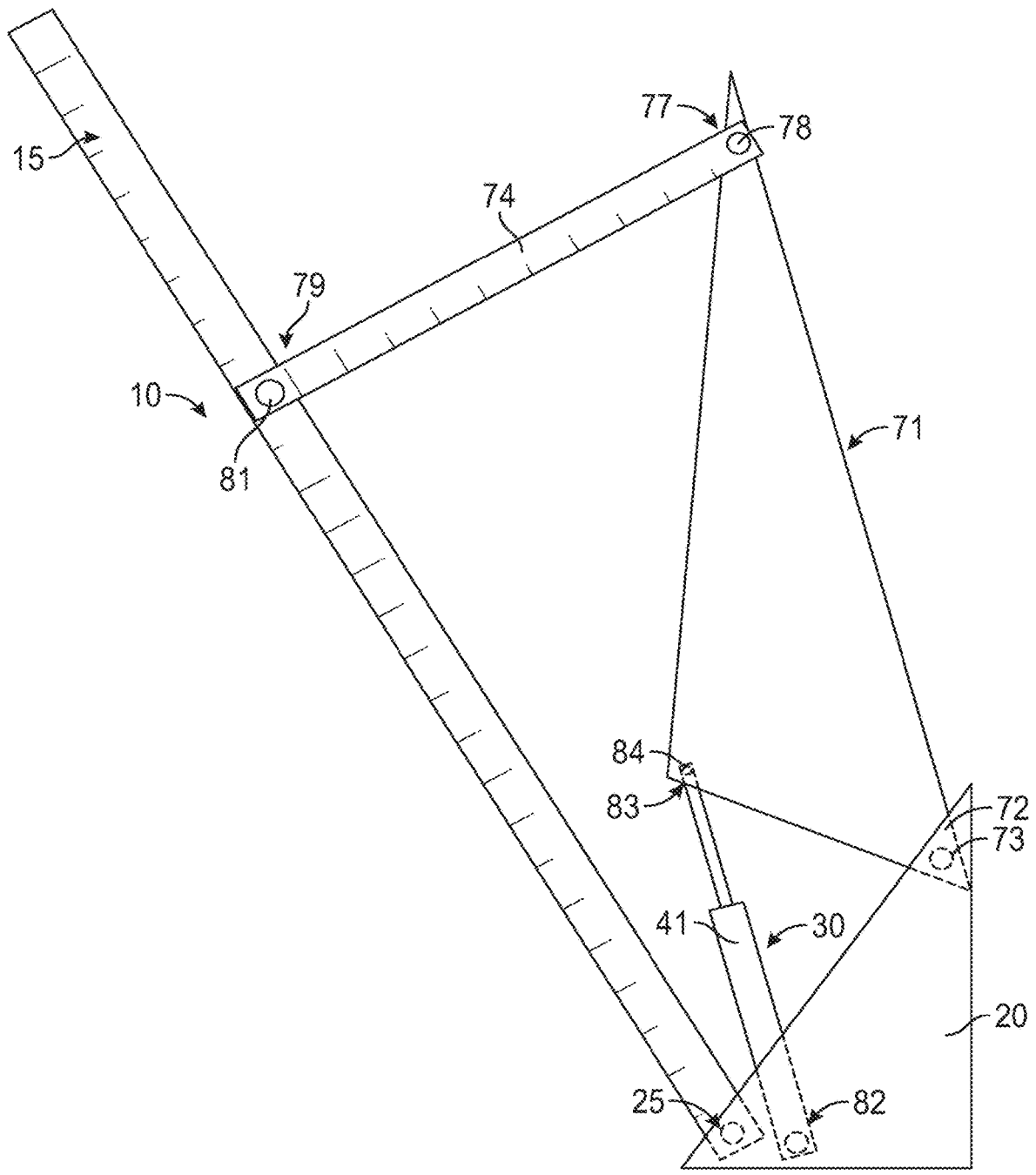
FIG. 6M illustrates a side view of a representative embodiment of the climbing wall.
Figure 6N:
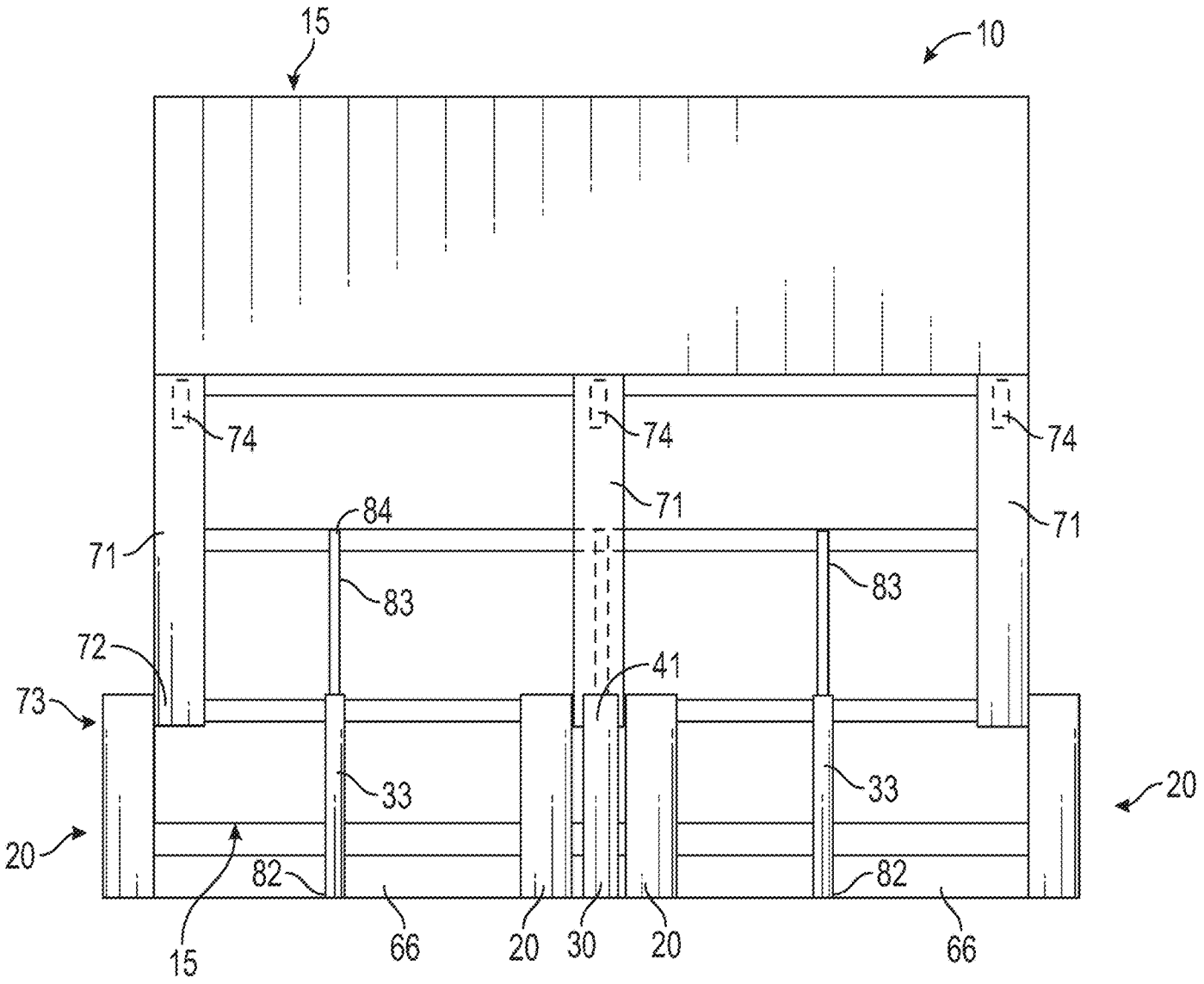
FIG. 6N illustrates a side view of a representative embodiment of the climbing wall.
Figure 6O:
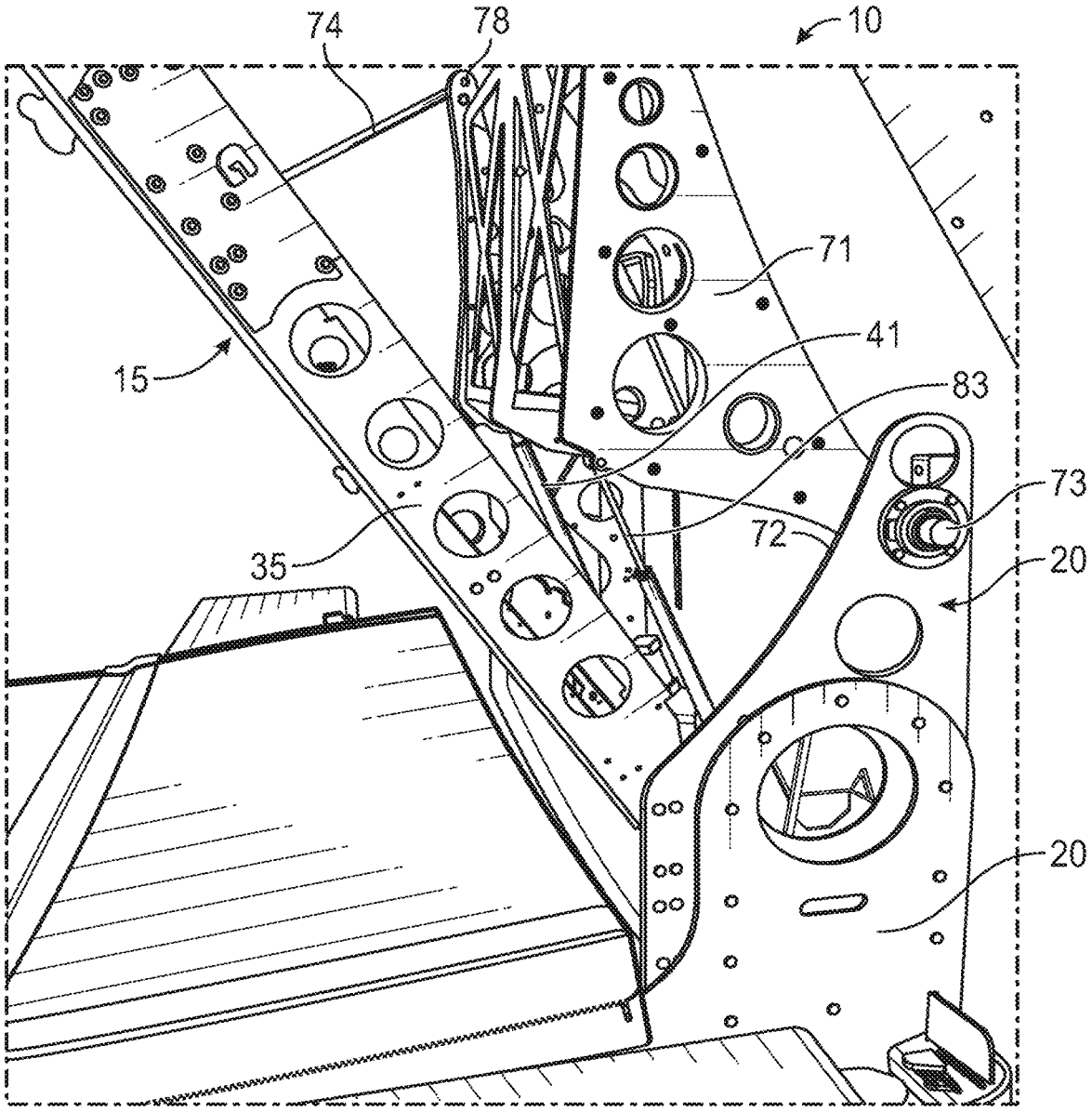
FIGS. 6O-6P each illustrate a side perspective view of the climbing wall in accordance with some embodiments.
Figure 6P:
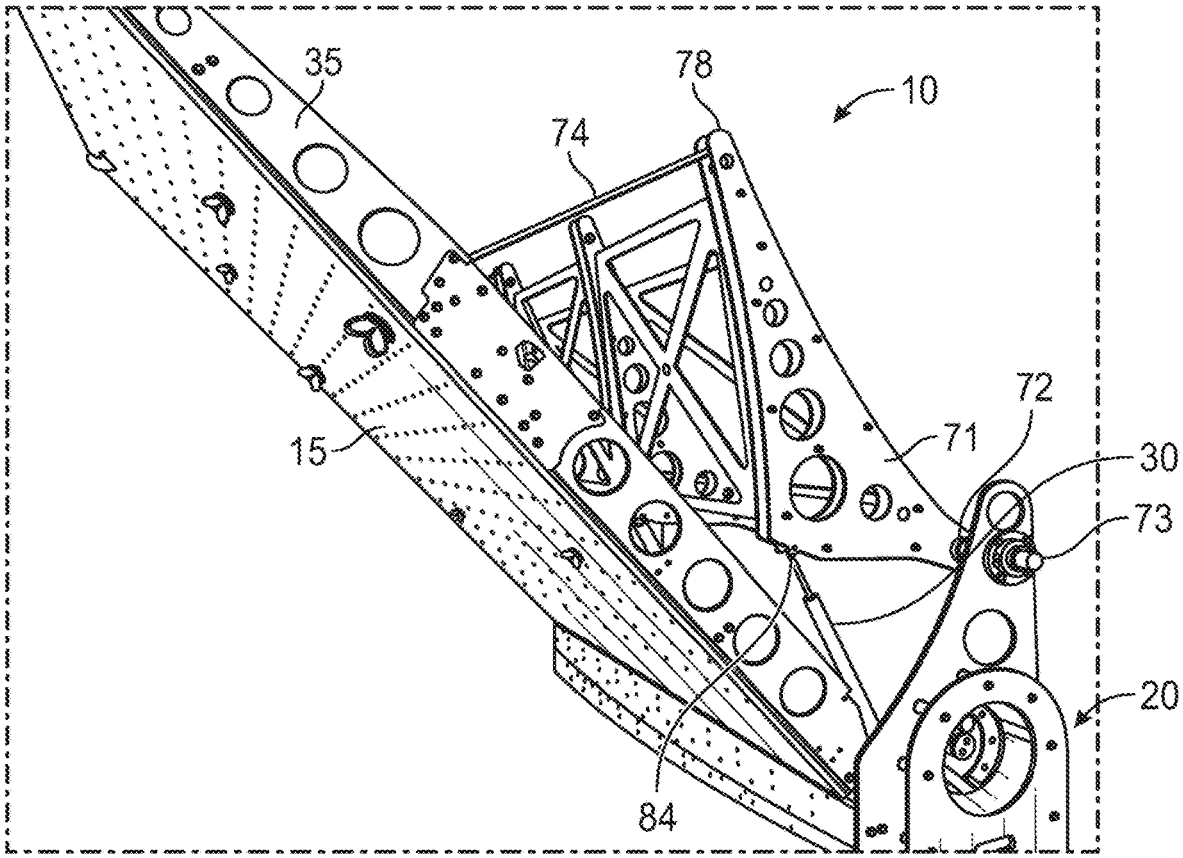
Figure 6Q:
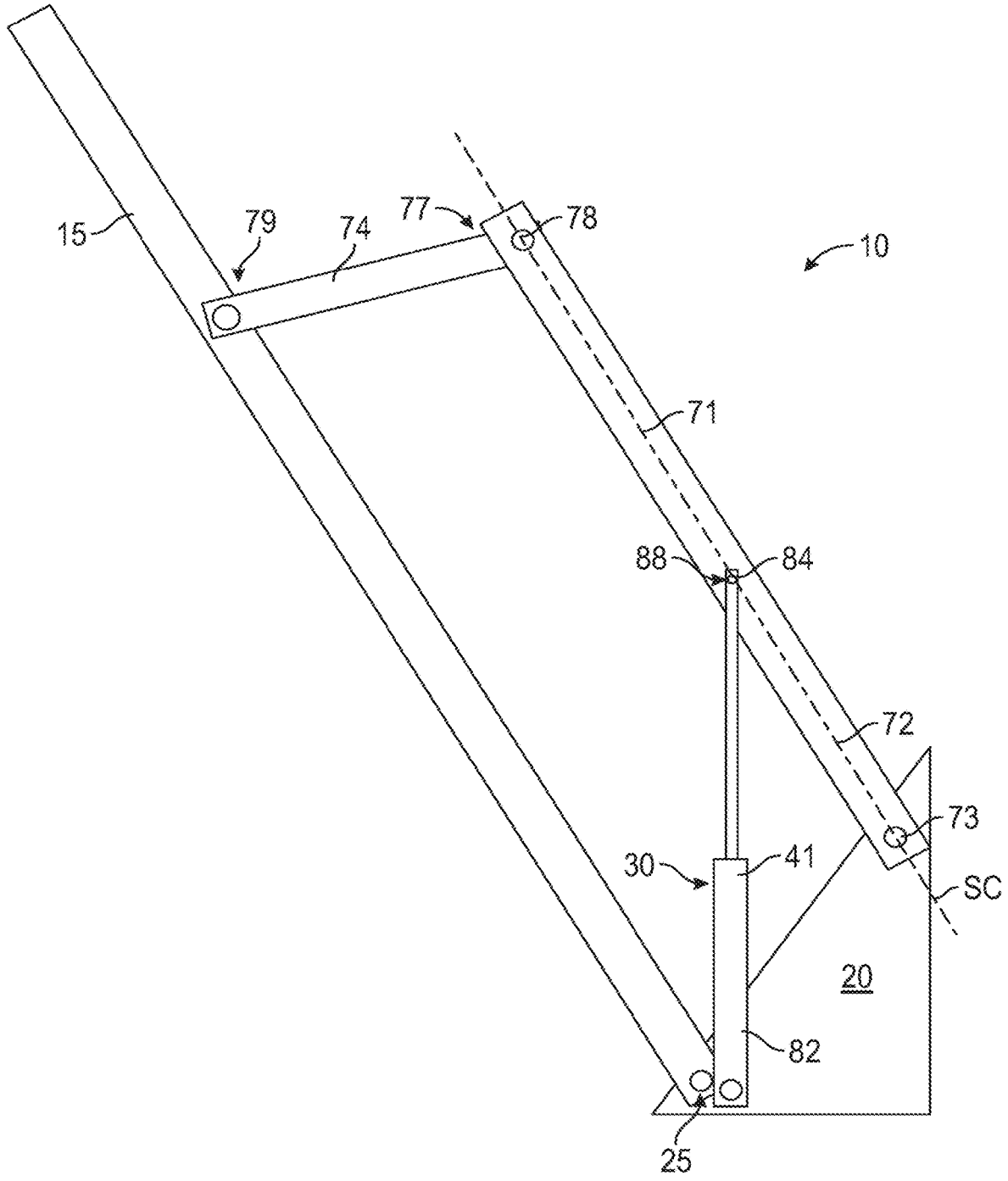
FIG. 6Q-6S each illustrate a side view of a different representative embodiment of the climbing wall.
Figure 6R:
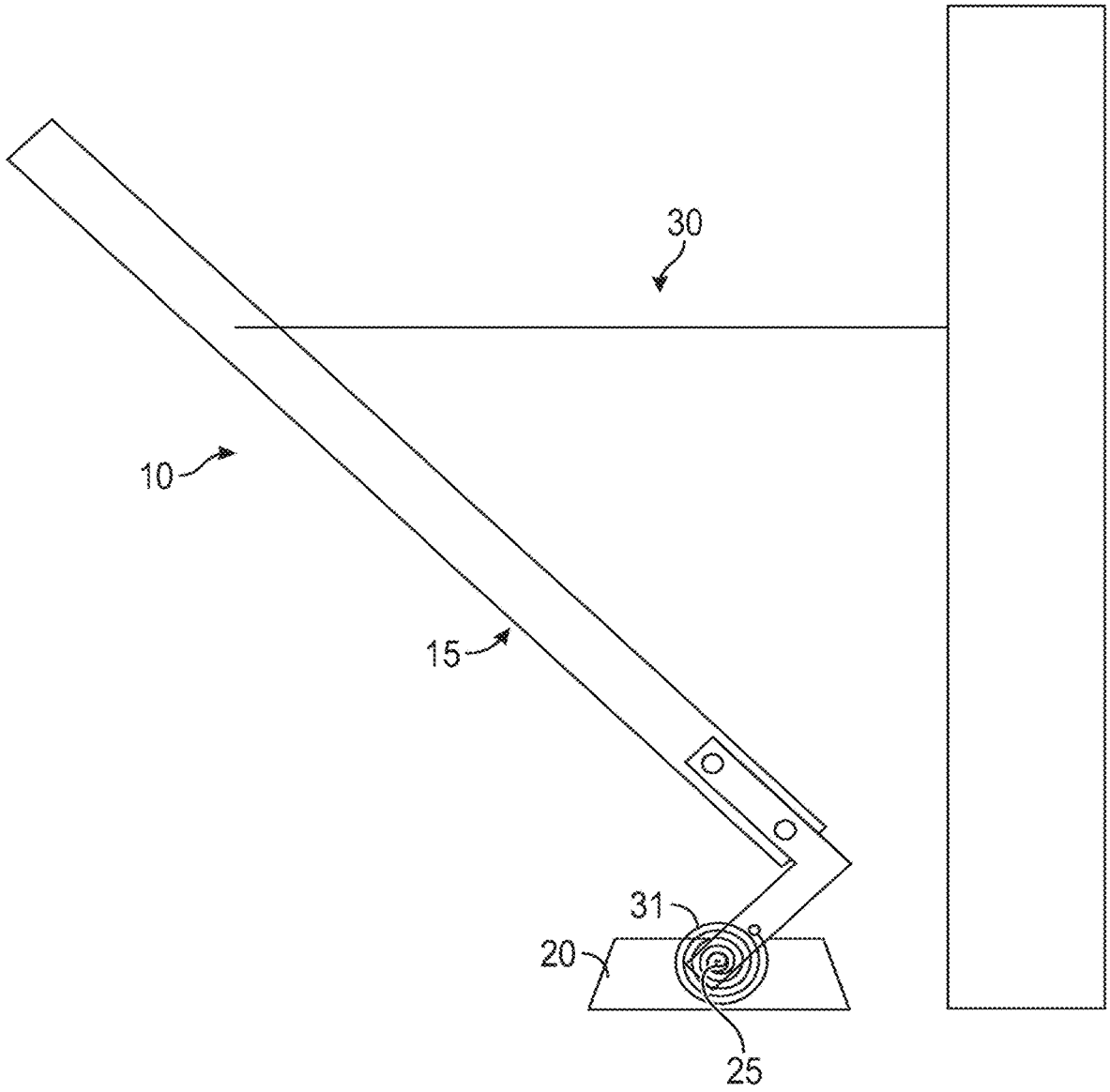
Figure 6S:
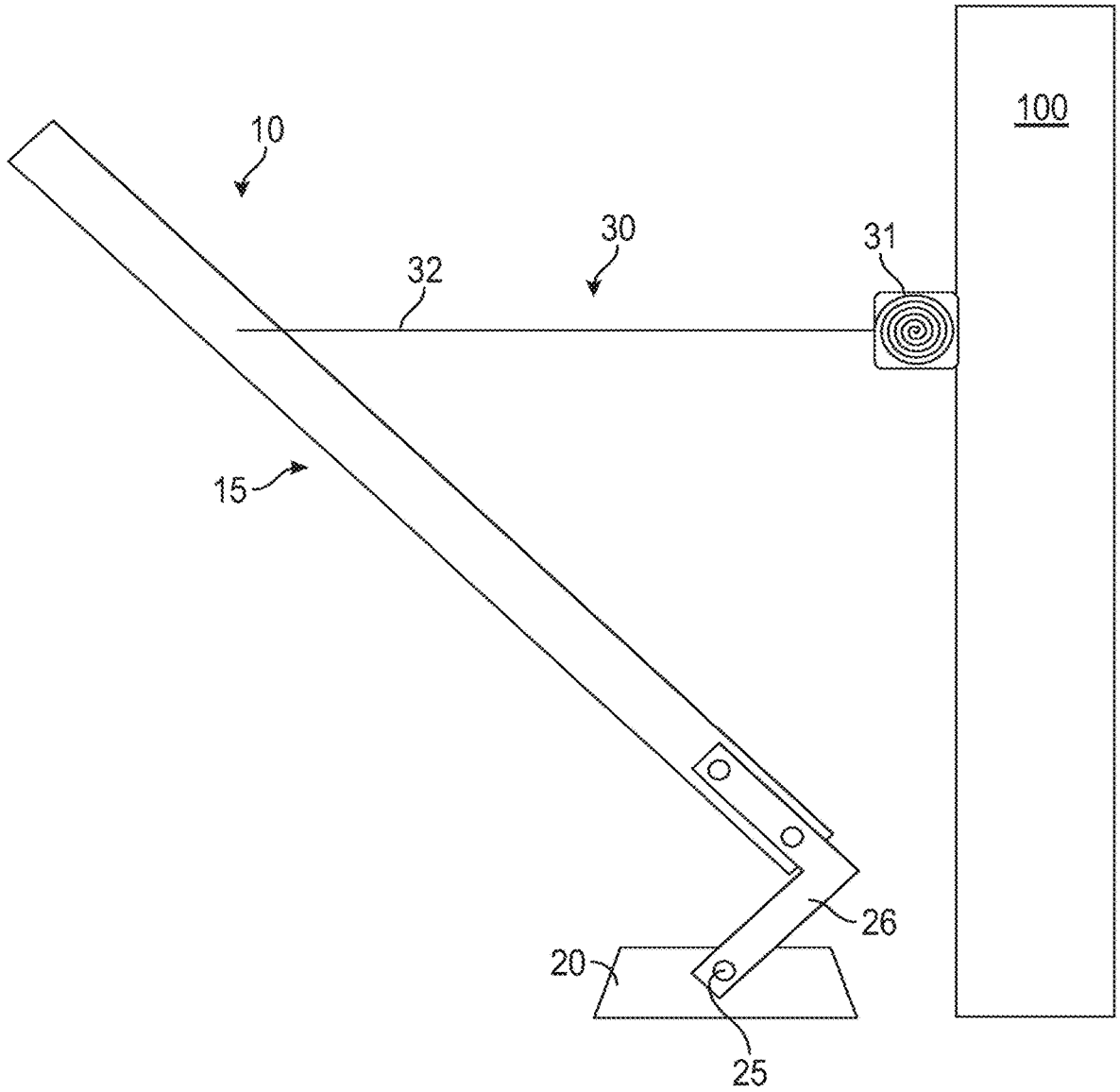
Figure 7:
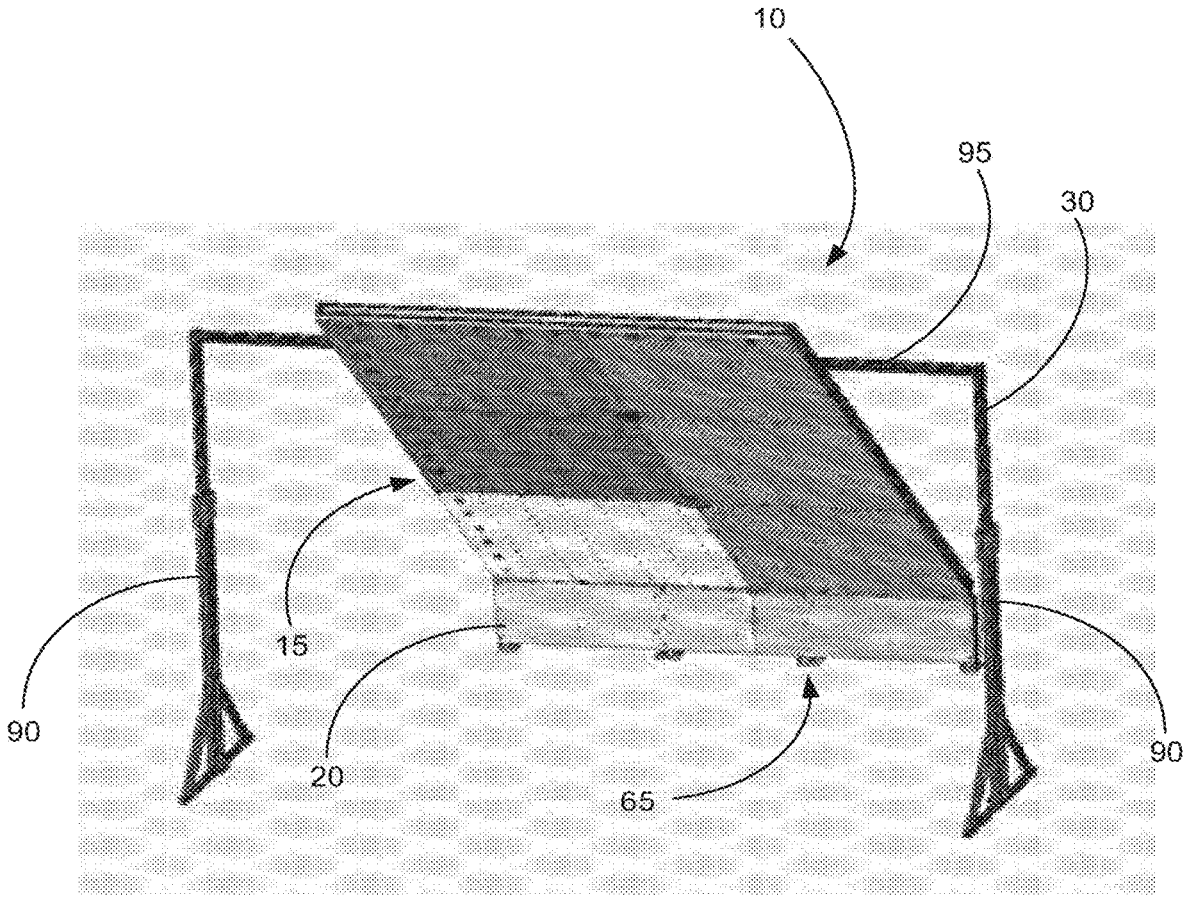
FIG. 7 illustrates a front perspective view of the adjustable climbing wall in which the climbing wall comprises a pair of support legs that extend to the sides of the climbing wall in accordance with a representative embodiment.
Figure 8:
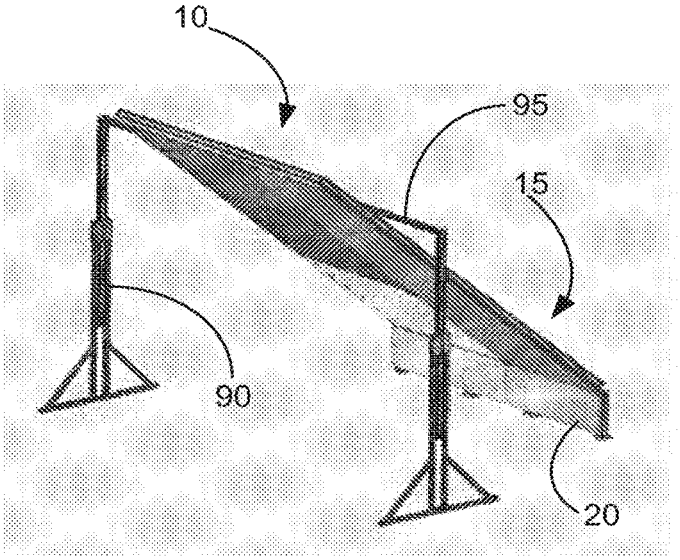
FIG. 8 illustrates a side perspective view of the adjustable climbing wall in which the climbing wall comprises the pair of support legs in accordance with a representative embodiment.

In some embodiments in which the climbing wall 10 comprises more than one climbing surface support 30, multiple supports are configured to adjust an angle of the climbing surface 15 at the same time (e.g., synchronously or otherwise) (e.g., as shown in FIG. 6L). In some other embodiments, however, one or more supports (e.g., actuators 41) are configured to be adjusted at different times (e.g., asynchronously). Thus, in some such latter embodiments, the supports can be used to not only adjust an angle of the climbing surface 15 with respect to a floor, but from side to side as well.

In some embodiments, the supports 30 are configured to allow the climbing surface 15 to be selectively moved to one or more of a fixed number of positions. Indeed, in some embodiments, the supports are configured to be used to hold the climbing surface in one or more incremental positions (e.g., to be moved in increments, including, without limitation, increments of 5 degrees, 10 degrees, and/or any other suitable increments). In some other embodiments, however, the supports are configured to allow the climbing surface to be moved to virtually any desired position and/or to an infinite number of positions (e.g., by adjusting the supports, such as one or more actuators 41, as much or as little as desired). Accordingly, in some such embodiments, the climbing wall 10 can be finely adjusted to multiple positions desired by one or more specific climbers.

Figure 10:
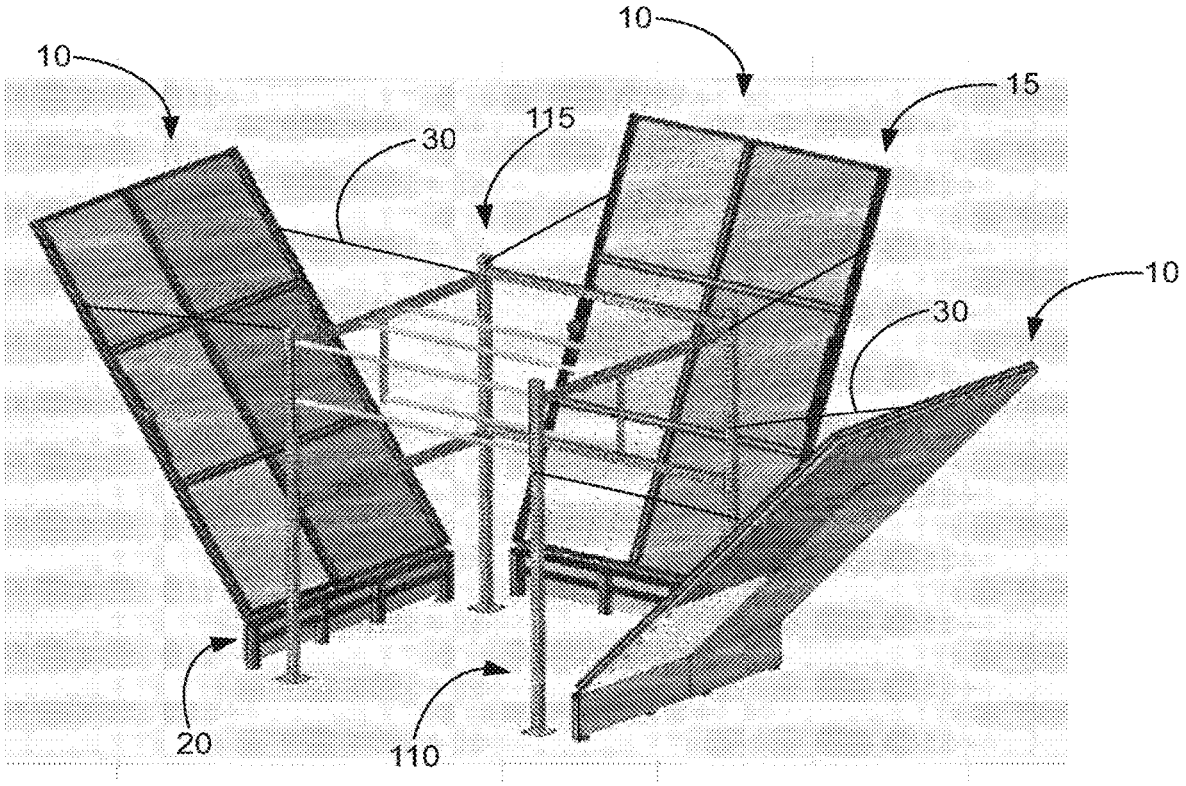
FIG. 10 illustrates a perspective view of multiple adjustable climbing walls that are coupled to a central frame or support in accordance with a representative embodiment.
Figure 11:
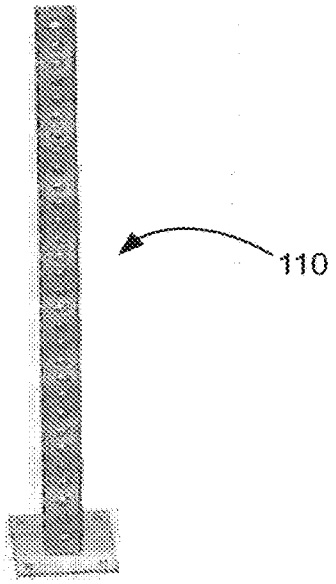
FIG. 11 illustrates a perspective view of a portion of a support object in accordance with a representative embodiment.

In order to hold the climbing surface 15 at a desired angle, the supports 30 can be coupled to, rest on, braced against, and/or otherwise interact with any suitable support surface or object. Indeed, in some embodiments, the supports are coupled to or rest on (directly or indirectly) one or more walls, pillars, floors, frames, frameworks, braces, vehicles, trees, fences, support surfaces, posts, scaffolds, structures, power racks, power cages, squat cages, squat racks, benches, weight lifting racks, weight lifting systems, base members, and/or any other suitable object that is capable of supporting the climbing wall 10 and/or one or more climbers on the wall. By way of non-limiting illustration, FIG. 3 shows an embodiment in which the climbing surface 15 is anchored by one or more supports 30 to a wall 100, a post, and/or any other suitable support object that is capable of supporting the climbing wall 10. In some other illustrations, however, FIGS. 10-11 shows some embodiments in which one or more climbing walls 10 are coupled (or configured) to couple (e.g., via one or more supports 30) to a frame (e.g., one or more posts 110, power racks 115, and/or any other suitable support structure).

In addition to the aforementioned components, the described climbing wall 10 can have any other suitable component that allows it to function as intended. In one example, some embodiments of the climbing wall optionally comprise one or more mechanisms for indicating an angle of the climbing surface 15. In this regard, the wall can comprise any suitable mechanism that is capable of performing such a function, including, without limitation, one or more inclinometers, baseline bubble inclinometers, tilt gauges, digital gauges, smart phones or other electronic devices comprising an inclinometer, user interfaces, magnetic levels, magnetic angle finders, clinometers, pitch locators, slope locators, tube inclinometers, satellite inclinometers, protractors, markings and/or meters on various positions or connection points for the supports 30 (showing various angles that are achieved when the supports are adjusted), and/or any other suitable mechanism. By way of non-limiting illustration, FIG. 6A shows an embodiment in which the climbing wall 10 comprises a protractor 100 (and/or any other suitable inclinometer). In some other embodiments (not shown), the wall comprises a holder for cell phone, tablet, inclinometer, and/or other electronic device that is capable of indicating an angle of the climbing surface. In still other embodiments, the climbing wall has a built-in digital display that indicates the angle of the climbing surface. In still other embodiments, the wall comprises one or more sensors and the wall is configured to relay measurements from such sensors to a smartphone, user interface, and/or any other suitable processing unit.

Figure 12:
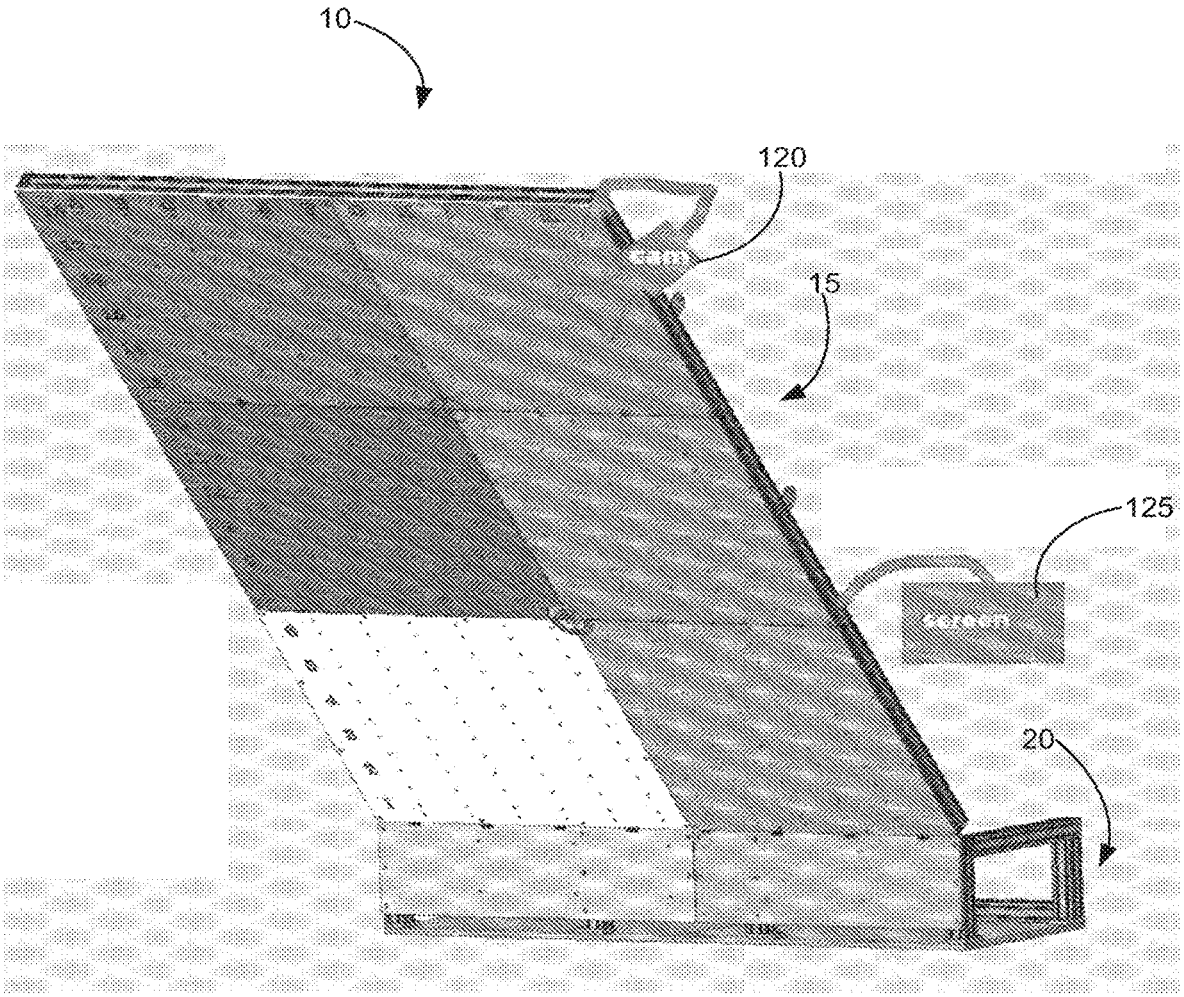
FIG. 12 illustrates a front perspective view of the adjustable climbing wall in accordance with a representative embodiment.
Figure 13:
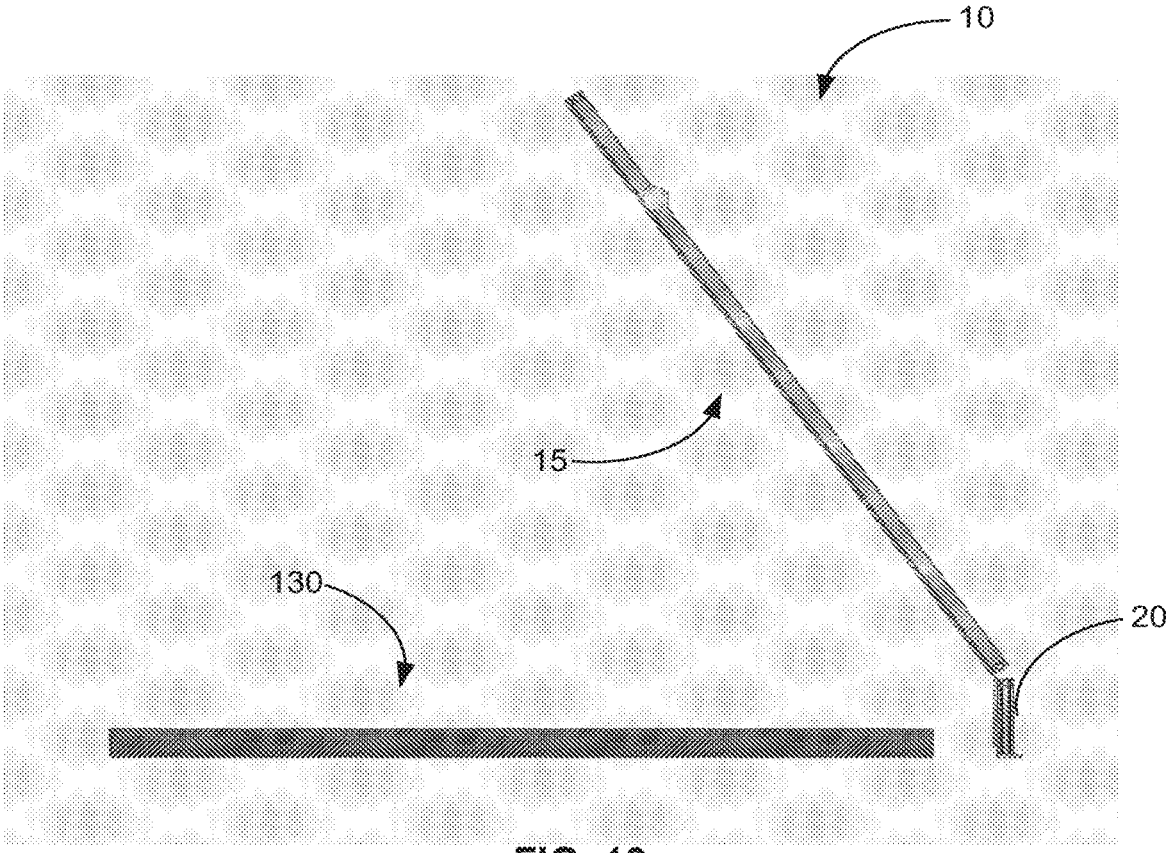
Figure 14:
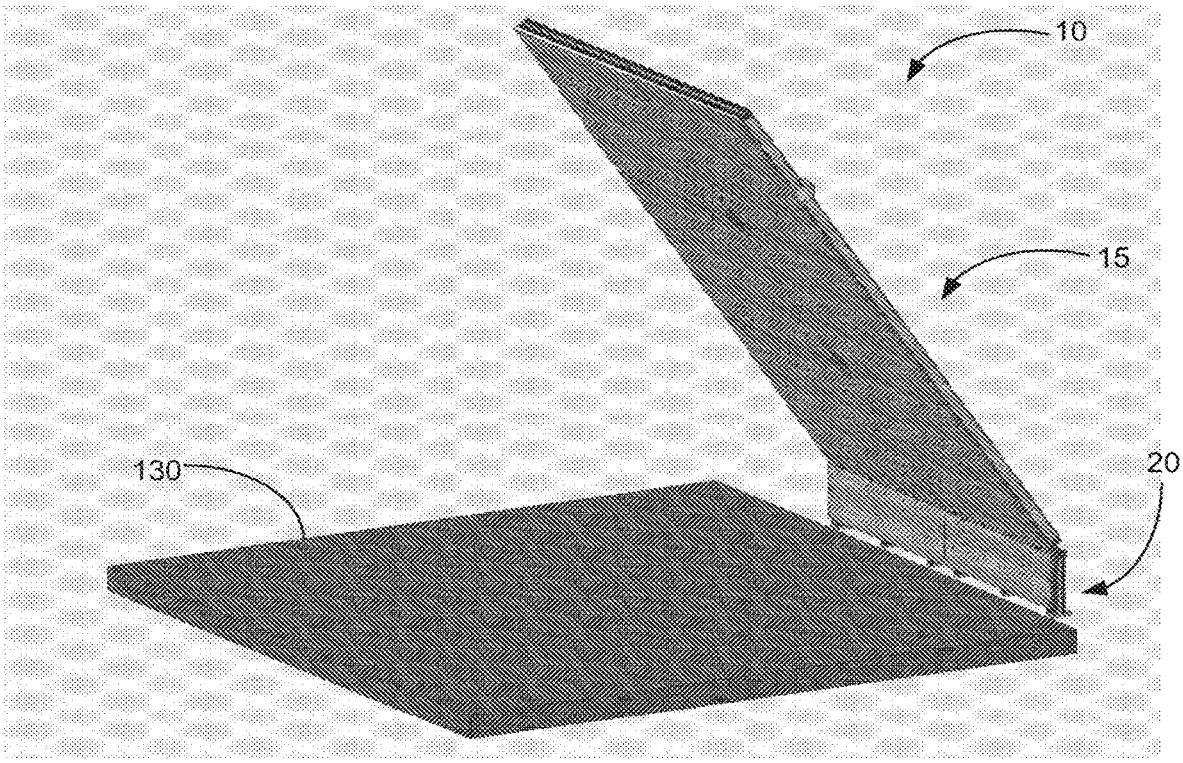
Figure 15:
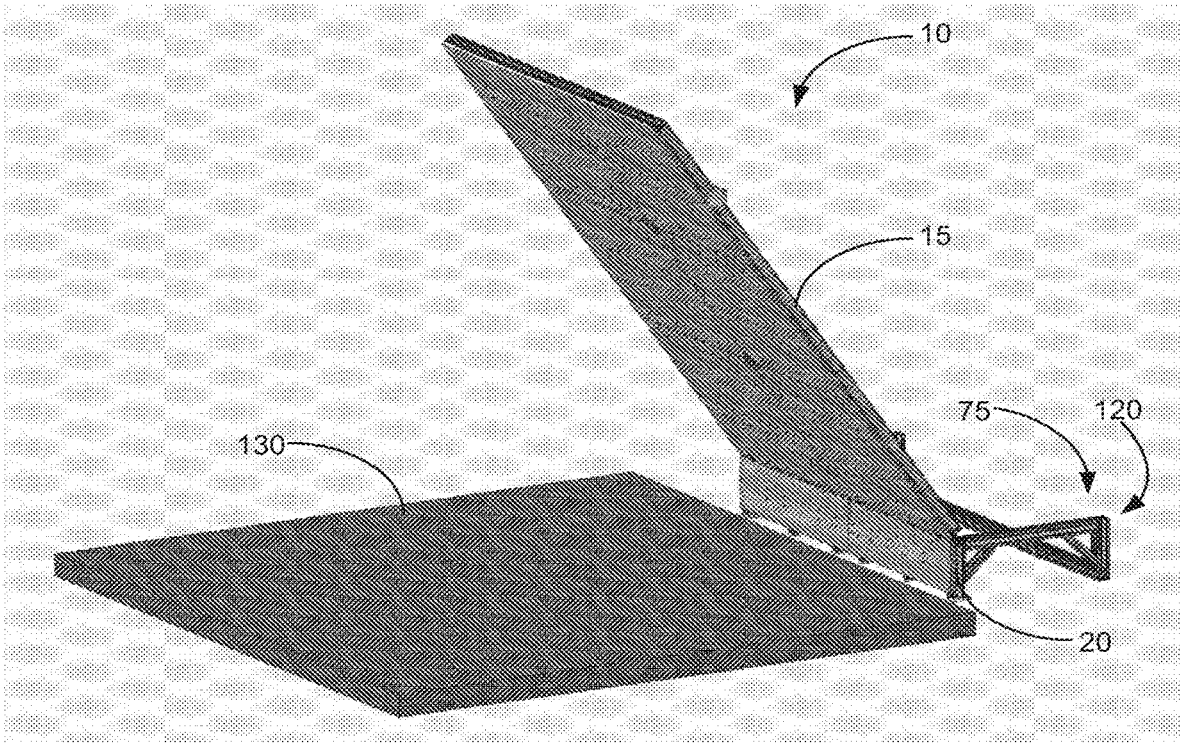
Figure 16:
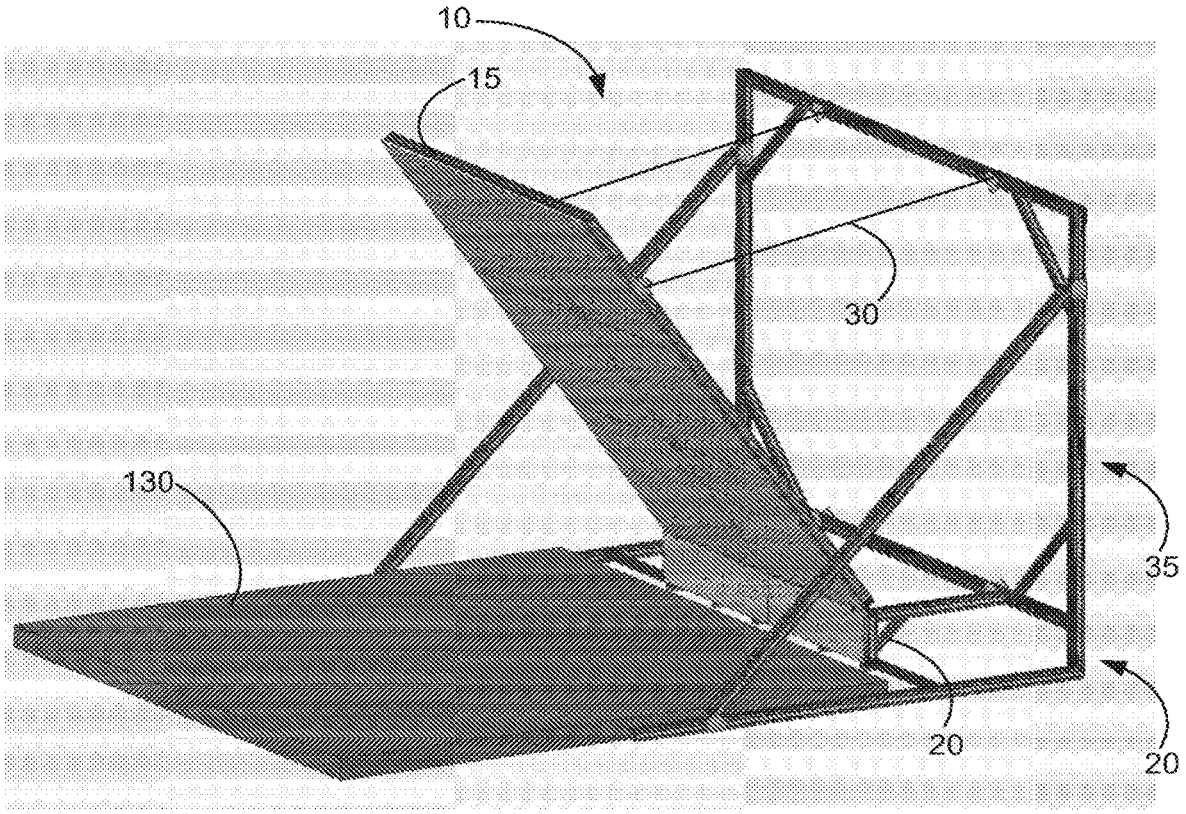
Figure 17:
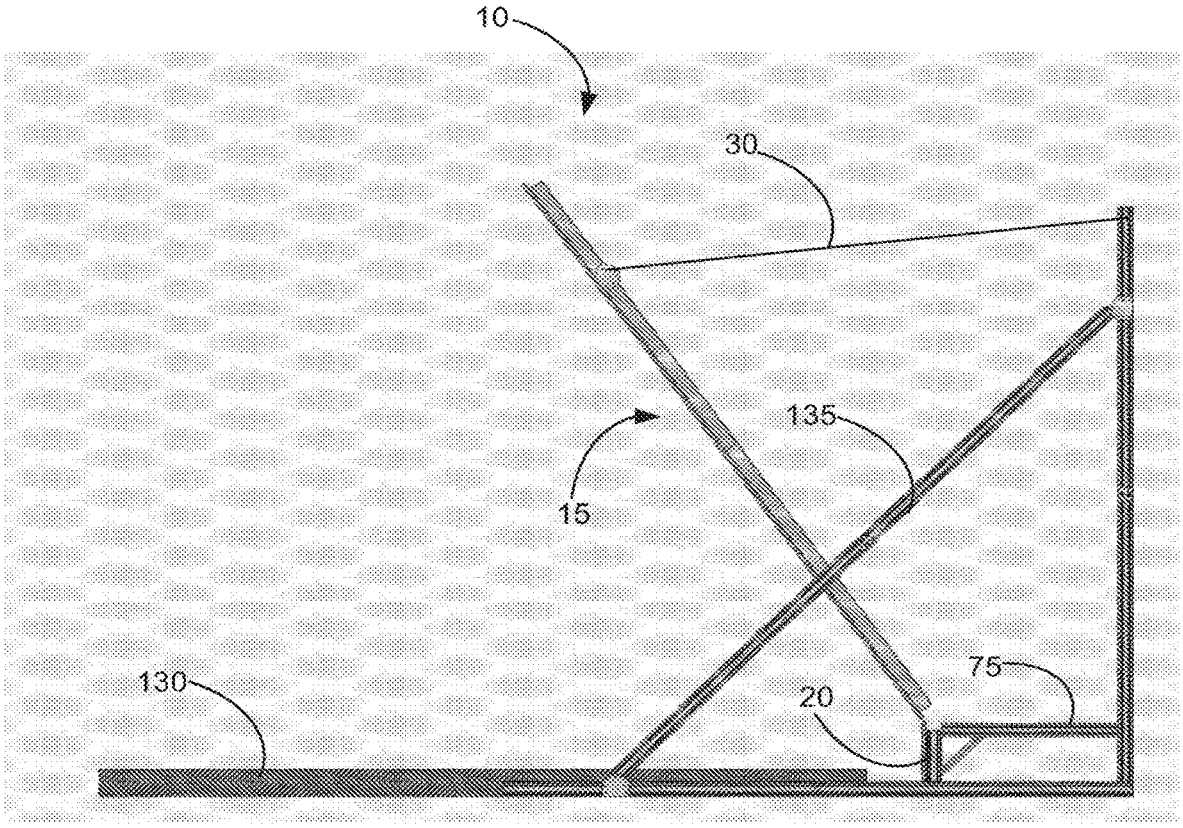
Figure 18:
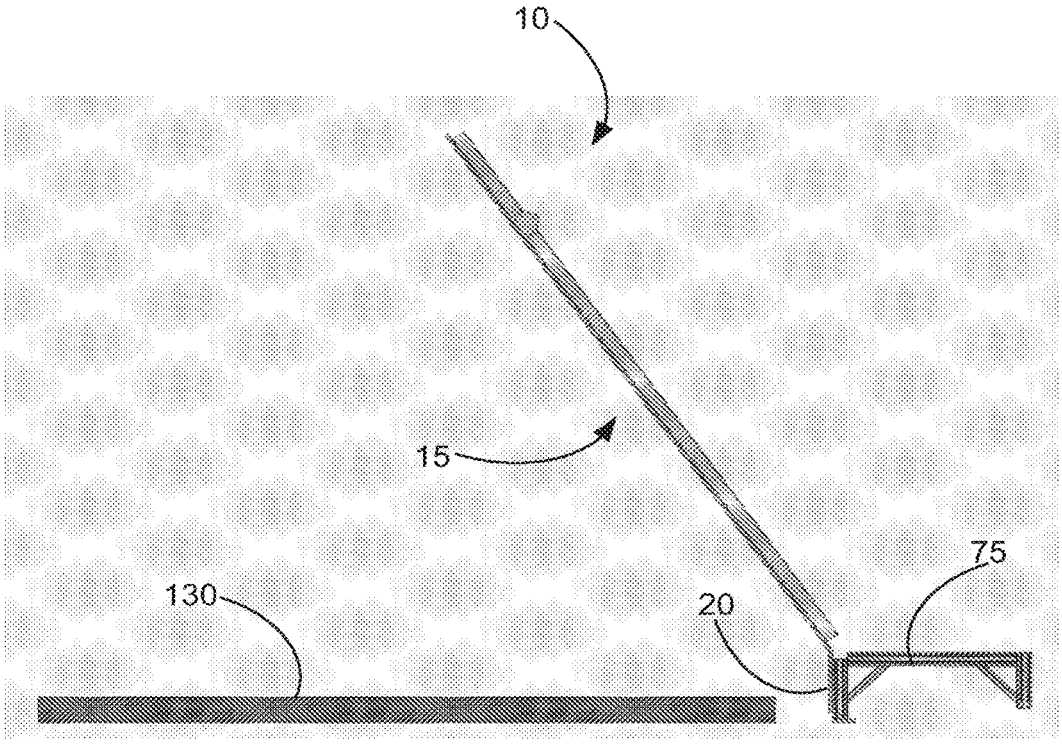
Figure 19:
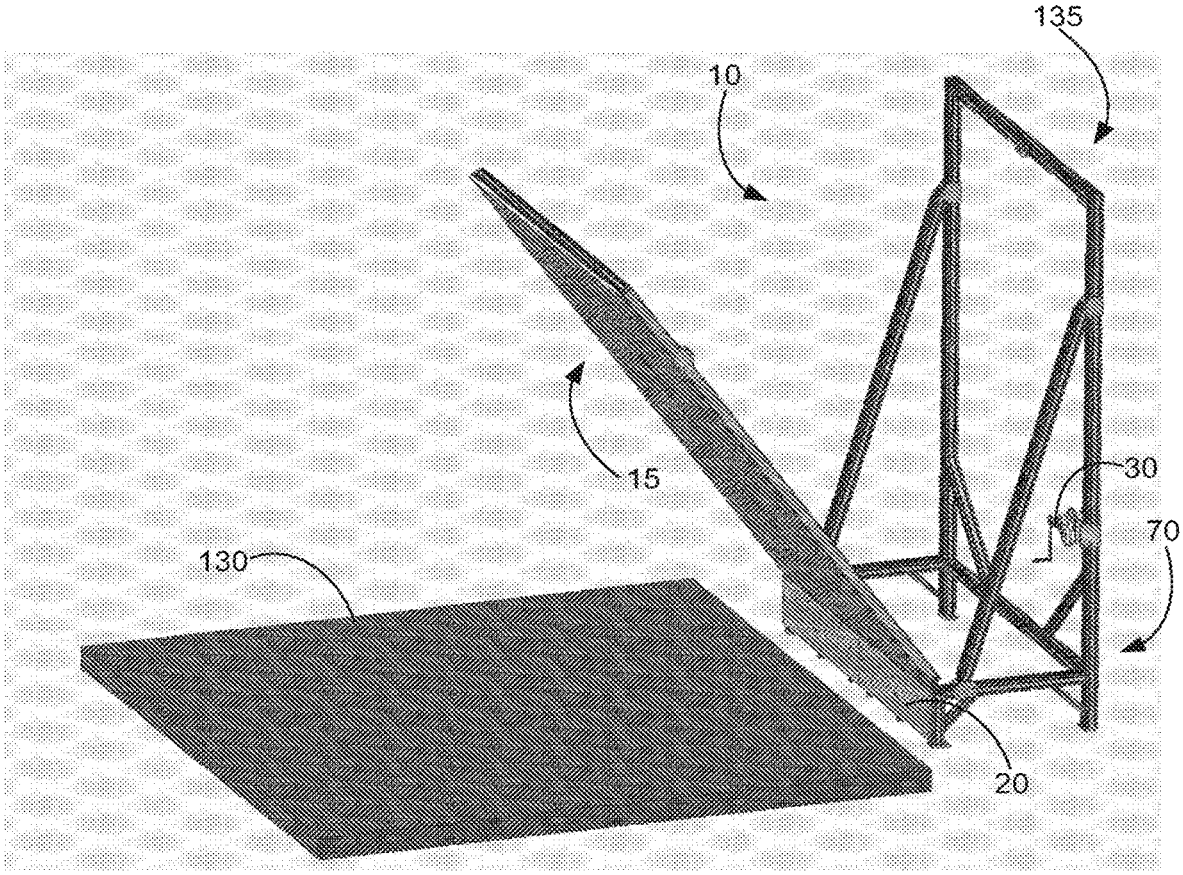
Figure 20:
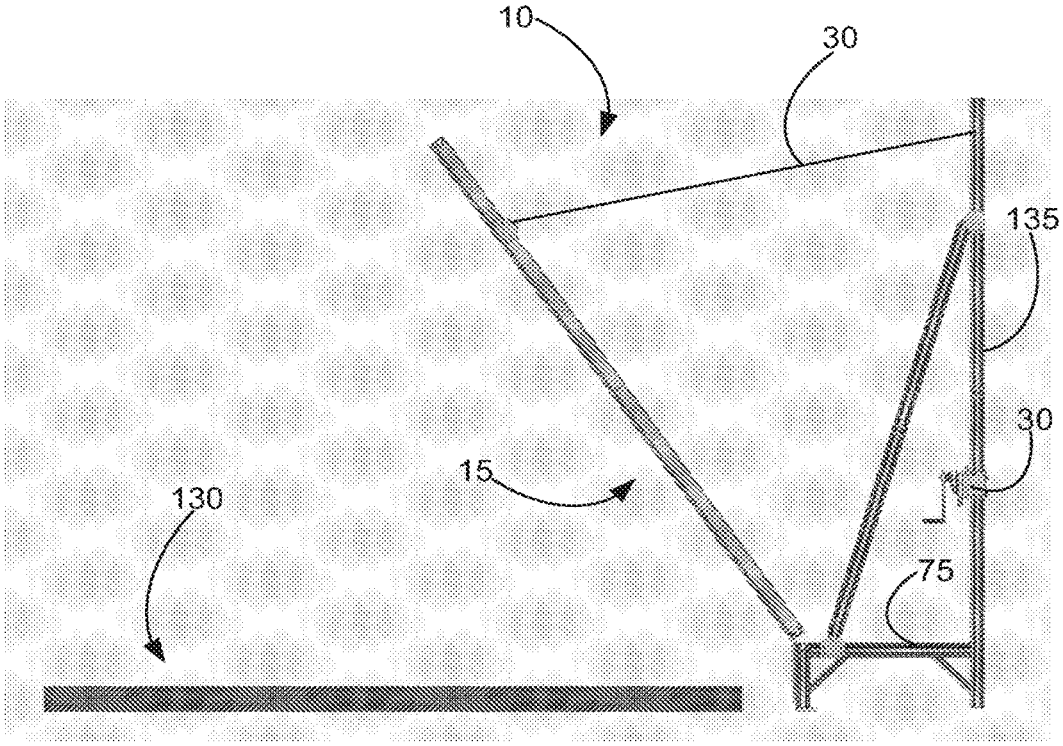

In some embodiments, the climbing wall 10 comprises and/or is otherwise associated with one or more cameras, sensors, microphones, and/or other suitable devices that are configured to capture images and/or audio of a person (e.g., a climber and/or a trainer on or near the climbing wall) and/or to otherwise gather information on a climber. In some such embodiments, the camera and/or microphone (and/or any other suitable device) can be used to: record a climber's climbs, transmit the climber's climbs and/or conversations to another location (e.g., a trainer, a competitor, a friend, etc.), analyze a climber's climbs, identify which holds 200 a climber uses, and/or for any other suitable purpose. Indeed, in some embodiments, use of a camera allows the climber to interact in near real-time with another person (e.g., a trainer and/or friend) in another location. While such a camera, microphone, and/or other device can be disposed in any suitable location, in some embodiments, they are coupled to the climbing surface 15 (e.g., as shown by the camera 120 in FIG. 12), one or more legs 90, one or more stands, the floor, and/or in any other location.

As another example of a suitable component of the climbing wall 10, some embodiments of the climbing wall optionally comprise one or more displays, speakers, light boards, and/or any other suitable devices that allow a climber to: watch video from another climber on another climbing wall; watch a training video; receive instructions on how to climb; interact with other climbers and/or coaches in real-time (or near real-time); watch the climber climb from the view of one or more cameras 120; watch TV (or any video material); watch nature scenes; program the wall (e.g., movements of the supports 30 and/or the climbing surface 15) via a touchscreen, computer processor 500 (e.g., as discussed below) and/or in any other suitable manner; speak to and/or otherwise communicate with another climber (or person) in a different location; hear music, nature sounds, talking, and/or any other sounds; see holds that have been used and/or that are being used by another climber on another all; and/or for any other purpose. Indeed, in some embodiments, such a display allows a climber to watch, receive feedback from, and/or otherwise communicate with another person (e.g., a trainer) in another location. While such displays can be disposed in any suitable location (as mentioned above), in some embodiments, they are coupled to the climbing surface 15 (e.g., as shown by the display 125 in FIG. 12), one or more legs 90, one or more stands, the floor, and/or in any other location.

As another example of a suitable component, some embodiments of the climbing wall 10 comprise one or more indicators that are configured to: identify different holds 200 the climber should, could, and/or has used; different routes or circuits a climber could follow; holds that have been used a climber in another location (e.g., a climber on another wall); the complexity of different routes or hold; a starting hold; an ending hold; a hold that is to be used by a user's hand; a hold that is to be used by a user's foot; and/or to otherwise perform any other suitable function. By way of non-limiting illustration, FIG. 1C shows an embodiment in which a climbing route is set by several illuminated holds 201. In some embodiments, the climbing path is configured to follow an animated route (e.g., by having the climber follow a pattern of specific movements that are designated by a series of illuminated holds 201 in order). Additionally, in some embodiments, the climbing surface 15 is configured to change its angle during an animated session (e.g., while the climber is on the climbing wall). In any case, the indicators can comprise any suitable component that is capable of performing such a function.

In some embodiments, the route (or climbing path) shown by the indicators (e.g., illuminated holds 201) changes based upon a climb. Accordingly, in some embodiments, once a climb of a route shown by the indicators is complete, the system provides a different or more challenging route shown by the indicators to allow the climber to move to the next climb/route. Alternatively, if a route is unable to be completed, the route can continue to be shown to allow the climber to master the route, or a different or less challenging route is provided to match the ability of the climber. Accordingly, in some embodiments, the system (e.g., a processor 500) dynamically uses routes identified by components (e.g., lights) and/or any other suitable indicators that enable a climber to improve the climber's climbing ability and skill.

Some non-limiting examples of such components include one or more lights, light sources, LEDs, multicolor LEDs, LCDs, digital displays, speakers, buzzers, haptic vibrators, addressable light sources (e.g., light sources where one or more light sources are independently controllable), and/or any other suitable indicators. Indeed, in some embodiments, the climbing wall 10 has one or more LEDs that are associated with one or more climbing holds 200 and/or possible hold locations on the climbing wall.

In some embodiments, the climbing surface 15 of the wall 10 is transparent, perforated, and/or is otherwise translucent to allow light from a single and/or multiple source LEDs (and/or any other suitable light sources) to backlight one or more of the holds 200. Accordingly, this LED (or other suitable) illumination of holds can be used to create routes and is able to be implemented on large scale climbing walls. Indeed, in some embodiments, one or more light sources, LEDs, multicolor LEDs, LCDs, digital displays, speakers, buzzers, haptic vibrators, and/or any other suitable indicators are disposed in and/or on one or more portions of the climbing wall 10 so as to be closed to (and/or humanly perceptible at) one or more holds 200 on the wall. In some such embodiments, a hold has a fiberoptic component, a lens, diffusers, and/or any other suitable feature that allows the hold to be coupled to the climbing surface 15 and to allow light from the climbing surface to clearly be seen through or from the hold.

In some embodiments, however, one or more of the holds 200 comprise one or more light sources, LEDs, multicolor LEDs, LCDs, digital displays, speakers, haptic vibrators, and/or any other suitable indicators to: identify possible climbing courses, indicate which hold should be used next, indicate which holds have been used, track a climber's path, indicate the holds that another climber is currently using and/or has used, indicate which holds are part of a particular climbing path, indicate the difficulty of a particular hold and/or climbing path, and/or for any other suitable purpose. In some such embodiments, one or more of the holds comprise one or more such light sources (e.g., LEDs, incandescent lights, and/or any other suitable lights sources).

Where a hold 200 comprises a light source (e.g., LED, light bulb, and/or any other suitable light source or light sources), the light source can be disposed at any suitable portion of the hold, including, without limitation, at or around a center of the hold, being offset from a center of the hold, being in a hole that is typically used to bolt the hold to the climbing surface 15, at a perimeter of the hold, at a backside of the hold, within the hold, and/or in any other suitable location. In some cases, however, the light source is disposed in a central hole of the hold (e.g., in a hole that is typically formed in the hold to receive a bolt (or other fastener) to secure the hold to a surface (e.g., the climbing panel 55)). By way of non-limiting illustration, FIGS. 21B-21E show some embodiments in which the hold 200 comprises one or more light sources 205 that are disposed in a hole 210 that extends through the hold (e.g., a central hole).

In some cases in which one or more holds 200 comprise one or more light sources 205, the holds optionally comprise one or more lenses to cover, protect, diffuse light from, and/or otherwise cover the light source(s). In some such cases, the lens is recessed within the hold. In some other cases, however, a portion of the lens and/or the light source itself extends from the hold, is convex, and/or is otherwise configured to be readily visible when a climber is in various locations with respect to the hold (e.g., above, below, to a side of, at an angle to, and/or at any other suitable location with respect to the hold). By way of non-limiting illustration, FIGS. 21B-21E show some embodiments in which the hold 200 comprises a lens 215 (e.g., a convex lens and/or any other suitably shaped lens) that extends outwardly from a portion of the hold 200.

Regardless of where the indicators (e.g., one or more LEDs, light sources, vibrators, and/or other suitable indicators) are located, the indicators can be controlled in any suitable manner. Indeed, in some embodiments, the indicators identify the holds that a climber has used. In such embodiments, the indicators can identify the holds in any suitable manner, including, without limitation, by turning on, increasing in intensity, changing color, and/or otherwise providing an indication related to one or more holds once a sensor (as discussed below) indicates that a climber has touched or otherwise used (or not used) on a hold.

In some other embodiments, the indicators (e.g., LEDs) are controlled by one or more processors 500 (e.g., in a user interface, in a smartphone, or elsewhere) and/or programs that show the climber a proposed route before, during, and/or after a climber climbs the wall 10. In some embodiments, climbing and/or route circuits can be created with the program. Indeed, although in some embodiments, all of the indicators of a route are lit before and/or while a climber is on the wall, in some other embodiments, an indicator relating to a specific hold lights up, flashes, and/or otherwise identifies the next hold, once the climber has used a prior hold.

In some embodiments, a person in a remote location is able to control the indicators on the wall 10, movement of the climbing surface 15, and/or any other suitable feature of the wall (e.g., via one or more processors 500 (as discussed below)). In this regard, the person in the remote location can control the indicators (and/or any other suitable feature) in any suitable way (e.g., by selecting specific indicators or routes on a touchscreen, by selecting routes and/or specific indicators with a phone, keypad, touchscreen, and/or any other suitable input device; by selecting one or more programs to be run on the wall (e.g., via one or more processing units 500); and/or in any other suitable manner). Indeed, in some embodiments, as a first person in a first location climbs a first embodiment of the wall, one or more sensors (e.g., touch sensors, pressure sensors, sensors indicating a direction of force applied to a hold, force sensors, photo sensors, and/or any other suitable type of sensors) on the first embodiment of the wall cause one or more indicators on a second embodiment of the wall to light up, flash, change color, and/or to otherwise provide an indication to identify corresponding holds on the second embodiment of the wall. Accordingly, some embodiments of the described wall allow users to compete against each other, to train each other, and/or to otherwise interact with each other.

In some embodiments, each indicator (and/or any other suitable feature) is individually and/or collectively controlled by a switch associated with an indicator (e.g., a switch that turns on and off a light in the hold 200). By way of non-limiting illustration, FIG. 21D shows an embodiment in which the light source 205 of the hold 200 is controlled by a switch 235 on the hold 200.

In some embodiments, one switch controls multiple indicators (e.g., a switch is used to selectively turn on and off multiple lights indicating a climbing path). In some other embodiments, one or more indicators are configured to be controlled by one or more processors 500 (e.g., such as those discussed below with reference to the representative operating environment). Additionally, in some embodiments, one or more indicators are controlled by a processor, one or more programs, one or more sensors that provide feedback regarding user interaction with the wall, one or more devices in a remote location, and/or in any other suitable manner.

Where the indicators (e.g., light sources, haptic vibrators, etc.) are controlled by a processor 500 and/or any other suitable controller, such indicators can be in signal communication with the processor and/or other controller in any suitable manner. Indeed, in some embodiments, the indicators are in wired communication with one or more processors and/or controllers. In some other embodiments, however, one or more indicators are configured to be in signal communication with one or more processors and/or controllers via a wireless communication (e.g., via one or more internet connections, modems, BLUETOOTH™ communication systems, WiFi connections, cellular connections, wireless links, and/or other adapters for connection to a local and/or wide area network ("WAN")). Indeed, in some embodiments, one or more holds having one or more indicators are configured to communicate with a processor via BLUETOOTH' communication. By way of non-limiting illustration, FIG. 21D shows an embodiment in which the hold 200 comprises a BLUETOOTH' communications link 225. In some other embodiments, as a sensor is triggered, information from that sensor is conveyed to a smartphone, to a user in another location, to a server, to a user interface, and/or to any other suitable location.

Where the climbing wall 10 and/or one or more holds 200 comprise one or more indicators (e.g., LEDs, light sources, and/or other indicators), the indicators can be powered in any suitable manner. Indeed, in some embodiments, each indicator is powered by the same power source (e.g., the mains, one or more common batteries, a power supply, and/or any other common power source). Indeed, in some embodiments, when a hold comprising an LED is coupled to the climbing wall 10, the hold (e.g., the light source and/or other indicator of the hold) is coupled to a power source via one or more plugs, wires, connectors, electrical couplers, electrical contacts, and/or in any other suitable manner.

In some other embodiments, however, one or more holds 200 each comprise their own power source (e.g., one or more batteries, solar cells, and/or any other suitable power source). By way of non-limiting illustration, FIG. 21D shows an embodiment in which the hold 200 comprises a battery 230 that is in electrical communication with the light source 205.

Additionally, in some embodiments, the one or more climbing holds 200 is associated with a haptic vibrator (e.g., to indicate that climber has used a hold for too long, to indicate that a climber is not using the right hold, to indicate that another climber has or has not used that hold (e.g., a climber on a second climbing wall in signal communication with a first climbing wall), and/or for any other suitable purpose).

Moreover, in some embodiments, the sizing of the holds 200 is carefully optimized for a wide range of climbers. Moreover, in some embodiments, one or more portions of the climbing holds (or flow holds) are symmetrical and/or are otherwise shaped for uses as a natural "pull-down" holds, like a ladder rung. In some embodiments, one or more of the holds are also configured to be flipped (or rotated) to make the hold an "under-cling" hold, where the fingers are pointing up when grabbing the hold (e.g., to work the biceps and provide body tension in a specific way). In some cases, the exact shapes of the holds and their locations on the climbing surface are specific to the flow concept of movement awareness, with coordination and asana-like "flow" for climbers of all skill levels. In this regard, having holds that a climber can grab from the top and the bottom is believed to be unique. Additionally, some implementations of the flow holds have radii that are configured to be ergonomic for fingers at every angle from −10 degrees slab to 70 degrees overhanging. In this regard, FIGS. 21F-21I show some embodiments of a hold 200 that is symmetrical about a medial axis MA, that can function as a pull-down hold (e.g., as shown in FIG. 21G), and that can also be rotated to function as an under-cling hold (e.g., as shown in FIG. 21H).

As another example of a suitable component, some embodiments of the climbing wall 10 comprise (or are otherwise associated with) a projector that projects images (e.g., images of natural rock, potential climbing routes, and/or any other suitable image) onto the climbing surface 15. In still other embodiments, the climbing surface and/or the climbing panels 55 comprise one or more displays (e.g., TVs, monitors, screens being projected on by one or more projectors located behind a translucent climbing surface, and/or any other suitable type of display) to allow the climbing surface: to visually resemble a natural and/or artificial formation, to watch another climber on another climbing wall climb, to display possible paths, and/or to show any other suitable image. Indeed, in some embodiments, the climbing wall comprises one or more displays behind a transparent material (e.g., plastic, glass, etc.) comprising climbing holds.

As yet another example of a suitable component, some embodiments of the climbing wall 10 comprise one or more sensors that are configured to determine which holds 200 a user has used, how much weight a user has placed on a hold, how long a user used a hold 200, how wet a hold is, when to turn on an indicator, a direction of a user's weight on a hold, to obtain any other suitable information regarding the climbing wall and/or one or more climbers' climbs, and/or to otherwise observe and/or control one or more aspects of the wall. In this regard, the climbing wall (and/or hold) can comprise any suitable type of sensor, including, without limitation, one or more touch sensors, weight sensors, piezoelectric sensors, temperature sensors, IR sensors, proximity sensors, ultrasonic sensors, pressure sensors, wire resistive sensors, surface capacitive sensors, projected capacitive sensors, surface acoustic wave sensors, and/or any other suitable sensors.

While the sensors can be disposed in any suitable location (e.g., at any suitable portion of the climbing wall 10), in some embodiments, the sensors are associated with one or more holds 200. By way of non-limiting illustration, FIG. 21D shows an embodiment in the hold 200 comprises one or more sensors 240.

In accordance with some embodiments in which one or more holds 200 comprise one or more sensors 240, the climbing wall 10 is configured to track which holds a climber has used, to track a climber's progress, to light up LEDs (or change a color of, change an intensity of, and/or to otherwise control one or more indicators) on another climbing wall (e.g., for competition purposes, for gaming purposes, for training purposes, and/or any other suitable purpose), to determine an amount of weight a user puts on the hold, to determine how long a user was in contact with the hold, and/or for any other suitable purpose. Indeed, in some embodiments, the sensors readings are recorded (e.g., via a processor and/or memory associated with the climbing wall and/or hold) to track routes, to determine progress, to provide adaptive and/or personalized training, etc. Additionally, in some embodiments, sensor readings are transmitted (e.g., via a network interface, as discussed below) to a different location (e.g., to a server and/or a processor of a separate climbing wall) to allow a second climber to track the movements of a first climber and/or vice versa.

In some embodiments, one or more climbing holds on the wall 10 are configured to rotate, extend from the climbing surface, retract to the climbing surface, and/or to otherwise be modified (e.g., automatically and/or manually) to change a difficulty of the wall, to keep a climber from using a hold 200, to force a climber to solve problems, and/or for any other suitable purpose. Indeed, in some embodiments, one or more holds on the climbing wall are associated with one or more processing units 500, actuators, and/or other mechanisms and/or systems that are configured to selective rotate or otherwise modify such holds (e.g., based on a program, based on sensor readings, based on timer control, and/or in any other suitable manner).

In some embodiments, the climbing wall 10 comprises a treadmill climbing surface that allows the climbing surface 15 to rotate in a loop (or other suitable shape) as a climber moves from hold 200 to hold. In this regard, the climbing wall can comprise any suitable component that allows it to function, including, without limitation, any other component disclosed herein, one or more: brakes, motors, speed controls, rotors, tracks, guides, speed and/or movement sensors, and/or any other suitable component.

As another example of a suitable component, some embodiments of the climbing wall 10 comprise one or more training programs that are configured to: help a climber learn new routes, help a climber learn new techniques, train a climber, modify an angle of the climbing surface 15 during a climb and/or between climbs, modify a functioning of the wall, and/or to perform any other suitable function. In some embodiments, such a program is run on computer or other processor (e.g., as discussed below) that is associated with the climbing wall. Moreover, in some embodiments, the program is configured to receive information on the climber (e.g., from wearable sensors, such as heart sensors and/or location sensors; from sensors in shoes; from sensors associated with holds on the climbing wall; from a camera associated with the wall; from a touchscreen, keyboard, remote control, voice command, and/or from any other suitable source). In some such embodiments, the program is configured to adapt to the needs and/or desires of the climber, a trainer, and/or to otherwise adapt. Indeed, in some embodiments, the program is configured to: automatically change an angle of the climbing surface 15 (e.g., on the fly, as part of a preset program, and/or otherwise); rotate or otherwise move one or more holds; to increase, decrease, and/or stop rotation of the climbing surface where the climbing surface comprises a treadmill wall; activate different indicators (e.g., LEDs) based on specific needs, performance, program parameters, and/or any other suitable factor; and/or to otherwise vary the wall.

Although in some embodiments, the climbing wall 10 comprises a single climbing surface 15, in some other embodiments, the wall comprises multiple climbing surfaces. In some such embodiments, each of the climbing surfaces is configured to be moved together. In some other embodiments, however, the various climbing surfaces are configured to be moved to various positions (or angles) independent of one or more other climbing surfaces. In this manner, the wall can be used to vary the intensity of climbing routes and/or to otherwise vary the climbing wall.

Where the climbing wall 10 comprises more than one climbing surface 15, the climbing wall can have any suitable component or characteristic that allows it to function as intended. Indeed, in some embodiments, the wall comprises one or more pinch sensors, movement sensors, electric eyes, and/or any other suitable sensors that can be used to ensure that a portion of a climber's body, clothing, gear, etc. is not pinched or scissored between the edges of two adjacent climbing surfaces and/or between any other components, in any embodiment of the wall. In some embodiments, one or more climbing surfaces and/or other components of the wall comprise a skirt and/or any other suitable protector that extends backwards and at an edge from the climbing surfaces, around linkages, over actuators, and/or any other suitable portion of the wall (e.g., again, to ensure that a portion of a climber's body, clothing, gear, etc. is not pinched or scissored between portions of the wall).

Although in some embodiments (e.g., as shown in FIGS. 1A-10 and 12), each of the individual climbing panels 55 are in a fixed or static position with respect to the climbing surface 15, in some other embodiments, one or more panels in the climbing surface are configured to selectively move (e.g., automatically and/or manually via one or more supports 30 and/or other suitable mechanisms) with respect to the climbing surface. In this regard, the individual climbing panels can be configured to move in any suitable manner, including without limitation, by extending out of the climbing surface, moving deeper into the climbing surface, pivoting, and/or otherwise moving. For instance, where a climbing panel comprises at least a portion of a three-dimensional cube, the cube can move out and/or into the climbing surface. Additionally, where a climbing panel comprises a three-dimensional sector shaped object, such a panel can pivot with respect to a portion of the climbing surface to expose a three-dimensional volume.

As still another example of a suitable component, some embodiments of the climbing wall 10 comprise: one or more fans (e.g., to cool the climber, to mimic natural breezes, to dissipate fragrances, and/or for any other suitable purpose); essential oil diffusers, fragrance printers, and/or other smell outputs (e.g., to release certain smells at certain times); misters, drip hoses, hoses, spray nozzles, pumps, and/or other apparatus that are configured to provide moisture and/or other water features to the climbing wall, one or more holds, and/or the climber (e.g., to cool a climber and/or to mimic dew, natural springs, rain, and/or other water hazards that may be encountered when climbing in nature); speakers (e.g., to provide music, nature sounds, and/or any other suitable sound); and/or any other suitable feature that can increase a climber's sensory experience while using a wall. Indeed, in some embodiments, the wall comprises one or more smell out puts that are configured to release one or more smells (e.g., a smell of a sea breeze, pine, moss, sage, and/or any other suitable smell) at a desired time (e.g., when a specific sensor is engaged, when the climber reaches the "summit," as controlled by a program, and/or at any other suitable time). Where the wall comprises any of the foregoing features, such features can be controlled in any suitable manner, including, without limitation, through the use of one or more switches, inputs, programs, user controls, sensors, processors, user interfaces, and/or in any other suitable manner.

In still another example of a suitable component, some embodiments of the wall 10 are used with one or more mats (see e.g., mats 130 in FIGS. 13-19). In this regard, the mats can have any suitable characteristic that allows them to cushion falls and/or to otherwise make use of the wall safer and/or more comfortable. Indeed, the mats can be any suitable size, including, without limitation, having a length and a width between about 0.1 m and about 20 m, or any subrange thereof (e.g., about 3.9 m×about 3.9 m). In some embodiments, the mat is wider than the climbing surface (e.g., by between about 0.1 m and about 3 meters, or within any subrange thereof).

In addition to the described modifications, the climbing wall 10 can be modified in any suitable manner. In one example, the climbing surface 15 is pivotally attached directly to a floor without the base member 20 being disposed between the two.

In another example, the base member 20 and/or base section 70 can have any suitable shape that allows the climbing surface 15 to be supported. By way of non-limiting illustration, FIGS. 16, 17, 19, 20, and 21A show some embodiments in which the base member 20 and/or the base section 70 are coupled to and/or otherwise comprise a framework 135 that is configured to support the climbing surface 15 and/or supports 30. Accordingly, in some such embodiments, the climbing wall 10 comprises a self-supporting unit that does not require the climbing surface to further be anchored to another support object (e.g., a wall).

In still another example of a suitable modification, some embodiments of the climbing surface 15 and/or one or more climbing panels 55 comprise one or more addressable light sources, including, without limitation, one or more single color addressable light strips, RGB addressable light strips, LED addressable light strips, addressable light bulb strips, and/or any other suitable addressable light source. In some embodiments, however, one or more addressable light sources of the climbing wall 10 comprise addressable LED strips (e.g., addressable RGB LED strips) that are configured to selectively and differentially light up, dim, change a color of, turn off, blink, and/or otherwise control separate LEDs in the strip.

While the addressable light source or light strips (e.g., addressable LED strips) can perform any suitable function, in some cases, one or more portions (e.g., LEDs, light bulbs, and/or other light sources of) the addressable light source are configured to be illuminated to identify one or more holds 200. Indeed, in some embodiments, the addressable light sources are configured to: light up (or otherwise identify) one or more holds on a particular climbing path or route, identify a starting hold, identify an ending hold, identify a challenge of a hold (e.g., whether it is an expert or a novice hold), identify a hold that is outside of a set climbing path, identify a hold that was used by another climber (e.g., on that particular climbing all, on a remote, by the climber in the past, and/or otherwise), identify a location of another climber on a particular climbing path (e.g., on another wall in a remote location or otherwise), identify whether a hold is to be used with hands and/or feet, and/or to perform any other suitable purpose.

Where the climbing wall 10 comprises one or more addressable light sources, the addressable light sources can emit any suitable color and/or combination of colors. Indeed, in some embodiments, each addressable light strip or light source comprises a single-color light. In some other embodiments, however, multiple addressable light strips or light sources that each produce a different color are: combined together, twisted together, run next to each other, braided together, stacked on each other, and/or are otherwise disposed in relatively close proximity to each other. In still other embodiments, one or more addressable light strips and/or other addressable light sources are configured to produce multiple colors of light (e.g., having RGB and/or any other suitable types of LEDs that allow the addressable light source to produce multiple colors).

In some embodiments, one or more portions of an addressable light strip and/or other addressable light source that are associated with one or more holds 200 (or potential hold locations, such as holes 60) can be changed or illuminated: as one color (e.g., to green and/or any other suitable color) when a particular hold is functioning as a starting hold in a route, to another color (e.g., to red and/or any other suitable color) when a particular hold is functioning as an ending hold in a route, to another color (e.g., to yellow and/or any other suitable color) when a particular hold is designated as belonging to a desired climbing path or route, to another color (e.g., purple and/or any other suitable color) when a hold is to be used by feet, to another color (e.g., blue and/or any other suitable color) when a hold is to be used by hands, and/or can otherwise have its color and/or luminosity be changed to convey any suitable information (e.g., the presence and/or role of a particular hold in a climb path).

In addition to turning on and/or providing a particular color of light, some embodiments of the addressable light source can perform any other suitable function. Indeed, in some embodiments, one or more portions (e.g., lights or sets of lights) of one or more addressable light sources are configured to be selectively and controllably caused to: increase and/or decrease in intensity, blink, turn on and off at particular times, and/or otherwise modify the light they produce so as to convey any suitable information.

Where the climbing wall 10 comprises one or more addressable light strips or other addressable light sources, such light sources can be disposed in any suitable manner. Indeed, in some embodiments, the addressable light strips are placed on top of a climbing surface 15 of the climbing panel 55. In some embodiments, one or more addressable light sources are disposed behind the climbing surface of the climbing panel (e.g., at a back surface of the climbing panel where the climbing panel (and/or one or more portions of the climbing panel) comprises a translucent material, such as poly(methyl methacrylate), tempered glass, laminated glass, wire mesh glass, plastic, and/or any other suitable translucent material). Additionally, in some embodiments, the climbing surface 15 defines one or more channels, holes, and/or other recesses and one or more addressable light sources are disposed in the recesses. By way of non-limiting illustration, FIGS. 22A-22C each illustrate some embodiments in which the climbing surface 15 of the climbing panel 55 defines a plurality of channels or other recesses 250 that include one or more addressable light sources 255.

Where the climbing surface 15 and/or a climbing panel 55 includes one or recesses 250 with one or more addressable light sources 255 disposed in the recesses, the recesses can be formed in the climbing surface and/or panel in any suitable manner. Indeed, in some cases, the recesses are formed through the use of one or more computer numerical control (CNC) machining tools, routers, saws, molds, presses, stamps, drills, chisels, 3D printing, additive manufacturing, molding, and/or in any other suitable device and/or in any other suitable manner. In some cases, one or more recesses (e.g., for receiving the addressable light sources) are formed in the climbing surface through the use of a CNC machine.

Figure 22A:
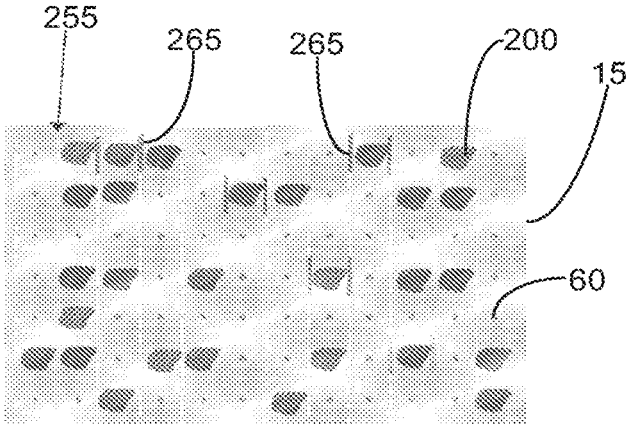
FIGS. 22A-22B each illustrate a front side view showing a different representative embodiment of a climbing surface comprising addressable light strips.
Figure 22B:
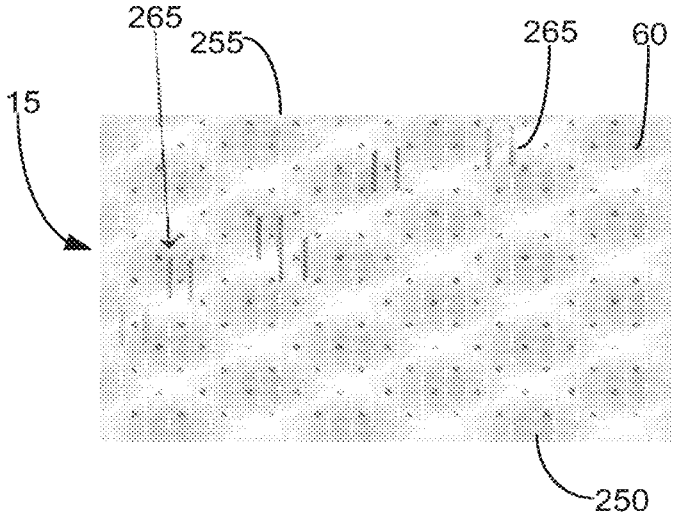
Figure 22C:
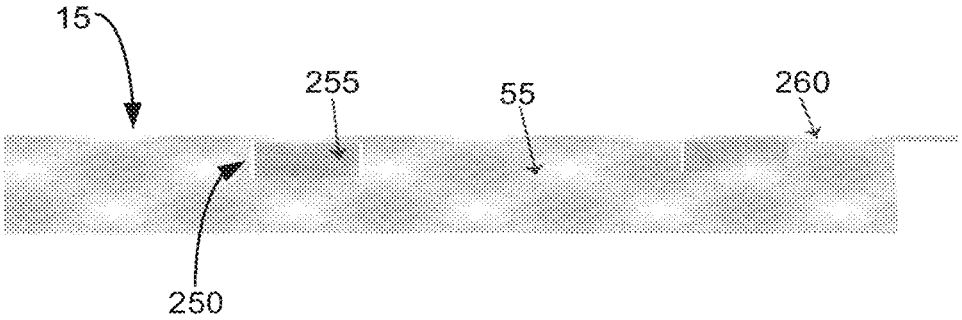
FIG. 22C illustrates a side cutaway view of the climbing surface, wherein the surface includes addressable light strips in accordance with a representative embodiment.

In some embodiments in which one or more addressable light sources 255 are disposed below a climbing surface 15 of the climbing wall 10 (and/or a surface of the climbing wall which is configured to hold one or more climbing holds 200 for climbing), the addressable light sources are left uncovered. In some other embodiments, however, one or more of the addressable light sources are covered with a translucent covering (e.g., to protect the addressable light source and/or to protect the user and others from the addressable light source). In this regard, the addressable light sources can be covered with any suitable translucent covering, including, without limitation, one or more pieces of plastic, glass, polymer, ceramic, natural materials, synthetic materials, and/or any other suitable materials that are at least partially translucent so as to allow the addressable light source to identify one or more particular holds and so as to protect the addressable light source. By way of non-limiting illustration, FIG. 22C shows an embodiment in which a piece of translucent material 260 (e.g., plastic) is disposed over the recesses 250. In this regard, while the translucent material can be disposed in any suitable location, including, without limitation, being inlaid into one or more recesses, extending out from one or more recesses, extending over and across one or more recesses, and/or in any other suitable location. For instance, FIG. 22C shows an embodiment in which a translucent material 260 extends across the climbing surface 15 and over the recesses 250 and addressable light source 255.

Where the climbing wall 10 has one or more addressable light sources 255, the addressable light sources can be disposed in any suitable pattern on and/or in the climbing wall. Indeed, in some embodiments, one or more addressable light strips are arranged vertically along a length of the climbing panel. For instance, some implementations of the panel comprise 1, 2, 3, 4, 5, 6, 7, 8, 9, 10, or more light strips run vertically in the climbing panel and are spaced apart from each other so as to fit one or more holds between them. In this regard, FIGS. 22A-22B show some embodiments, in which multiple addressable light strips or other addressable light sources 255 extend vertically down the climbing panels 55 with the holds 200 and/or holes 60 disposed between the light sources. Moreover, FIGS. 22A-22B show that, in some such embodiments, a group 265 of addressable lights (e.g., LEDs) is lit, has its color changed, blinks, and/or is otherwise is modified from other lights in the strips, on 1, 2, 3, 4, or more sides of the holds 200 or holes 60 in a climbing path.

Figure 23A:
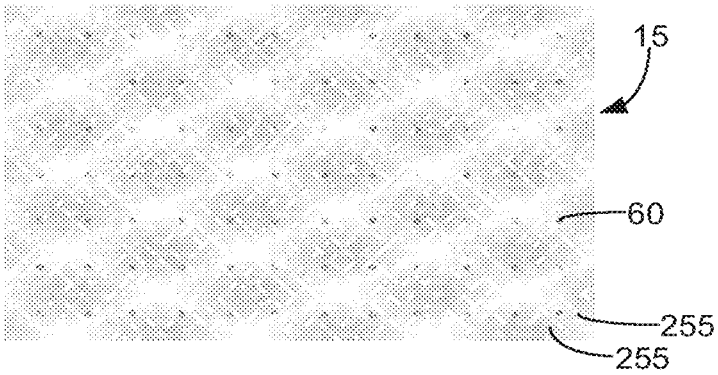
FIG. 23A illustrates a front side view showing the climbing surface having addressable light strips in an argyle configuration comprising in accordance with a representative embodiment.
Figure 23B:
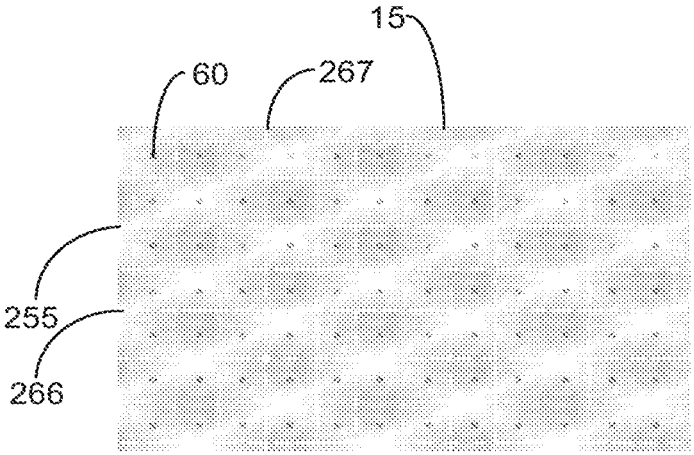
FIG. 23B illustrates a front side view showing the climbing surface having addressable light strips in an intersecting vertical and horizontal configuration in accordance with a representative embodiment.

In some other embodiments, one or more addressable light sources 255 (e.g., addressable light strips) run horizontally in the climbing surface 15 and/or climbing panel 55 and are spaced apart from each other so as to fit one or more holds 200 between them. By way of non-limiting illustration, FIG. 23B shows an embodiment in which the climbing panel 55 comprises multiple horizontal addressable light sources 266 along with multiple vertical addressable light sources 267. Thus, in some embodiments, the climbing wall 10 is configured to light up LED's and/or any other suitable addressable lights on 1, 2, 3, or 4 sides adjacent to one or more holds 200 or holes 60.

Figure 23C:
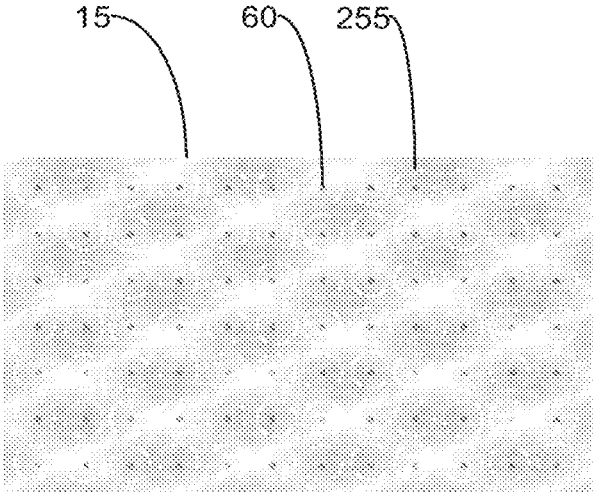
FIG. 23C illustrates a front side view showing the climbing surface having addressable light strips in circular configurations in accordance with a representative embodiment.

Moreover, in some embodiments, one or more addressable light sources 255 are otherwise disposed in proximity to one or more holds 200 and/or holes 60. Indeed, in some embodiments, one or more addressable light strips border, are otherwise disposed at one or more edges of, circle, extend around, are disposed near, and/or are otherwise configured to identify one or more holds (and/or holes). By way of non-limiting illustration, FIG. 23C shows a representative embodiment in which the addressable light sources 255 are disposed in circular patterns around multiple holes 60 in the climbing panel 55.

In still other embodiments, one or more addressable light sources 255 are disposed diagonally (e.g., diagonally in one direction, diagonally in two patterns that cross-hatch each other, diagonally in an argyle configuration, and/or in any other suitable diagonal pattern) so as to allow one or more portions of the addressable light sources to be lit up to identify one or more holds (or potential hold locations). By way of non-limiting illustration, FIG. 23A shows an embodiment in which the addressable light sources 255 run in a diagonal cross-hatched configuration.

Figure 24A:
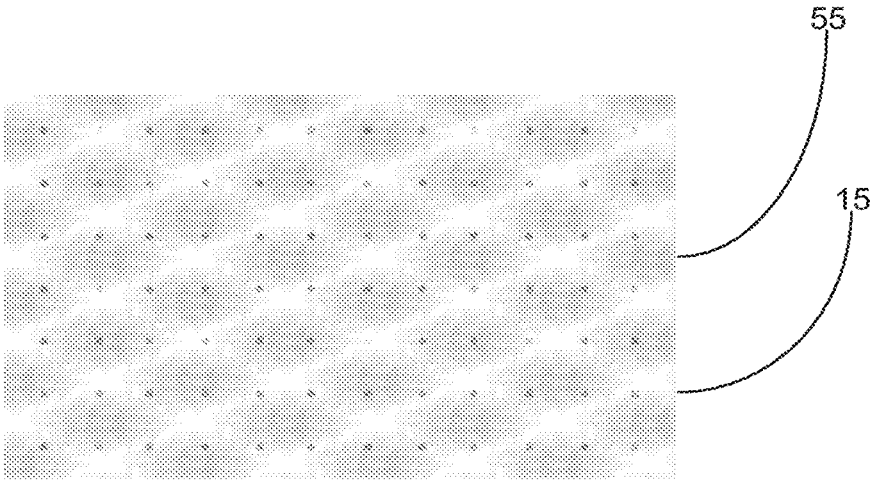
FIG. 24A illustrates a front side view showing a climbing panel in accordance with a representative embodiment.
Figure 24B:
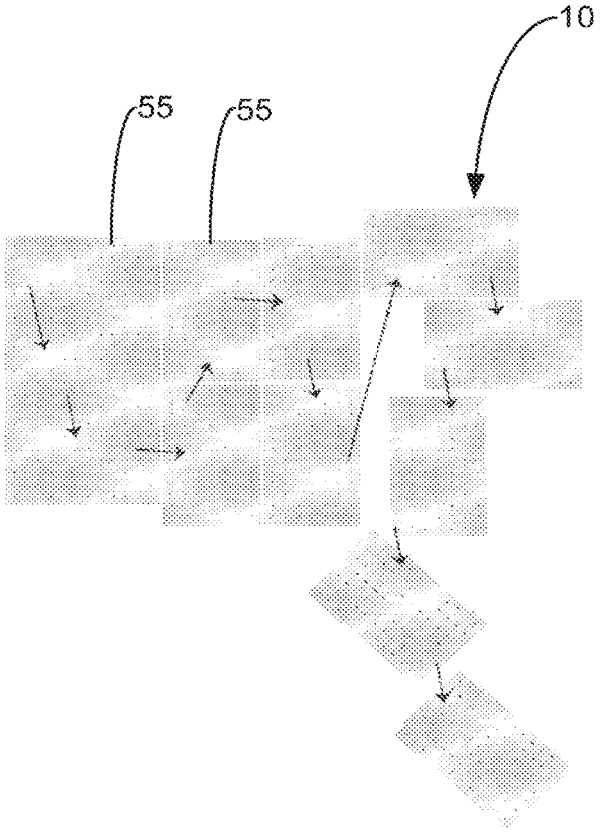
FIG. 24B illustrates a front side view showing possible connections between climbing panels in accordance with a representative embodiment.
Figure 25:
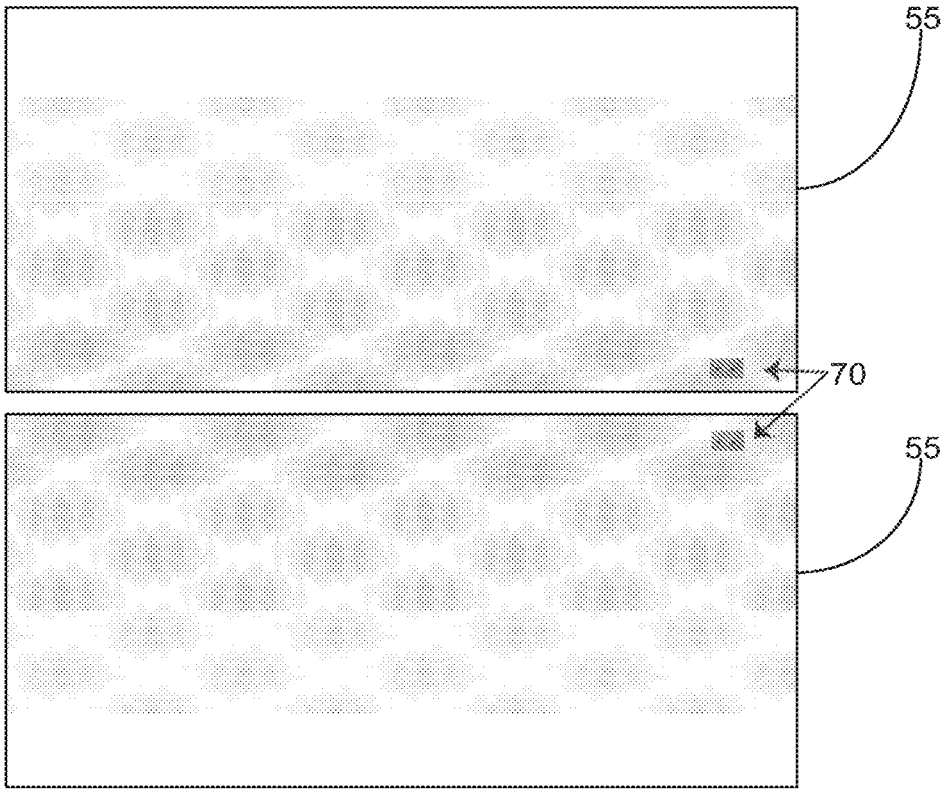
FIG. 25 illustrates a back, side view showing two climbing panels with flush mounted connection interfaces in accordance with a representative embodiment.

Additionally, in some embodiments, one or more addressable light sources 255 extend across and/or near one or more borders of the climbing surface 15 and/or one or more climbing panels 55 (e.g., a top side, a bottom side, a right side, a left side, and/or any other suitable portion of the climbing surface) and are configured to light up specific lights (or portions of the addressable light source) so that a climber can identify one or more particular holds or hold spots (e.g., by identifying a hold that corresponds to an intersection point of addressable light sources that light up on both a horizontal (or X) axis and a vertical (or Y) axis of the climbing panel). Accordingly, in some embodiments, the climbing wall 10 can identify each of its holds through the use of as few as 2, 3, or 4 addressable light strips.

Where the climbing wall 10 comprises one or more climbing surfaces 15 and/or climbing panels 55, the addressable light sources 255 on the panels can electrically couple with each other, to a control unit, and/or to the processor 500 in any suitable manner, including, without limitation, wirelessly (e.g., via WiFi, Bluetooth, radio signals, short range communications, and/or in any other suitable manner) and/or via one or more wired connections. Indeed, in some cases, one or more portions of the various panels (e.g., a back surface, a side surface, and/or any other suitable portion of the panels) comprises one or more electrical connection interfaces (e.g., one or more plugs, sockets, leads, clips, electrical contacts, and/or any other suitable electrical connectors). By way of non-limiting example, FIGS. 24A-25 show some embodiments in which one or more panels 55 (and/or climbing surfaces) can be added to and/or be removed from the climbing wall 10 (e.g., in a plug-and-play manner and/or any other suitable manner). Additionally, FIG. 25 shows an embodiment in which each of the panels 55 comprises one or more flush mounted electrical couplers 70 on their back side (and/or in any other suitable location) to allow for electrical connection without such connection being damaged as the climber climbs the wall.

In some cases, in place of and/or in addition to the addressable light sources 255, the wall 10 comprises wiring for addressable light sources and the holds 200 themselves comprise a light source (e.g., one or more LEDs, light bulbs, etc.) and one or more electrical contacts (e.g., to electrically contact with the wiring for the addressable light source in the climbing wall). In this regard, in some cases, when the hold is bolted (or otherwise coupled) to the climbing wall, contacts from the hold are forced into contact with the electrical contacts of the wiring for the addressable light sources.

Figure 21E:
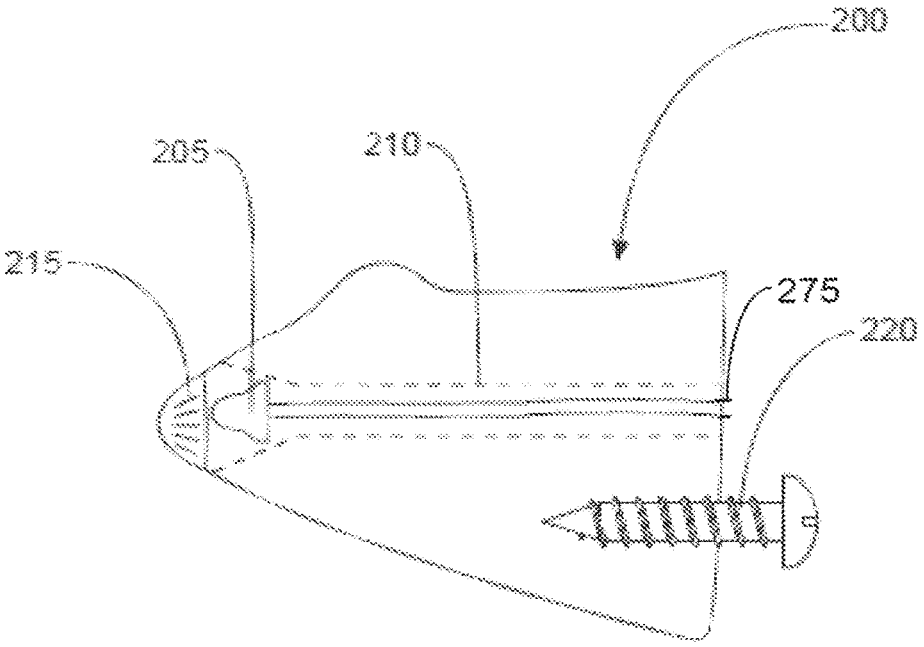
FIG. 21E illustrates a side, schematic view showing the climbing hold comprising the light source in accordance with a representative embodiment.
Figure 21F:
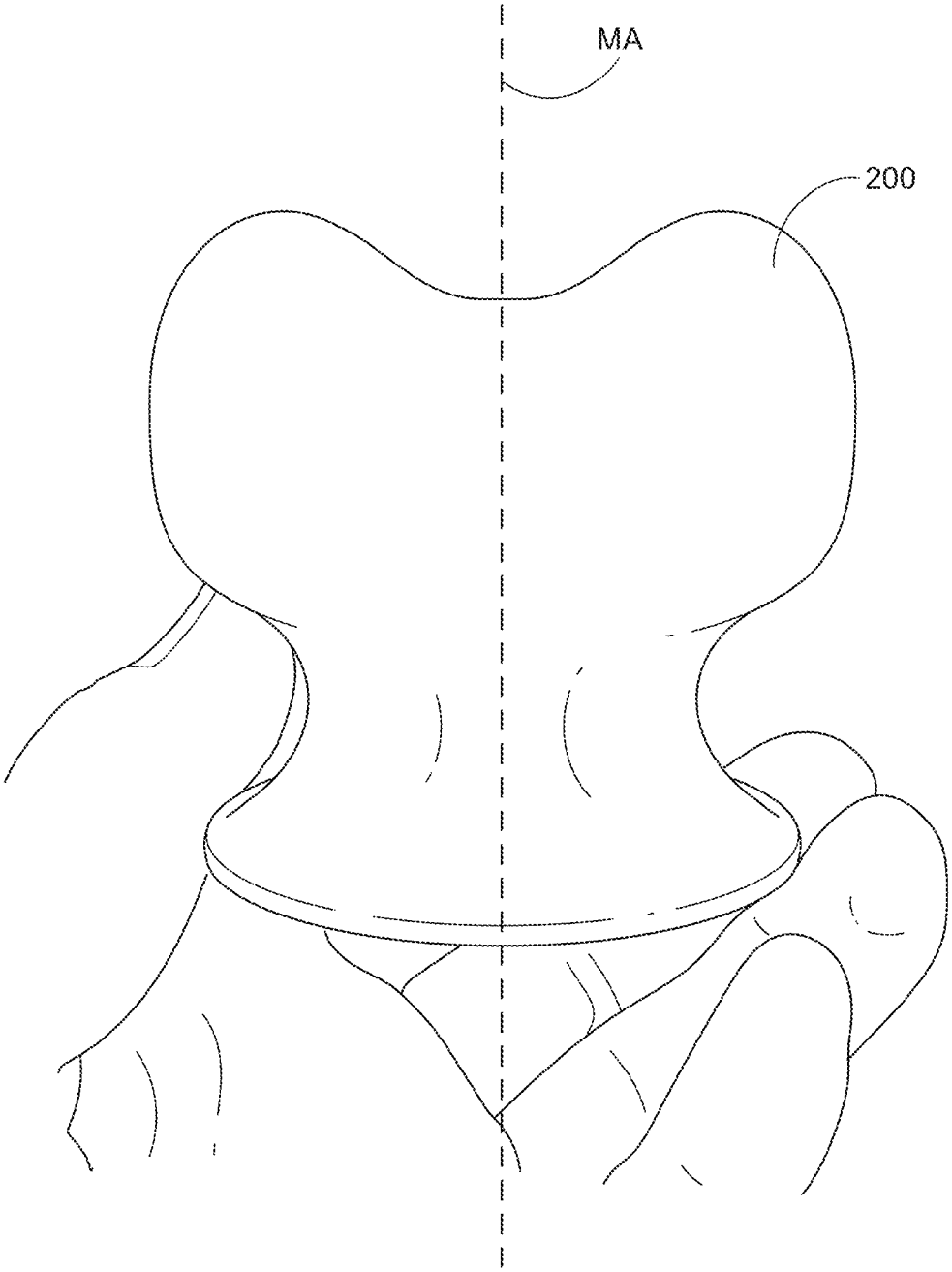
FIGS. 21F-21I illustrate a variety of views of a climbing hold in accordance with some embodiments.
Figure 21G:
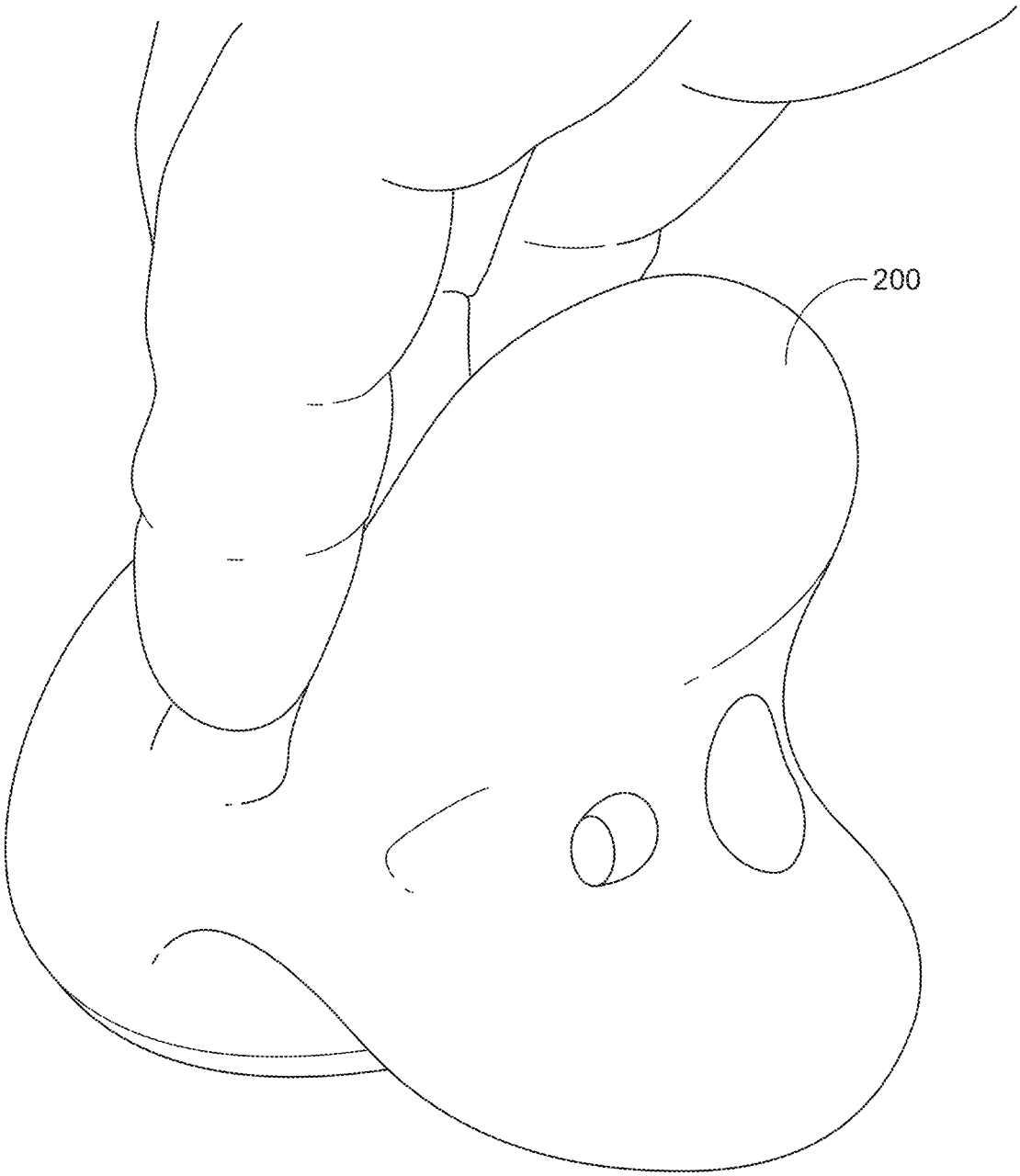
Figure 21H:
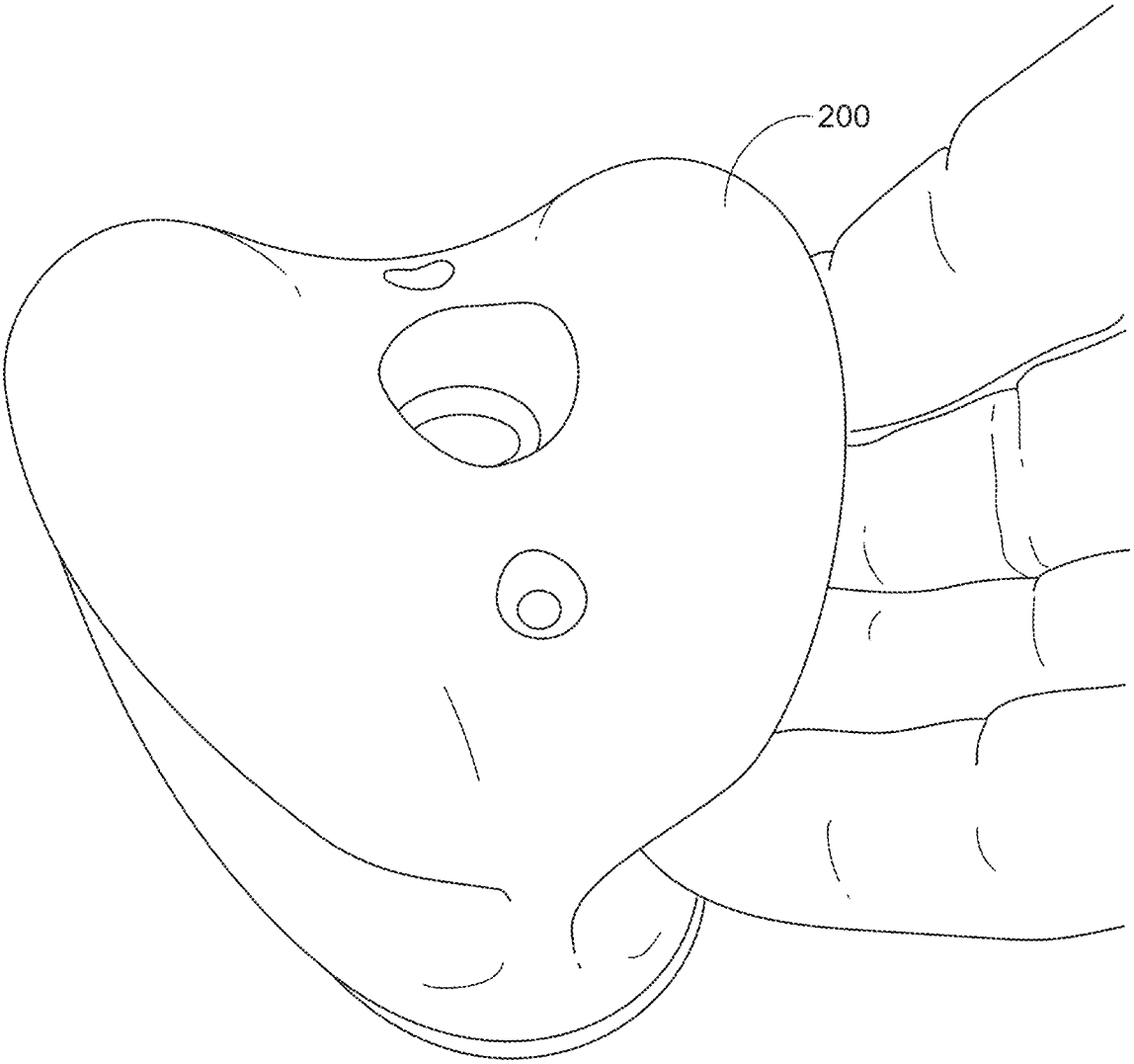
Figure 21I:
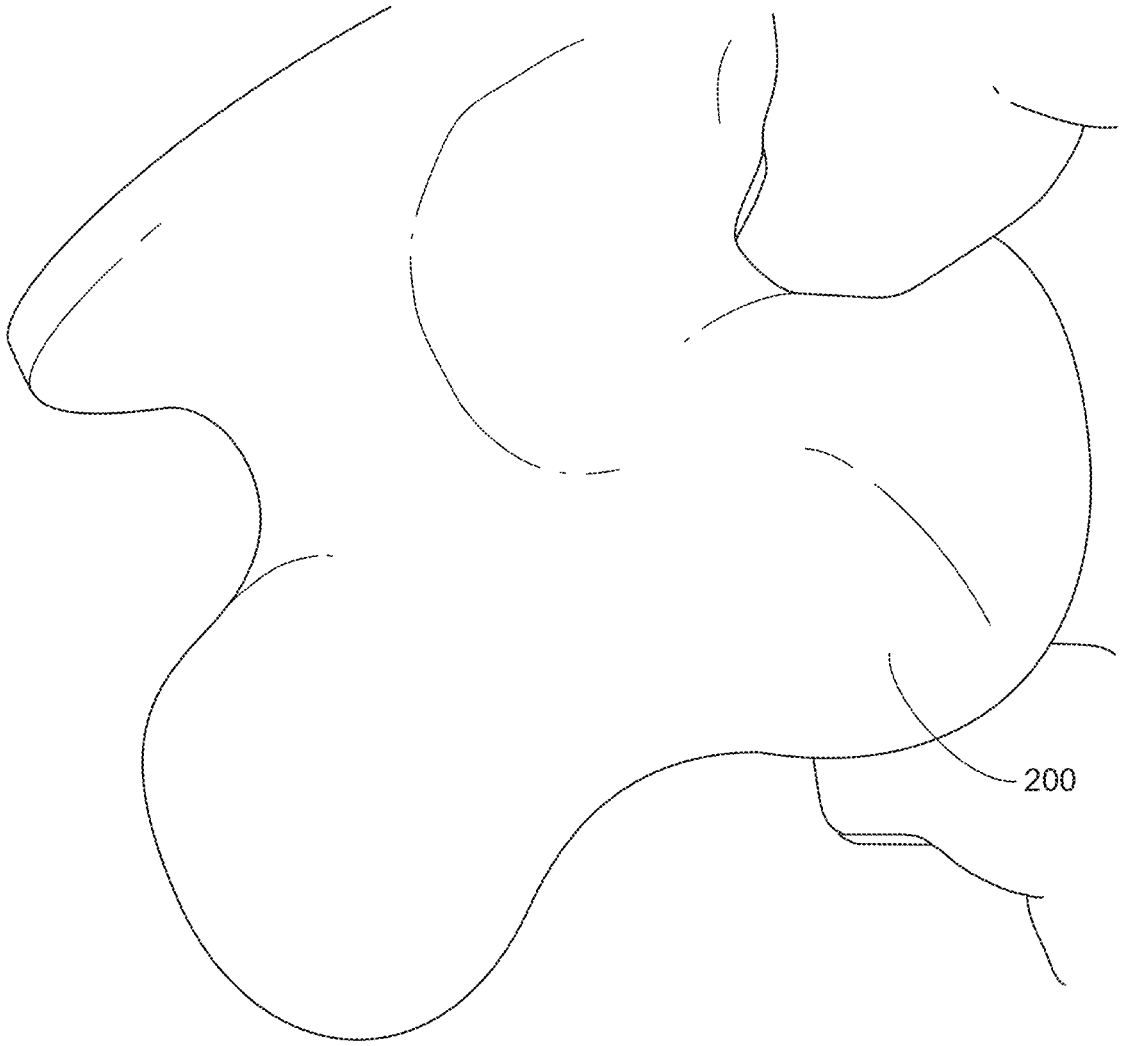
Figure 23D:
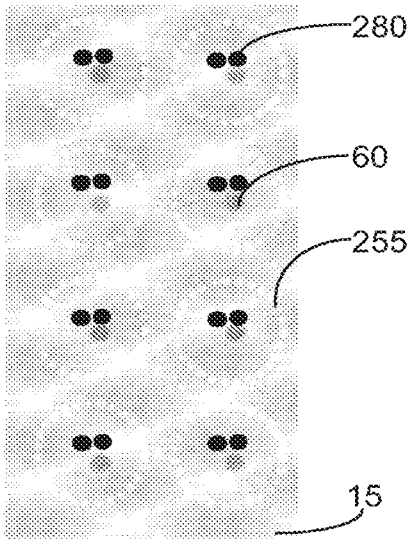
FIG. 23D illustrates a front side view showing the climbing panel having addressable electrical contacts for lights in holds.

By way of non-limiting illustration, FIG. 21E shows that, in some embodiments, a hold 200 comprises one or more electrical contacts 275 that are exposed from a rear surface of the hold 200. Additionally, FIG. 23D shows that, in some embodiments, the climbing panel 55 comprises one or more electrical contacts 280 that are in electrical communication with one or more addressable wiring systems. Thus, in some embodiments, a climber may couple one or more holds to the climbing wall and then the system (e.g., the user via one or more switches or controls, and/or a processing unit) can selectively light up that hold and/or any other hold on a desired climbing route.

Figure 26:
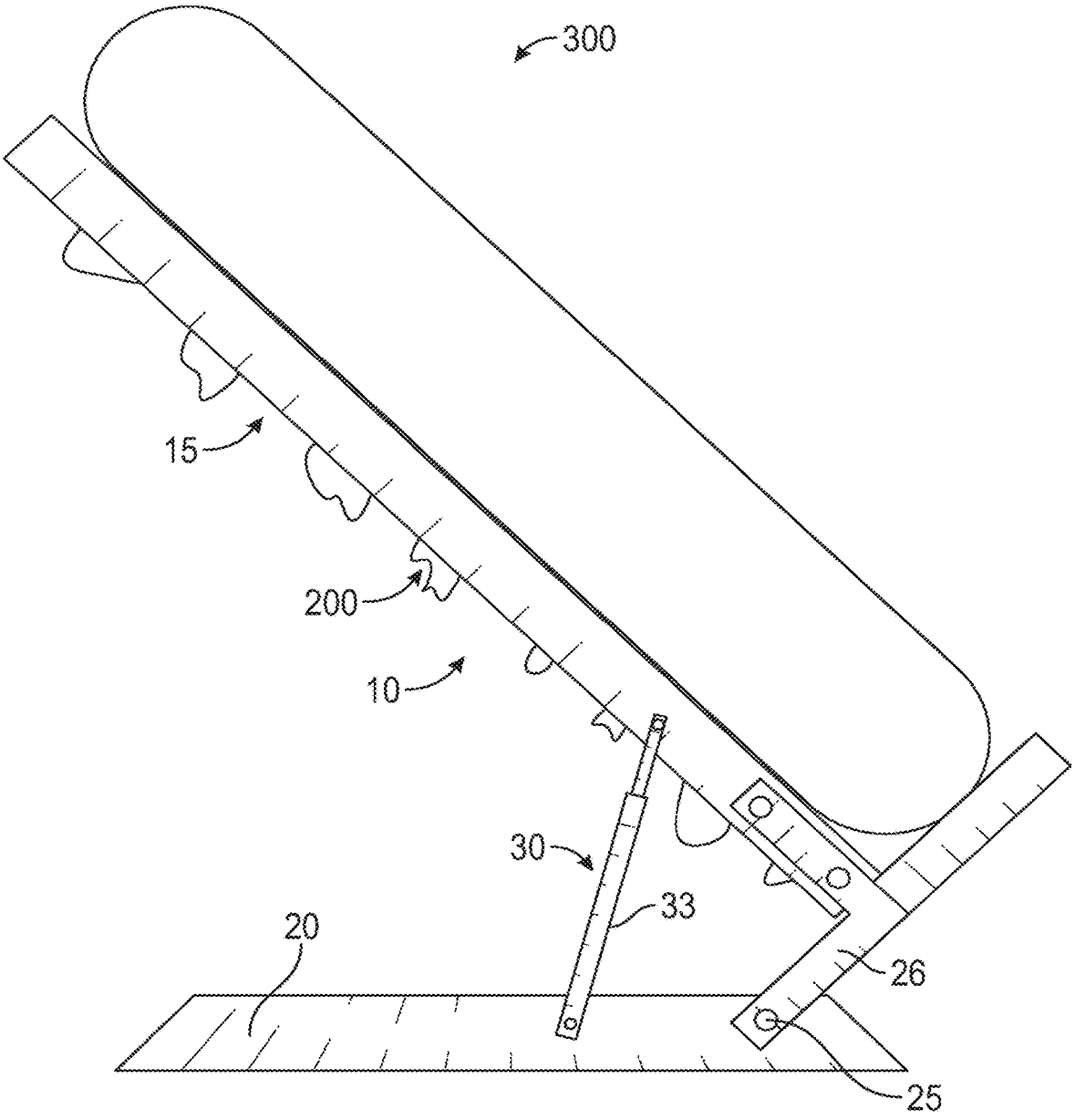
FIG. 26 illustrates a side view of the adjustable climbing wall in accordance with a representative embodiment.
Figure 27:
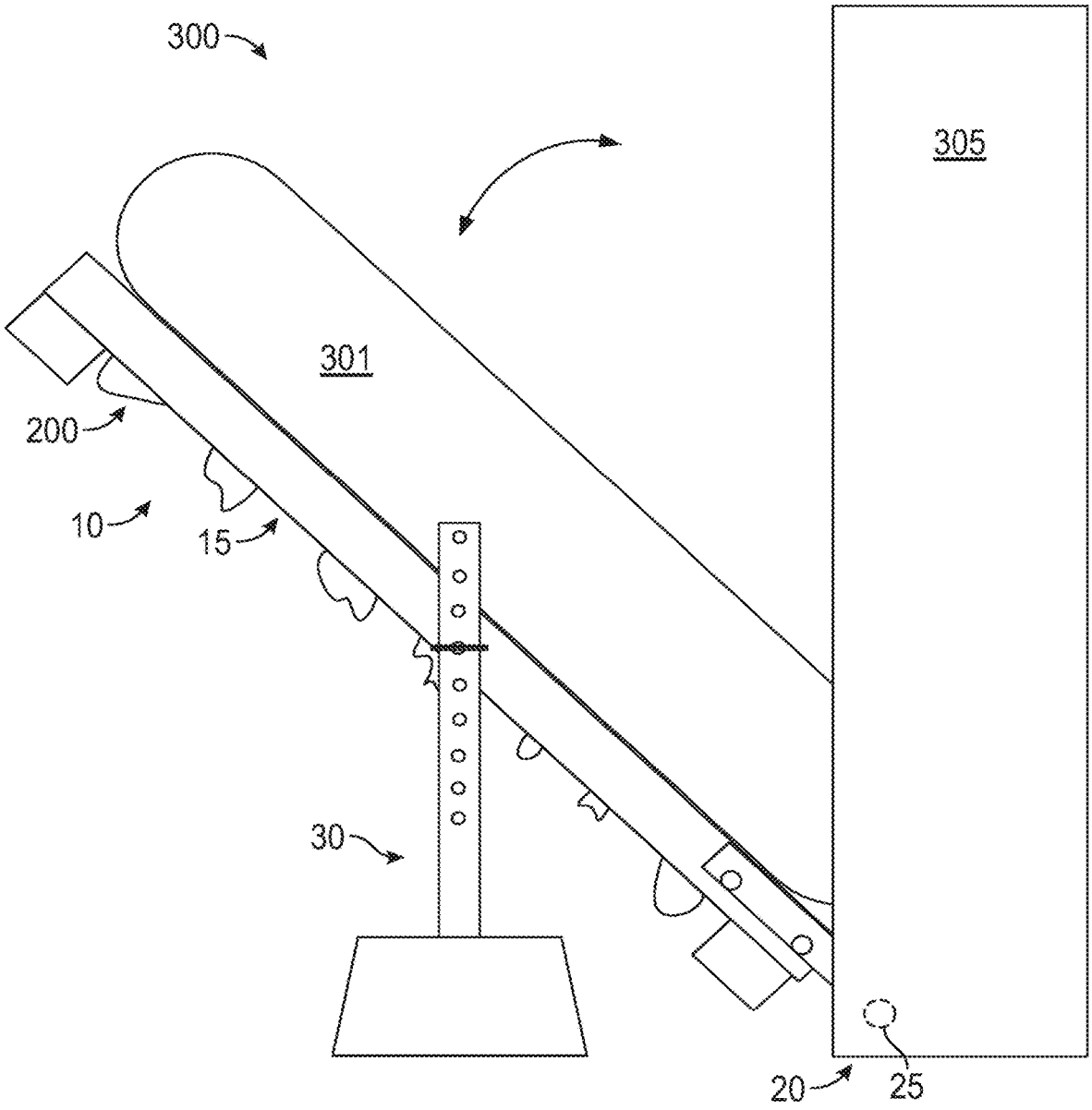
FIG. 27 illustrates a side view of the adjustable climbing wall comprising a Murphey bed in accordance with a representative embodiment.

As another example of a suitable modification of the climbing wall 10, in some embodiments, the climbing wall is configured to serve as a climbing wall when it is a suitable angle for climbing and to then be leaned forward such that the climbing wall functions as a bed, a desk, a floor, a shelf, and/or any other suitable object. Indeed, FIGS. 26 and 27 show some embodiments in which the climbing wall 10 comprises a Murphy bed 300. In such embodiments, the climbing wall can include any suitable component that allows it to function as a climbing wall and as a bed, including, without limitation, any component discussed with respect to any other embodiment disclosed herein. By way of non-limiting illustration, FIGS. 26-27 shows representative embodiments in which the climbing wall 10 comprises one or more mattresses 301 and/or cushions. Additionally, FIG. 27 shows an embodiment in which the climbing wall 10 comprises a cupboard and/or any other suitable shroud 305 that is configured to receive the mattress 301.

As another example of a suitable modification, some embodiments of the climbing wall 10 are configured to fit within a van, toy-hauler, trailer, truck, motorhome, and/or any other suitable vehicle. In this regard, such embodiments of the climbing wall can couple to the vehicle in any suitable manner, including, without limitation, by being set in the vehicle, being bolted to the vehicle, and/or being coupled to the vehicle in any other suitable manner. Indeed, in some embodiments the base members 20 are coupled to and/or comprise one or more industrial strength drawer slides, guides, rails, and/or other linear rails. In some such embodiments, when the climbing wall is in the van, the climbing surface is disposed in a position so as to make it substantially parallel with a floor of the van, such that a backside of the climbing surface is configured to function as a floor of the van and/or as a support for a mattress. In some such embodiments, one or more doors of the vehicle can be opened, and the climbing wall can be slid out of the van on, and be supported by, one or more linear rails. In some cases, when the climbing surface is out of the van, the position of the climbing surface on the rail is selectively locked and the climbing surface can be moved to any desired angle. In some such cases, after use, the climbing surface can be slid back into the vehicle and once again serve as a floor of the vehicle. In any case, such a climbing wall can comprise any suitable component and can have any suitable configuration, including, without limitation, any of the components and/or configurations discussed herein. In still other embodiments in which the climbing wall is coupled to a vehicle, the climbing wall comprises one more: feet that allow a portion of the weight of the wall to rest on the floor (e.g., ground), lower parts of the wall that fold down and/or otherwise extend from the wall towards the floor (e.g., to extend and/or support the climbing surface 15), jacks to stabilize the vehicle and/or the climbing surface, holds 200 on a lower part of the wall, reflectors, lights, mechanisms to selectively lock the wall within the vehicle and/or in a position outside of the vehicle, and/or any other suitable component.

The described climbing wall 10 can comprise any suitable materials that allow it to function as intended. Indeed, in some embodiments, the frame 35 comprises one or more metals (e.g., pieces of aluminum, steel, iron, magnesium, metal alloy, and/or any other suitable type of metal), plastics, fiberglass, wood, ceramic materials, natural materials, synthetic materials, and/or any other suitable materials. Indeed, in some embodiments, the frame comprises aluminum.

With respect to the climbing panels 55, the panels can comprise any suitable material, including, without limitation, one or more types of wood (i.e., plywood, oriented strand board (OSB), particle board, medium density fiberboard (MDF), fiberboard, and/or other suitable type of wood), plastic (e.g., polyethylene, high density polyethylene plastic, polypropylene, polyvinyl chloride, PVC sheet board, recycled plastic plywood (e.g., EKOPLY™ materials), metal, and/or any other suitable plastic), plastic coated plywood, nylon, resin, plaster, rubber, polymers, laminate, fiberglass, stone, natural materials, acrylic polymer, alumina trihydrate, rubber, thermoplastic, fabric, leather, conveyor belt (e.g., for a treadmill wall), ultra-high-molecular-weight polyethylene, lightweight high-strength oriented-strange polyethylene gels, dyneema, poly-paraphenylene terephthalamide, Kevlar, woven fabrics, and/or other suitable materials. Indeed, in some embodiments, the panels comprise plywood, OSB, MDF, and/or recycled plastic plywood.

The described climbing walls 10 can also be made in any suitable manner. In this regard, some non-limiting examples of methods for making the described climbing walls include, cutting, folding, bending, molding, shaping, extruding, drilling, sanding, plaining, using a computer numerical control device, connecting various pieces with one or more adhesives, mechanical fasteners (e.g., clamps, rivets, crimps, pins, brads, nails, staples, pegs, clips, screws, bolts, threaded attachments, couplers, etc.), 3D printing, additive manufacturing, welding pieces together, connecting pieces together, ultra-high-molecular-weight polyethylene, lightweight high-strength oriented-strange polyethylene gels, dyneema, poly-paraphenylene terephthalamide, Kevlar, polymers, woven fabrics, and/or any other suitable method that allows the described climbing walls to perform their intended functions. In some embodiments, the climbing panels 55 are made with a CNC cutting tool.

In addition to the aforementioned features, the described climbing wall 10 can have any other suitable feature. Indeed, in one example, some embodiments the climbing wall can be relatively easy to assemble (e.g., allowing one or more people to assemble it with relatively few tools, such as an Allen wrench, a screwdriver, etc.). In some embodiments, the wall can be assembled in a relatively short period of time. In still other embodiments, the wall can weigh relatively little. Indeed, while some competing artificial rock walls can weigh hundreds of kg (kilograms) (e.g., in some cases 540 kg or more), some embodiments of the described wall weigh less than 100 kg (e.g., less than about 40 kg).

As another example of a feature, some embodiments of the climbing wall 10 allow for the climbing surface 15 to be moved to many (if not an infinite number) of positions (or angles). In still another example, some embodiments of the described climbing wall are configured to automatically change in position, provide training, record movements, provide communication channels with one or more parties in one or more remote locations, and/or otherwise provide dynamic interaction as the wall is used.

Representative Operating Environment

The described climbing wall 10 can be used with or in any suitable operating environment and/or software. In this regard, FIG. 28 and the corresponding discussion are intended to provide a general description of a suitable operating environment (e.g., computer system 500) in accordance with some embodiments of the described systems and methods. As will be further discussed below, some embodiments embrace the use of one or more processing (including, without limitation, micro-processing) units in a variety of customizable enterprise configurations, including in a networked configuration, which may also include any suitable cloud-based service, such as a platform as a service or software as a service.

Some embodiments of the described systems and methods embrace one or more computer readable media, wherein each medium may be configured to include or includes thereon data or computer executable instructions for manipulating data. The computer executable instructions include data structures, objects, programs, routines, or other program modules that may be accessed by one or more processors, such as one associated with a general-purpose processing unit capable of performing various different functions or one associated with a special-purpose processing unit capable of performing a limited number of functions. In this regard, in some embodiments, the processing unit 500 (described above) comprises a specialized processing unit that is configured for use with the described system 10.

Computer executable instructions cause the one or more processors of the enterprise to perform a particular function or group of functions and are examples of program code means for implementing steps for methods of processing (e.g., actuating one or more actuators, moving hole or more holds 200, providing moisture, receiving and/or using sensor readings, etc.). Furthermore, a particular sequence of the executable instructions provides an example of corresponding acts that may be used to implement such steps.

Examples of computer readable media (including non-transitory computer readable media) include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing unit.

Figure 28:
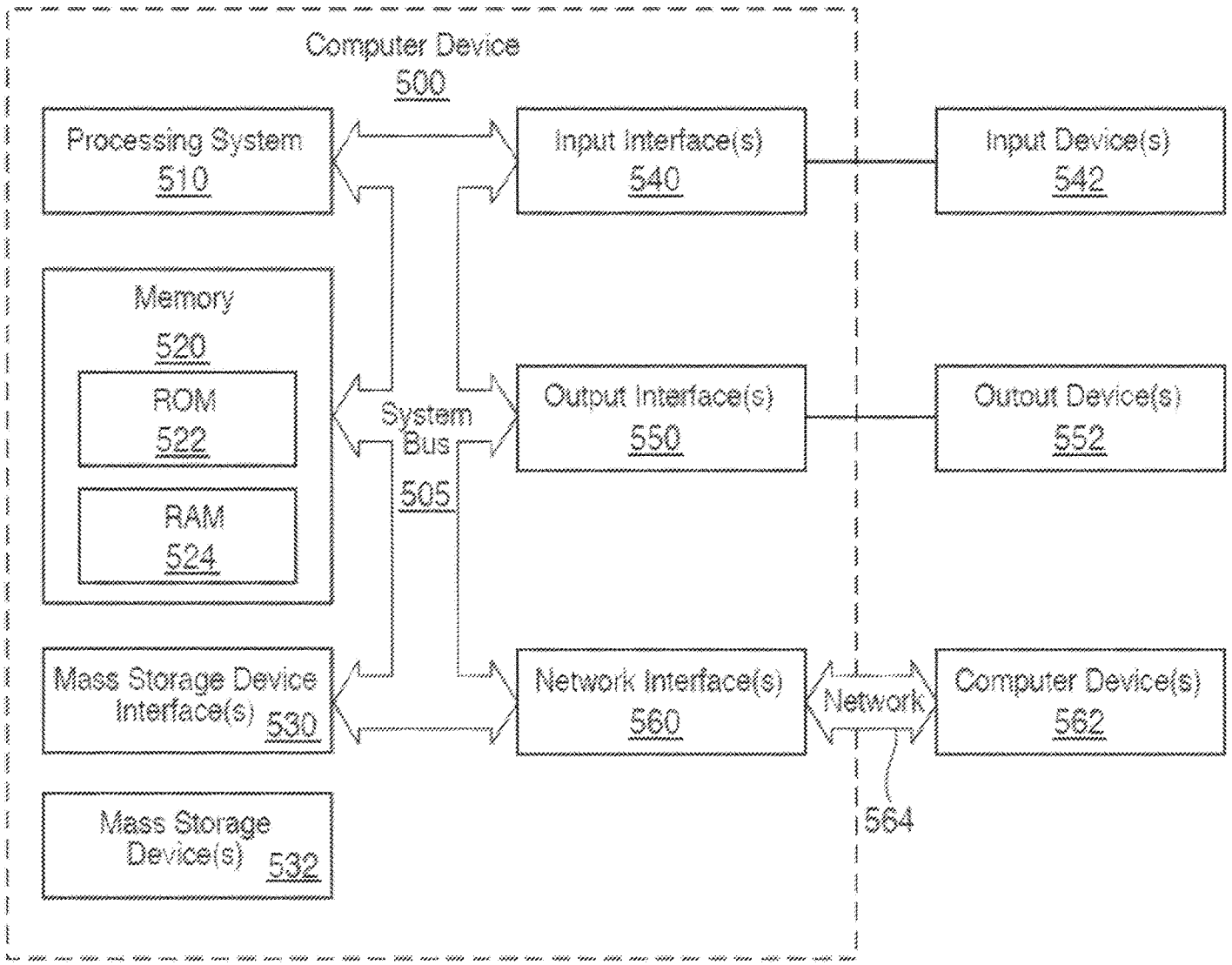
FIG. 28 illustrates a representative system that provides a suitable operating environment for use with some embodiments of the adjustable climbing wall.
Figure 29:
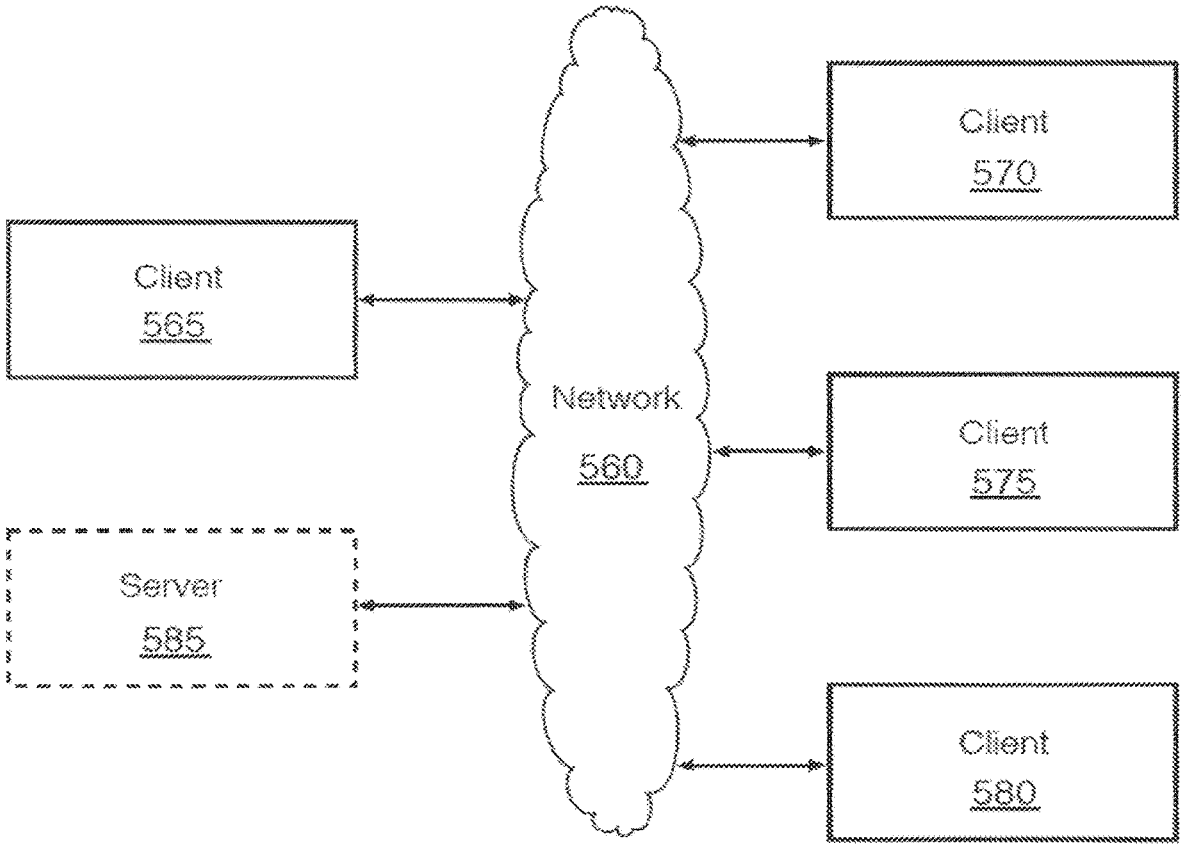
FIG. 29 illustrates a representative embodiment of a networked system that provides a suitable operating environment for use with some embodiments of the adjustable climbing wall.

With reference to FIG. 28, a representative system includes computer device 500 (e.g., a computer processor and/or other control unit), which may be a general-purpose or special-purpose computer. For example, computer device 500 may be a personal computer, a smartphone, a tablet, a notebook computer, a PDA or other hand-held device, a workstation, a minicomputer, a mainframe, a supercomputer, a multi-processor system, a gaming console (e.g., a PlayStation, X-Box, and/or any other suitable type of gaming console), a user interface 91, a network computer, a processor-based consumer device, a cellular phone, a tablet computer, a smart phone, a feature phone, a smart appliance or device, a control system, and/or the like.

Computer device 500 includes system bus 505, which may be configured to connect various components thereof and enables data to be exchanged between two or more components. System bus 505 may include one of a variety of bus structures including a memory bus or memory controller, a peripheral bus, or a local bus that uses any of a variety of bus architectures. Typical components connected by system bus 505 include processing system 510 and memory 520. Other components may include one or more mass storage device interfaces 530, input interfaces 540, output interfaces 550, and/or network interfaces 560, each of which will be discussed below.

Processing system 510 includes one or more processors, such as a central processor and optionally one or more other processors designed to perform a particular function or task. It is typically processing system 510 that executes the instructions provided on computer readable media, such as on the memory 520, a magnetic hard disk, a removable magnetic disk, a magnetic cassette, an optical disk, or from a communication connection, which may also be viewed as a computer readable medium.

Memory 520 includes one or more computer readable media (including, without limitation, non-transitory computer readable media) that may be configured to include or includes thereon data or instructions for manipulating data, and may be accessed by processing system 510 through system bus 505. Memory 520 may include, for example, ROM 522, used to permanently store information, and/or RAM 524, used to temporarily store information. ROM 522 may include a basic input/output system ("BIOS") having one or more routines that are used to establish communication, such as during start-up of computer device 500. RAM 524 may include one or more program modules, such as one or more operating systems, application programs, and/or program data.

One or more mass storage device interfaces 530 may be used to connect one or more mass storage devices 532 to the system bus 505. The mass storage devices 532 may be incorporated into or may be peripheral to the computer device 500 and allow the computer device 500 to retain large amounts of data. Optionally, one or more of the mass storage devices 532 may be removable from computer device 500. Examples of mass storage devices include hard disk drives, magnetic disk drives, tape drives, solid state mass storage, and optical disk drives.

Examples of solid-state mass storage include flash cards and memory sticks. A mass storage device 532 may read from and/or write to a magnetic hard disk, a removable magnetic disk, a magnetic cassette, an optical disk, or another computer readable medium. Mass storage devices 532 and their corresponding computer readable media provide nonvolatile storage of data and/or executable instructions that may include one or more program modules, such as an operating system, one or more application programs, other program modules, or program data. Such executable instructions are examples of program code means for implementing steps for methods disclosed herein.

One or more input interfaces 540 may be employed to enable a user to enter data (e.g., initial information) and/or instructions to computer device 500 through one or more corresponding input devices 542. Examples of such input devices include a keyboard and/or alternate input devices, such as a digital camera, a sensor, bar code scanner, debit/credit card reader, signature and/or writing capture device, pin pad, touch screen, mouse, trackball, light pen, stylus, or other pointing device, a microphone, a joystick, a game pad, a scanner, a camcorder, and/or other input devices. Similarly, examples of input interfaces 440 that may be used to connect the input devices 542 to the system bus 505 include a serial port, a parallel port, a game port, a universal serial bus ("USB"), a firewire (IEEE 1394), a wireless receiver, a video adapter, an audio adapter, a parallel port, a wireless transmitter, or another interface.

One or more output interfaces 550 may be employed to connect one or more corresponding output devices 552 to system bus 505. Examples of output devices include a monitor or display screen, a speaker, a wireless transmitter, a printer, and the like. A particular output device 552 may be integrated with or peripheral to computer device 500. Examples of output interfaces include a video adapter, an audio adapter, a parallel port, and the like.

One or more network interfaces 560 enable computer device 500 to exchange information with one or more local or remote computer devices, illustrated as computer devices 562, via a network 564 that may include one or more hardwired and/or wireless links. Examples of the network interfaces include a network adapter for connection to a local area network ("LAN") or a modem, BLUETOOTH', WiFi, a cellular connection, a wireless link, or another adapter for connection to a wide area network ("WAN"), such as the Internet. The network interface 560 may be incorporated with or be peripheral to computer device 500.

In a networked system, accessible program modules or portions thereof may be stored in a remote memory storage device. Furthermore, in a networked system computer device 500 may participate in a distributed computing environment, where functions or tasks are performed by a plurality networked computer devices. While those skilled in the art will appreciate that the described systems and methods may be practiced in networked computing environments with many types of computer system configurations, FIG. 28 represents an embodiment of a portion of the described systems in a networked environment that includes clients (565, 570, 575, etc.) connected to a server 585 via a network 560.

While FIG. 28 illustrates an embodiment that includes 3 clients (e.g., climbing walls 10, processors 500 coupled to gaming walls, etc.) connected to the network, alternative embodiments include at least one client connected to a network or many clients connected to a network. Moreover, embodiments in accordance with the described systems and methods also include a multitude of clients throughout the world connected to a network, where the network is a wide area network, such as the Internet. Accordingly, in some embodiments, the described systems and methods can allow for remote: remote gaming on the climbing wall 10; monitoring, training, and/or communication between climbing walls (and/or other suitable devices); variation of the climbing wall (e.g., by having a program, a trainer, a friend, and/or other entity in another location vary a position of the climbing surface 15 and/or otherwise varying the climbing wall 10); observation, control, adjustment, trouble shooting, data collecting, system optimization, user interaction, and/or any suitable type of other controlling of the wall from one or more places throughout the world.

Thus, as discussed herein, embodiments of the present invention embrace systems and methods for climbing. More particularly, some implementations of the described invention relate to systems and methods for providing an adjustable climbing wall having a climbing surface that is readily adjustable to a plurality of positions.

The present invention may be embodied in other specific forms without departing from its spirit or essential characteristics. The described embodiments, examples, and illustrations are to be considered in all respects only as illustrative and not restrictive. The scope of the invention is, therefore, indicated by the appended claims rather than by the foregoing description. All changes that come within the meaning and range of equivalency of the claims are to be embraced within their scope. In addition, as the terms on, disposed on, attached to, connected to, coupled to, etc. are used herein, one object (e.g., a material, element, structure, member, etc.) can be on, disposed on, attached to, connected to, or coupled to another object—regardless of whether the one object is directly on, attached, connected, or coupled to the other object, or whether there are one or more intervening objects between the one object and the other object. Also, directions (e.g., front back, on top of, below, above, top, bottom, side, up, down, under, over, upper, lower, lateral, forward, backward, etc.), if provided, are relative and provided solely by way of example and for ease of illustration and discussion and not by way of limitation. Where reference is made to a list of elements (e.g., elements a, b, c), such reference is intended to include any one of the listed elements by itself, any combination of less than all of the listed elements, and/or a combination of all of the listed elements. Furthermore, as used herein, the terms a, an, and one may each be interchangeable with the terms at least one and one or more.

What is claimed is:

1. A climbing wall comprising:

a first support;

a climbing surface pivotally coupled to the first support and configured to selectively pivot forward through a forward range of motion and backward through a backward range of motion, wherein the climbing surface comprises multiple climbing hold couplers that are each configured to hold a climbing hold on a front side of the climbing surface, and wherein the forward range of motion is towards a climber when the climber is on the front side of the climbing surface;

a lever arm having a first portion that is pivotally coupled at a first coupling to a second support;

a lever arm coupler having a first part that is coupled to a second portion of the lever arm at a second coupling and having a second part that is coupled to the climbing surface at a third coupling; and an actuator configured to pivot the climbing surface through the forward range of motion and the backward range of motion, the actuator having a first section that is coupled to a third support and a second section that is coupled to the lever arm at a fourth coupling, wherein as the actuator pivots the climbing surface through the forward range of motion, a weight of the climbing surface rests on the actuator and the actuator is in linear compression.

2. The climbing wall of claim 1, wherein the first support and the second support comprise one single support.

3. The climbing wall of claim 1, wherein the fourth coupling is disposed behind the climbing surface.

4. The climbing wall of claim 1, wherein the first coupling, the second coupling, and the fourth coupling are disposed in a non-linear configuration.

5. The climbing wall of claim 1, wherein the first coupling, the second coupling, and the fourth coupling are disposed in a triangular configuration.

6. The climbing wall of claim 1, further comprising a first gas spring and a second gas spring that are coupled to and extend between the third support and the lever arm, with the first gas spring and the second gas spring each being disposed on an opposite side of the actuator.

7. The climbing wall of claim 1, wherein the actuator is configured to dynamically modify an angle of the climbing surface as the climber is on the front side of the climbing surface by pivoting the climbing surface through at least one of the forward range of motion and the backward range of motion.

8. The climbing wall of claim 1, wherein the climbing surface comprises an addressable light strip that runs in proximity to the multiple climbing hold couplers, wherein the addressable light strip comprises a plurality of light sources that are configured to light up to identify individual climbing holds while other light sources on the addressable light strip are not lit up.

* * * * *